US011511909B1

(12) United States Patent
Rivera Velez et al.

(10) Patent No.: US 11,511,909 B1
(45) Date of Patent: Nov. 29, 2022

(54) LIGHTWEIGHT CONTACT LENS BLISTER PACKAGES AND METHODS FOR RECYCLING SAME

(71) Applicant: CooperVision International Limited, Fareham (GB)

(72) Inventors: Jesus Javier Rivera Velez, Juana Diaz, PR (US); Javier E. Alayon Rivera, Juana Diaz, PR (US); Jose A. Burgos Cruz, Coamo, PR (US); Lucas Sievens Figueroa, San Juan, PR (US)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 0 days.

(21) Appl. No.: 17/872,025

(22) Filed: Jul. 25, 2022

Related U.S. Application Data

(60) Provisional application No. 63/347,706, filed on Jun. 1, 2022, provisional application No. 63/347,732, filed on Jun. 1, 2022.

(51) Int. Cl.
*B65D 21/032* (2006.01)
*B65D 21/02* (2006.01)

(52) U.S. Cl.
CPC ..... *B65D 21/0228* (2013.01); *B65D 21/0233* (2013.01); *B65D 2585/545* (2013.01)

(58) Field of Classification Search
CPC ..... B65D 2585/545; B65D 21/0228; B65D 21/0233; B65D 21/0201; B65D 21/0204;
(Continued)

(56) References Cited

U.S. PATENT DOCUMENTS 4,691,820 A 9/1987 Martinez
5,467,868 A 11/1995 Abrams et al.
(Continued)

FOREIGN PATENT DOCUMENTS

CN 105522664 A 4/2016
EP 1092645 A1 4/2001
(Continued)

OTHER PUBLICATIONS

Contact Lens and Packaging Recycling, www.binyonvision.com/2018/05/10/contact-lens-and-packaging-recycling/, Mar. 12, 2021 (3 pages).
(Continued)

*Primary Examiner* — Stephen J Castellano
(74) *Attorney, Agent, or Firm* — Kilyk & Bowersox, P.L.L.C.

(57) ABSTRACT

Contact lens packages are provided and each includes a base member having a cavity and a sealing member coupled to the base member. An unworn contact lens is provided in a packaging solution within the sealed cavity. The base member is a thermoplastic or other recyclable material. The base member includes at least one connecting member that can be an interlocking feature and/or a stackable feature. The connecting member is configured to connect to the connecting member of another base member, after the contact lenses are removed from the cavities. A recyclable thermoplastic contact lens assembly is also provided that includes empty contact lens package base members stacked and connected together. A method of manufacturing contact lens packages and a method to recycle used contact lens package base members, such as by curbside recycling, are also provided.

30 Claims, 19 Drawing Sheets

(58) Field of Classification Search
CPC ..... B65D 21/0212; B65D 21/0209; B65D 21/0235
See application file for complete search history.

(56) References Cited

U.S. PATENT DOCUMENTS

| | | | | |
|---|---|---|---|---|
| 5,609,246 | A | 3/1997 | Borghorst et al. | |
| 5,620,087 | A | 4/1997 | Martin et al. | |
| 5,620,088 | A | 4/1997 | Martin et al. | |
| 5,685,420 | A | 11/1997 | Martin et al. | |
| 5,722,536 | A | 3/1998 | Pierce et al. | |
| 6,398,018 | B1 | 6/2002 | Livesley et al. | |
| 6,471,052 | B2 | 10/2002 | Faxe et al. | |
| 6,474,465 | B1 | 11/2002 | Jux | |
| 7,188,729 | B2 | 3/2007 | DeJonge | |
| D543,103 | S | 5/2007 | Roche et al. | |
| 7,213,382 | B2 | 5/2007 | Voss et al. | |
| 7,426,993 | B2 | 9/2008 | Coldrey et al. | |
| 7,477,366 | B2 | 1/2009 | Clements et al. | |
| 7,789,223 | B2 | 9/2010 | Tokarski et al. | |
| 8,069,979 | B2 | 12/2011 | Newman et al. | |
| 9,173,463 | B2 | 11/2015 | Clamp et al. | |
| 9,655,423 | B1 | 5/2017 | Wang | |
| 10,159,625 | B2 | 12/2018 | Sowden et al. | |
| 10,390,593 | B2 | 8/2019 | English et al. | |
| 2005/0247580 | A1 | 11/2005 | Hamilton | |
| 2007/0034533 | A1 | 2/2007 | Coldrey et al. | |
| 2012/0006695 | A1* | 1/2012 | Kawai | B65B 25/008 351/159.02 |
| 2014/0246337 | A1* | 9/2014 | Newman | B32B 27/365 53/467 |
| 2016/0015139 | A1 | 1/2016 | Clamp et al. | |
| 2019/0039798 | A1 | 2/2019 | Davis | |
| 2020/0229560 | A1 | 7/2020 | Almond et al. | |
| 2020/0229563 | A1 | 7/2020 | Almond et al. | |
| 2020/0231351 | A1 | 7/2020 | Almond et al. | |
| 2021/0394986 | A1 | 12/2021 | Ellis et al. | |

FOREIGN PATENT DOCUMENTS

| | | | |
|---|---|---|---|
| EP | 1799585 | B1 | 7/2010 |
| EP | 2526808 | B1 | 10/2015 |
| GB | 2520297 | A | 5/2015 |
| JP | 2006016049 | A | 1/2006 |
| JP | 5184925 | B2 | 4/2013 |
| KR | 101907956 | B1 | 10/2018 |
| WO | 9821995 | A1 | 5/1998 |
| WO | 2005073105 | A2 | 8/2005 |
| WO | 2014185354 | A1 | 11/2014 |

OTHER PUBLICATIONS

U.S. Appl. No. 17/872,029, filed Jul. 25, 2022 (119 pages).
U.S. Appl. No. 17/868,811, filed Jul. 20, 2022 (62 pages).
International Search Report and Written Opinion issued in corresponding International Patent Application No. PCT/GB2022/051883 dated Oct. 18, 2022 (15 pages).

* cited by examiner

LIGHTWEIGHT CONTACT LENS BLISTER PACKAGES AND METHODS FOR RECYCLING SAME

This application claims the benefit under 35 U.S.C. § 119(e) of prior U.S. Provisional Patent Application No. 63/347,706, filed Jun. 1, 2022 and U.S. Provisional Patent Application No. 63/347,732, filed Jun. 1, 2022, which are incorporated in its entirety by reference herein.

FIELD

The present invention relates to contact lens packaging and the recycling of at least parts of the packaging. More particularly, the present invention relates to contact lens packages that are lightweight at least with respect to the plastic base member. The present invention further relates to various methods to recycle at least a plurality of base members of such packages after they are used.

BACKGROUND

There are various demands on consumer products from an environmental impact point of view and recycling point of view. The contact lens industry has struggled in the past to address these needs partly due to the size and shape of the contact lens blister packaging that has in the past been used.

Further with respect to recycling, newly manufactured contact lenses are frequently packaged in contact lens blister packages or blister packs. For example, a newly manufactured contact lens will be placed in a cavity or bowl of a plastic base member of a contact lens blister package, a contact lens packaging solution will be provided in the blister package cavity, and a foil sealing member will be adhered to the top surface of the base member to hermetically seal the contact lens and packaging solution, in the cavity. In other words, a contact lens blister package contains a base member having a cavity, an unworn contact lens provided in packaging solution within the cavity, and a sealing member sealed to the base member to provide an air tight seal around the perimeter of the cavity.

Base members of blister packages are generally formed of a plastic or thermoplastic material. It is common for a user to peel away the sealing member, take the unworn contact lens out of the cavity, and discard the empty blister package, or the plastic base member, in the trash such that it is not recycled. Each individual blister package, or plastic base member, is too small to be recycled as plastic at most recycling centers because most recycling processes for plastic require minimum dimensions of the plastic to be recycled. If such dimensions are not met, most recycling processing lines have steps to remove these smaller objects and avoid recycling them. In other words, objects like individual blister packages are not recycled and instead are treated as non-recyclable trash or waste. The material that the contact lens package is made of, however, is a recyclable material. Accordingly, there is a need to address this problem so that contact lens packaging can be recycled by recycling centers.

It can be appreciated that there remains an important environmental need to improve contact lens packaging to reduce the environmental impact of the packaging.

SUMMARY

A feature of the present invention is to provide a contact lens blister package, especially the base member, that is light weight or lighter in weight than conventional blister packages in use previously.

An additional feature of the present invention is to provide a contact lens blister package that utilizes less thermoplastic polymer and yet provides the same or comparable structural features of conventional blister packages in use previously.

A further feature of the present invention is to provide a contact lens wearer with the ability to successfully have the contact lens package (or a portion thereof) accepted as recyclable material at a recycling facility or MRF (Materials Recovery Facility).

An additional feature of the present invention is to provide a method for a contact lens wearer or purchaser to easily recycle contact lens packages or portions thereof (e.g., curbside recycling).

A further feature of the present invention is to provide a contact lens wearer or purchaser a simple way to recycle used or opened contact lens packages, for example, by curbside recycling.

Also, a feature of the present invention is to provide a way to recycle used or opened contact lens packages as a collective unit such that the packages that form the collective unit preferably do not break or separate during transport to and during initial processing steps at a recycling facility.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention, in part, relates to a contact lens blister package that includes a thermoplastic base member. The thermoplastic base member includes a planar top surface having an edge and at least partially defining a handle, a bottom surface, and a bowl that is recessed from the planar top surface. The bowl has an upper rim that intersects with the planar top surface, and defines a blister cavity configured or dimensioned for holding a contact lens. The handle extends away from the bowl and terminates at a handle end. The base member, which is a thermoplastic base member is light weight. The thermoplastic base member preferably has a weight of from 0.40 g to 0.72 g. A flange projects away from the blister cavity. The flange provides a sealing ring region (or sealing ring) circumscribing the blister cavity. The flange further provides a gripping portion configured to be held between a thumb and a finger of a contact lens wearer. The contact lens blister package further includes a liquid contact lens packaging solution (at room temperature or 20 to 25 deg C.) provided in the blister cavity, and an unworn contact lens located in the liquid contact lens packaging solution in the cavity and a sealing member hermetically sealed to the sealing ring region of the thermoplastic base member to maintain the contact lens in a sterile condition.

The present invention, in part, further relates to the contact lens blister package that has a connecting member or feature. The connecting member can be an interlocking feature(s) and/or a stackable feature(s) configured such that two or more used or empty thermoplastic base members of the contact lens blister package can be interlocked or stacked together securely, such as for recycling purposes.

The present invention, in part, further relates to a method of manufacturing a packaged contact lens. The method includes the steps of providing a contact lens blister package as described herein, placing a contact lens into the blister cavity of the thermoplastic base member, placing a volume of liquid contact lens packaging solution into the blister cavity of the thermoplastic base member; and sealing a sealing member to the sealing rim region of the thermoplastic base member. The method can further include autoclaving the sealed contact lens blister package to sterilize the contact lens and the packaging solution.

In addition, the present invention relates to a method of recycling the contact lens blister package as described herein. The method includes the steps of removing the sealing member from the thermoplastic base member and then removing the contact lens from the blister cavity; and then removing the liquid contact lens packaging solution from the blister cavity. The method then includes coupling at least two of the thermoplastic base members of two contact lens blister packages by utilizing the connecting member that is part of the base member. The coupling can be or include inserting the proximal end of one thermoplastic base member into the hole of the second thermoplastic base member to form a thermoplastic base member assembly, or coupling at least two of the thermoplastic base members of two contact lens blister packages by inserting the bowl or blister cavity of one thermoplastic base member into the bowl or blister cavity of the second thermoplastic base member to form the thermoplastic base member assembly, or coupling at least two of the thermoplastic base members of two contact lens blister packages by inserting a pin or post (e.g., located on or near the proximal end) of one thermoplastic base member into a receiving slot or receptable (e.g., located on or near the proximal end) of the second thermoplastic base member to form the thermoplastic base member assembly. The connecting of two or more base members can form a mechanical connection (e.g., a mechanical interlock or mechanical stacking). The connection of two or more base members can provide an interference fit as part of the mechanical connection.

It is to be understood that both the foregoing general description and the following detailed description are exemplary and explanatory only and are intended to provide a further explanation of the present invention, as claimed.

The accompanying drawings, though not drawn to scale, exemplify relative dimensions that can be used. The accompanying drawings are incorporated in and constitute a part of this application and illustrate some of the features of the present invention. The drawings, together with the description, serve to explain the principles of the present invention.

DETAILED DESCRIPTION

Figure 1A:
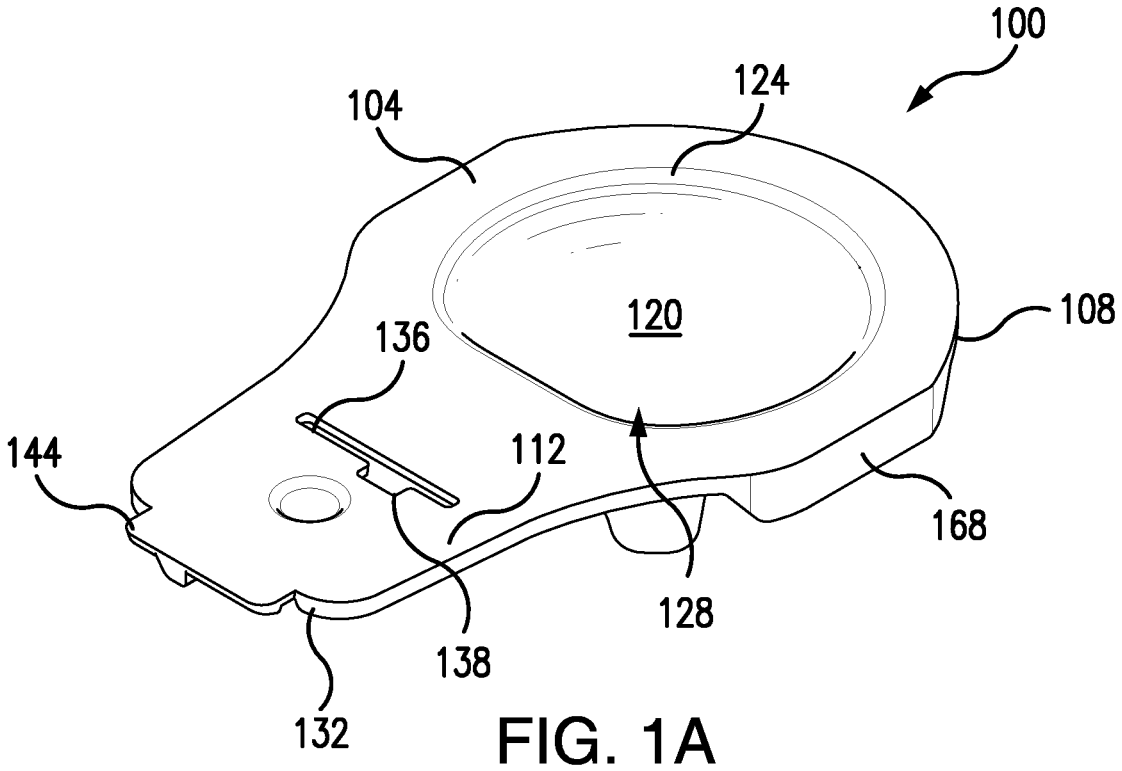
FIG. 1A is a top view of a contact lens package base member according to an exemplary embodiment of the present invention.

The present invention relates to contact lens packages or contact lens blister packages, as well as to methods of manufacturing contact lenses, and methods of recycling used contact lens packages or the base members of the contact lens packages.

The present invention further relates to a contact lens package base member stack or assembly comprising a collection of used contact lens package base members that are mechanically fastened together (e.g., using an interlocking feature and/or a stackable feature that can be present as part of the thermoplastic base member).

The present invention also relates to methods of attaching used contact lens package base members together to form a recyclable assembly of used contact lens package base members that is suitable as a recyclable material, for example, by exhibiting acceptable dimensions required or requested for recycling.

In one aspect of the present invention, when a connecting member (e.g., the interlocking feature or the stackable feature) is present on the thermoplastic base member, the present invention enables used contact lens package base members to become sorted, for example, processed, and recycled at recycling facilities, such as materials recovery facilities (MRFs). In other words, the present invention enables a user or other person to recycle used or opened contact lens package base members (e.g., blister packages) or portions thereof and enables the user or other person to form a recyclable unit from a plurality of opened or used contact lens package base members (e.g., blister package base members), wherein the unit exhibits dimensions that can be acceptable in size for sorting facilities and withstand the handling/sorting. Thus, with the present invention, recycling, such as curbside recycling, is possible and feasible and easy to accomplish by the contact lens wearer or purchaser.

The present invention provides a contact lens user or another person, with a simple way to recycle opened or used contact lens package base members, for example, by curbside recycling.

As an option, each of the contact lens base members can include one or more connecting members for connecting the base member or members of one or more other contact lens packages of the plurality, such that the so connected base packages, base members, or both, form a recyclable assembly, unit, or item.

In more detail, the present invention relates to a contact lens blister package. The blister package can comprise or include a thermoplastic base member having a weight from 0.40 g to 0.72 g.

The weight of the thermoplastic base member is based on the dry weight of the thermoplastic base member by itself (i.e., weight based on no liquid and no solution present and does not include any sealing member).

It is believed that the present contact lens blister packages have the lightest weight thermoplastic base member of which the inventors are aware. Several commercially available blister pack plastic base members were dried and weighed, as presented in Table 1 below:

TABLE 1

| Manufacturer | Product | Average Weight (g) | Standard Deviation | Range (g) |
|---|---|---|---|---|
| JJVC | OASYS | 0.75 | 0.013 | 0.732-0.766 |
| JJVC | OASYS 1-DAY | 1.23 | 0.003 | 1.231-1.238 |
| JJVC | ACUVUE2 | 0.74 | 0.005 | 0.732-0.743 |
| JJVC | TRUEYE | 1.23 | 0.010 | 1.226-1.247 |
| Alcon | AIROPTIX | 1.02 | 0.007 | 1.014-1.030 |
| Alcon | PRECISION 1 | 1.04 | 0.011 | 1.021-1.052 |
| Alcon | TOTAL 1 | 1.07 | 0.011 | 1.051-1.081 |
| Alcon | DAILIES AQUA COMFORT PLUS | 1.04 | 0.008 | 1.031-1.053 |
| Alcon | TOTAL30 | 1.05 | 0.008 | 1.045-1.063 |
| B&L | ULTRA | 0.87 | 0.016 | 0.859-0.896 |
| B&L | BIOTRUE 1-DAY | 1.59 | 0.007 | 1.581-1.599 |
| B&L | PUREVISION2 | 2.74 | 0.005 | 2.730-2.741 |
| B&L | INFUSE | 0.84 | 0.011 | 0.829-0.854 |
| CooperVision | MYDAY | 1.11 | 0.012 | 1.088-1.122 |
| CooperVision | BIOFINITY | 2.05 | 0.020 | 2.035-2.085 |
| CooperVision | AVAIRA VATALITY | 1.07 | 0.005 | 1.064-1.077 |
| CooperVision | CLARITI 1 DAY | 0.96 | 0.006 | 0.950-0.965 |
| CooperVision | PROCLEAR 6 PACK | 2.07 | 0.005 | 2.066-2.080 |
| CooperVision | PROCLEAR 1 DAY | 0.99 | 0.021 | 0.960-1.016 |
| CooperVision | BIOMEDICS 55 6 PACK | 2.08 | 0.011 | 2.071-2.093 |
| CooperVision | MISIGHT | 0.97 | 0.019 | 0.954-0.992 |

For each commercial product, five blister pack base members were weighed using a conventional scale, and the average weight in grams is provided in Table 1 (the weights have been rounded to two significant digits). The range for the base member weights is provided in the right column. The Acuvue 2 and Oasys contact lens blister packs had the lightest weight base member of 0.732 grams. Examples of blister packs are shown in the following patent or patent application publications: EP1092645 A1, U.S. Pat. No. 7,213,382, EP1092645 A1, U.S. Pat. Nos. 7,213,382, 5,609,246, 5,609,246, 5,609,246, 5,609,246, 10/390,593, 7,426,993, 10/390,593, 7,426,993, 7,477,366, 6,398,018, and 7,477,366. Blister pack base members in these patents are visually similar to the actual weighed blister packs of the commercial products identified in Table 1.

The blister package of the present invention, including the thermoplastic base member, can have any design with respect to the base member and sealing member and optionally has a connecting feature(s) or member(s), as further described herein.

For purposes of the present invention, the term "thermoplastic base member" is used interchangeable with "base member" or "plastic base member". The term "bowl" defines the same area as the "blister cavity".

The blister package, and specifically, the thermoplastic base member, includes a blister cavity dimensioned to accommodate a contact lens, such as a soft contact lens. A soft contact lens can be a hydrogel contact lens in that it has an equilibrium water content (EWC) from 10-90%. Preferably, the soft contact lens is a silicone hydrogel contact lens (that is, a hydrogel contact lens that comprises polymeric units derived from at least one silicone-containing chemical).

The blister package, when new, includes a liquid contact lens packaging solution provided in the blister cavity.

The blister package, when new, also includes an unworn contact lens located in the contact lens packaging solution in the cavity.

The blister package, when new, further includes a sealing member hermetically sealed to the sealing ring region of the thermoplastic base member to maintain the contact lens in a sterile condition. The sealing member can be a laminated foil material. The thickness of the sealing member can be from about 50 micrometers to about 100 micrometers or other thicknesses. Suitable materials for the sealing member can be obtained from AMCOR (Switzerland).

With respect to the weight of the thermoplastic base member of the present invention, the base member is light weight in view of the weight being 0.72 g or less. The weight can be 0.40 g to 0.72 g, such as from 0.40 g to 0.70 g, from 0.40 g to 0.60 g, from 0.40 g to 0.50 g, from 0.45 g to 0.72 g, from 0.50 g to 0.70 g, from 0.55 g to 0.70 g, from 0.60 g to 0.70 g. The weight provided is for the empty thermoplastic base member—meaning not taking into account the sealing member, contact lens, or packaging solution.

The thermoplastic base member has a shape and design or structural features that includes a blister cavity or bowl or recess. The blister cavity is dimensioned to accommodate a contact lens.

The base member includes a flange projecting away from the blister cavity. The flange provides a sealing ring region (e.g., a top surface or top planar surface) that circumscribes the blister cavity. The flange also includes or provides a gripping portion configured to be held between a thumb and a finger of a contact lens wearer. The gripping portion can be considered a handle.

The base member has an upper surface, an edge that circumscribes the base member, and a lower surface. The upper surface can be considered the top surface. The lower surface can be considered the bottom surface.

The gripping portion of the flange is located at a proximal end of the flange and the blister cavity is located closer to a distal end of the flange. The flange includes an upper surface and a lower surface.

The blister cavity of the thermoplastic base member has a concave interior surface and a convex exterior surface. The concave interior surface is present as part of the upper surface of the base member, and the convex exterior surface is present as part of the lower surface of the base member.

The blister cavity has a depth. The depth can be uniform or not uniform across the surface area of the blister cavity. The depth can be from 5.0 mm to 8.0 mm, such as from 6.0 mm to 7.1 mm, or from 6.5 mm to 7.0 mm. The depth, when measured, is the deepest area in the blister cavity.

The bister cavity or bowl is dimensioned such that the liquid contact lens packaging solution can be present in an amount from 0.4 mL to 1.6 mL (e.g., from 0.5 mL to 1.4 mL or from 0.6 mL to 1.0 mL, or about 0.6 mL or 0.6 mL, or about 0.7 mL or 0.7 mL, or about 0.8 mL or 0.8 mL, or amounts above or below any one of these ranges).

The thermoplastic base member has a length (e.g., an overall length) and a width (e.g., an overall width). The length can be from 40.0 mm to 50.0 mm, such as from 40.0 mm to 45.0 mm. The width can be from 25.0 mm to 35.0 mm, such as from 30.0 to 35.0 mm. The length is based on the largest measured length from the edge of the handle or gripping portion (e.g., the handle end) to the opposite edge that is adjacent to the blister cavity or bowl. The width (perpendicular to the length described herein) is based on the largest measured width from side to side of the base member, which generally the one side edge adjacent the blister cavity or bowl to the opposing side edge that is adjacent the blister cavity or bowl.

The thermoplastic base member has a thickness with respect to the thermoplastic material or polymer that forms the shape of the various features of the base member. The thickness can be uniform or substantially uniform (e.g., not varying by more than 5%) throughout the base member. In the alternative, the base member can have certain design features that have a thickness that is different from other design features of the base member.

For instance, the blister cavity or bowl can have a different thickness compared to the gripping portion of the base member and/or compared to the sealing ring region of the base member.

For example, the thickness of the thermoplastic that defines the blister cavity can be different from the thickness of the same thermoplastic material that defines the flange of the base member.

As a more specific example, the thermoplastic base member has a thickness, and the blister cavity is defined by a curved surface having a thickness of X mm, and the flange of the thermoplastic base member has a thickness that is no greater than X (e.g., no greater than 95% of X, or no greater than 90% of X, or no greater than 85% of X, or no greater than 80% of X, or the thickness is 80% to 95% of X).

The term 'thickness' can be considered an average thickness for the referenced area. Further purposes of the present invention, unless stated otherwise, any dimension, weight, or other parameter can, as an option, be considered an average value.

The thermoplastic base member can be characterized by physical properties and/or mechanical properties and/or material properties (e.g., relating to polymer rigidness, strength, and/or other properties).

For instance, the thermoplastic base member, or a portion thereof, can have a flexural modulus of from 1600 MPa (232,000 psi) to 1900 MPa (275,500 psi), as measured using the ISO 178 testing method. The modulus can be from 1600 MPa to 1850 MPa or from 1600 MPa to 1800 MPa, or from 1600 MPa to 1750 MPa, or from 1600 MPa to 1700 MPa, or from 1650 MPa to 1900 MPa, or from 1700 MPa to 1900 MPa, or from 1750 MPa to 1900 MPa, or from 1800 MPa to 1900 MPa. Other amounts below or above any one of these ranges is also an option. The flexural modulus can be measured using conventional equipment, such as equipment provided by Instron (Norwood, Mass., USA) or the equipment can be specified by the plastics manufacturer as part of the plastics technical data.

For instance, the thermoplastic base member, or a portion thereof, can have a flange that has a stiffness from 50,000 psi·mm$^2$ to 150,000 psi·mm$^2$, such as from 60,000 psi·mm$^2$ to 90,000 psi·mm$^2$, or from 60,000 psi·mm$^2$ to 140,000 psi·mm$^2$, or from 60,000 psi·mm$^2$ to 130,000 psi·mm$^2$, or from 60,000 psi·mm$^2$ to 120,000 psi·mm$^2$, or from 60,000 psi·mm$^2$ to 110,000 psi·mm$^2$, or from 60,000 psi·mm$^2$ to 100,000 psi·mm$^2$, or from 60,000 psi·mm$^2$ to 80,000 psi·mm$^2$, or from 60,000 psi·mm$^2$ to 70,000 psi·mm$^2$, or from 70,000 psi·mm$^2$ to 150,000 psi·mm$^2$, or from 80,000 psi·mm$^2$ to 150,000 psi·mm$^2$, or from 90,000 psi·mm$^2$ to 150,000 psi·mm$^2$, or from 100,000 psi·mm$^2$ to 150,000 psi·mm$^2$, or from 110,000 psi·mm$^2$ to 150,000 psi·mm$^2$, or from 120,000 psi·mm$^2$ to 150,000 psi·mm$^2$, or from 130,000 psi·mm$^2$ to 150,000 psi·mm$^2$, or from 140,000 psi·mm$^2$ to 150,000 psi·mm$^2$, or any amount above or below any one of these ranges. The stiffness is based on the modulus (as measured by ISO 178 testing method) of the base member plastic material (in psi) multiplied by the square (mm$^2$) of the thickness of the flange (the thickness can be an average thickness).

The sealing ring region or top planar surface can have a circular configuration or a non-circular configuration when viewed from a top plan view. Non-circular configurations can include rectangular, multi-sided, oval, oblong, or a combination of curved and straight edges that define the sealing ring region, or can have other geometric configurations.

Figure 23:
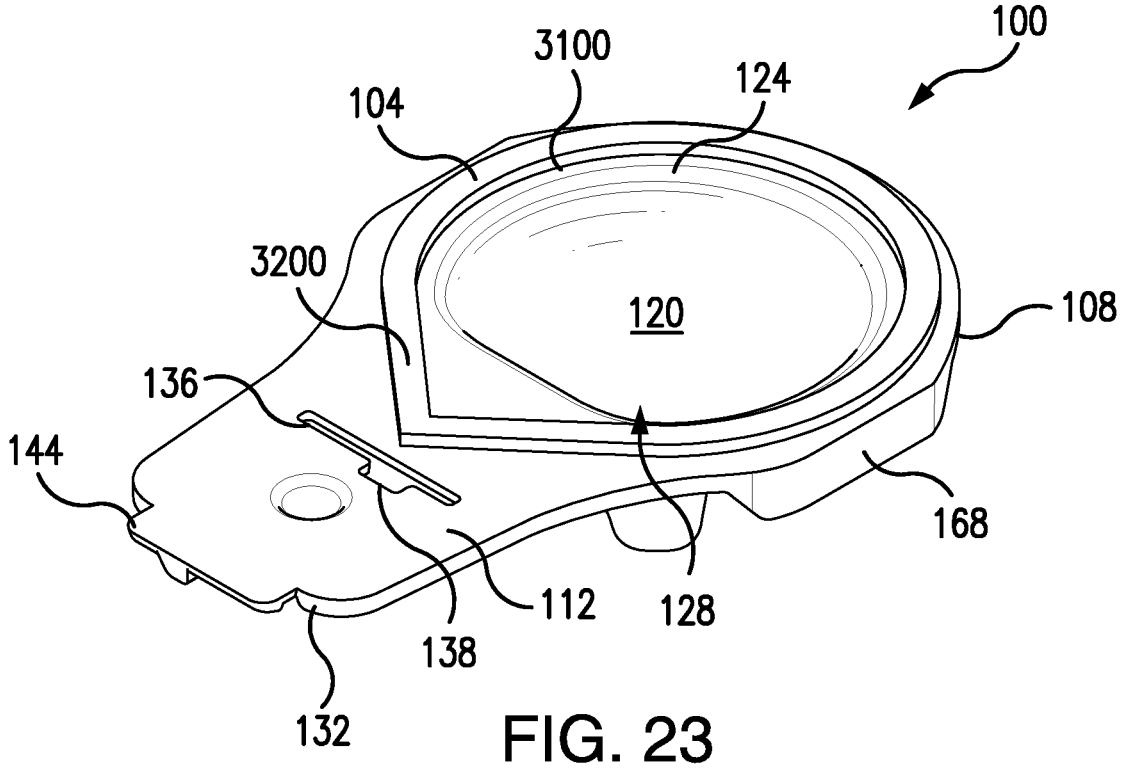
FIG. 23 is a top view of a further contact lens package base member according to an exemplary embodiment of the present invention that includes a vertex shaped sealing rim.

The sealing rim region can include or is a raised rim around the bowl (e.g., a continuous raised rim around the bowl). The raised rim can be any shape such as, but not limited, to, circular or can have curved and/or straight portions. The sealing rim region, alternatively, can be flat (or even) with the flat surface of the flange. As an option, the sealing rim region (for example), when the sealing rim region is raised, can include a vertex region as part of the shape. The vertex region can be located such that the point of the vertex (a sharp point or round point) points toward the handle. The shape of the raised rim, as an option, can be formed by the heat sealing die which can imprint this shape on the flange by melting that shape around the bowl. An example of the vertex and raised rim is shown, for instance, in FIG. 23. FIG. 23 is an example and this vertex can be present in any of the base member designs described herein.

The sealing ring region can have a width from 1.0 mm to 4.0 mm. This width is the distance that is measured from the edge or rim of the top of the blister cavity outward to a side edge of the base member. The width can be an average width. The width can be uniform or can vary as the region circumscribes the blister cavity. The sealing ring region can as an option comprise of the entire planar area circumscribing the blister cavity on the sides that are facing or adjacent to the gripping portion or handle.

Desirably, the sealing ring region provides a sufficient seal between the thermoplastic base member and the sealing member to withstand separation forces that occur during a contact lens autoclave sterilization process, and also is relatively easy for a person to peel open using the person's fingers.

For example, in some embodiments of the present blister packs, the sealing ring region is configured to provide an average separation force (of the sealing member from the sealing ring region) of less than 15 Newtons (N). In some embodiments, the sealing ring region is configured to provide a separation force of from about 4 N to about 14 N. In further embodiments, the sealing ring region is configured to provide a separation force of from about 6 N to about 11 N. In yet further embodiments, the sealing ring region is configured to provide a separation force of from about 8 N to about 10 N.

The peel strength can be measured using an INSTRON Model 5943 machine. For purposes of these measurements, the angle of pull is set at 45 degrees. The load cell of the machine is calibrated prior to testing the peel strength. Generally, the operating instructions are set by the manufacturer.

The sealing ring configuration can be adjusted by controlling the temperature of a heat sealing head surface that is pressed against the sealing member on the top surface of the thermoplastic base member, controlling the pressure the sealing head is applied to the sealing member, or controlling the time the sealing head is applied to the sealing member, or combinations thereof. As an example, the sealing head can seal the sealing member to the thermoplastic base member at a temperature of from about 210 C to about 240 C, and/or the sealing head can be applied at a pressure of from about 25 psi to about 60 psi, and/or the sealing head can be held in contact with the sealing member for a time of from 100 ms to 1100 ms, for example, from about 200 ms to about 600 ms.

The rim or edge that defines the top perimeter of the blister cavity or bowl (in other words, the sealing ring region) can have a circular configuration or a non-circular configuration when viewed from a top plan view. Non-circular configurations can include rectangular, multi-sided, oval, oblong, or a combination of curved and straight edges that define the sealing ring region, or can have other geometric configurations. For instance, as shown in FIG. 1A, a portion of the blister cavity (i.e., a portion of the sealing ring region) that is at the edge of the opposite side of the handle end, can have essentially a side (or a portion) that is a straight edge with the remaining perimeter being curved.

A non-circular configuration can include a vertex or more than one vertex as part of the configuration. The vertex can be located in proximity to the gripping portion of the thermoplastic base member. As used herein, a vertex is understood to be a portion of a geometric shape having the sharpest turn relative to the rest of the shape. For example, the vertex can be a point where two or more line segments meet. However, if the line segments are curved it can be appreciated that the intersection may appear more blended in such a way that there is a region having a smaller radius than a portion of the line segments located away from the vertex.

The gripping portion or handle can be planar or substantially planar (e.g., not varying by more than 5% in flatness and/or the area comprising the gripping portion has mostly planar surfaces where at least 80% of the cross-sectional top surface is planar, or at least 85%, or at least 90% or at least 95% or at least 98% is planar. The remaining area can be non-planar (e.g., a recess, or receptable or other non-planar configuration).

The gripping portion, from the gripping portion end (or handle end) to about the edge of the rim of the blister cavity (closest to the handle end) can have a length that comprises or consists of from about 40% to about 55% of the overall length of the base member. The length, for instance, can be from 15 mm to 28 mm in length (e.g., 18 mm to 25 mm, or 20 mm to 23 mm). The width of the gripping portion at the gripping portion end can be from 12 mm to 20 mm (e.g., from 13 mm to 18 mm, from 14 mm to 16 mm). The width of the gripping portion can be non-uniform where the width gradually increases in the direction of the blister cavity (as for instance shown in FIG. 1A-B and other figures). Thus, the width can be an average width or the width can be the width that is the narrowest portion.

The base member can include an interlocking feature or connecting member feature.

As an option, the interlocking feature or connecting member can be in the form of a hole or slot(s) and a corresponding latch(es) (which can be referred to or considered a catch mechanism), where the latch of one base member connects with a slot of a second base member to form connected base members from this attachment of the latch into the slot. This attachment is preferably such that the connected members are not easily removed from each other. For purposes of the present invention, the latch is described as a clip or clip feature at times.

As an option, the flange can include at least one hole (e.g., one or two or three or more holes) extending entirely through the thickness of the flange. The flange can have only one hole.

The at least one hole can be located at a greater distance from the blister cavity than an outer perimeter of the sealing ring region.

The at least one hole can be located at the gripping portion of the base member or be located such that the at least one hole is closer to the handle end or gripping portion end than the blister cavity.

The at least one hole can have or include the shape of slot or be considered a slot.

The shape of the slot can be a rectangle or essentially have a rectangular shape (e.g., a rectangular shape with curved corners).

The slot can have a width and a length (with the length being the larger dimension). The width can be, for example, from 0.5 mm to 1.5 mm, such as from 0.7 mm to 1.3 mm or from 0.8 mm to 1.2 mm, or from 0.9 mm to 1.0 mm, or other amounts above or below any one of these ranges. The width can be an average width.

The length of the slot can be, for instance, from 3.0 mm to 13.0 mm, such as from 3.5 mm to 12 mm, from 4.0 mm to 12 mm, or from 5 mm to 12 mm, or from 6 mm to 12 mm, or from 7 mm to 12 mm, or from 8 mm to 12 mm, or from 9 mm to 12 mm, or from 8 mm to 11 mm, or from 9 mm to 11 mm, or 9 mm to 10 mm The length can be an average length.

The length and width of the slot can have a L/W ratio of from about 1.5 to 4 or from 2 to 4 or from 2.25 to 3.5.

The orientation of the length and the width of the slot as part of the flange with respect to the base member or the blister cavity can be of any orientation.

For instance, the length of the slot can be parallel or essentially parallel with the gripping portion end or handle end. In other words, the slot can be parallel to the longitudinal axis of the base member that runs from the center edge of the gripping portion (proximal edge) to the opposite center edge on the side opposite of the blister cavity (distal edge). The longitudinal axis or line typically runs through the center of the blister cavity.

Alternatively, the length of the slot can be perpendicular or essentially perpendicular to the gripping portion end or handle end. In other words, the slot can be perpendicular to the longitudinal axis of the base member as described herein.

Alternatively, the length of the slot can be oriented such that the length is aligned anywhere from 5 degrees to 45 degrees from being parallel with the longitudinal axis of the base member as described herein.

As a further option, the hole or slot can include a notch in an edge of the hole.

As a more specific example, the notch can be included with the slot. The notch can be included in a slot that is rectangular.

The notch can be present along an edge of the slot (e.g., along a side of the length of the slot as opposed to the width of the slot). The notch can be off-centered from the center of the length. The center of the notch can be closer to the edge or side of the width than the center of the slot (based on length). The notch can be located anywhere between an edge or side of the width of the slot and the center of the slot. As an option, the notch can be at the center of the length. One notch can be present. As an option, more than one notch can be present.

The notch can have any geometric shape, such as, but not limited to, rectangular or oval or circular in shape. For instance, the notch can have a rectangular shape with curved corners.

The notch itself can have a width and length, with the length of the notch aligned on (or parallel to) the length of the slot. The width and length of the notch can be the same or different. The length of the notch can be from 10% to 35% of the length of the slot (e.g., from 15% to 30%, from 20% to 30% of the length of the slot).

For instance, the length of the notch can be from 1 mm to 3.5 mm, or from 1.5 mm to 3.5 mm, or from 2 mm to 3 mm. The width of the notch can be same or about the same (within 10% or within 5%) of the width of the slot described herein.

The gripping portion end or handle end can have, as an option, a clip feature that defines the end/edge of the base member at the gripping portion end. The length, width, and thickness of this clip is configured so as to fit through the slot. The clip is complementary to the shape of the slot. In operation, the clip of one base member is capable of being inserted into the slot of a second base member so as to connect or interlock them together.

The clip can include a key, which can be considered or include a barb or protrusion. The length, width, and thickness of the key is configured so as to fit through the notch that can be part of the slot as described herein. The clip can include a tapered surface which can be part of the key or barb or protrusion. The key is complementary to the shape of the notch. In operation, the key, as an option and based on the key's location on the clip, can ensure that insertion of a first base member into a slot/notch of a second base member is oriented into certain manner. For instance, if desired, the notch/key feature can ensure that the top surface of each of the base members when connected together are facing all upward or all downward. See FIG. 3 as one example.

The clip or a portion of the clip (e.g., key) can be deformable or flexible.

The clip or a portion thereof can have a tapered surface and/or a beveled surface or any combinations thereof.

The length of the clip is the same or smaller than the length of the slot. Preferably, the length of the clip is from 1% to 20% smaller in length compared to the length of the slot (e.g., 2% to 5%, or 5% to 10%, or 10% to 20% or 15% to 20% smaller in length).

The width of the clip is not dependent on the slot dimensions. The width of the clip dictates the distance that the clip is inserted into a second base member's slot. For instance, the width of the clip can be from 1 mm to 3 mm (e.g., from 1.5 mm to 3 mm, from 2 mm to 3 mm, or from 2.2 mm to 2.6 mm). Other widths below or above any one of these ranges can be utilized.

The thickness of the clip can be the same or less than the width of the slot. For instance, the thickness of the clip can be from 0% to 5% less than the width of the slot, such as 0.5% to 3% or from 1% to 5% less.

The key and its location along the clip match (or are complementary to) the notch and its location along the slot or is located in the reverse arrangement. Examples of this are shown in some of the figures. On one base member, the key can be located on the same longitudinal axis or line as the notch location or the key can be located such that the key is on a different longitudinal axis, so that a second base member must be turned, for instance, turned upside down, to be inserted and interlocked into a first base member of the same design.

While the dimensions of the clip are configured so as to fit through the slot, the top surface of the clip can be planar. The front side edge of the clip can be planar or a straight edge or can be curved or have angled or curved portions or section. The bottom surface (underneath) of the clip can be planar or can be angled or sloped such that the thickness of the edge of the clip is smaller than the thickness of the clip that is closer to the slot on the base member. As a further option, the bottom surface of the clip can end such that a barb or prong is formed so as to make removal of the clip from a slot more difficult. This can ensure that the connected base members remain connected, for purposes of recycling, for instance.

As an option, one or more sidewalls (or two or more sidewalls), which can include or be considered two or more side tabs, can be present as part of the base member.

The sidewalls can be a plurality of side tabs that depend or extend from an upper surface of the flange of the base member.

The sidewalls or side tabs can be located on opposing side edges of a base member. The sidewalls extend downward from edges of the base member. The sidewalls or side tabs can be located on side edges of the base member that are adjacent to the bowl or blister cavity. The sidewalls or side tabs are generally located on edges of the base member that are not the same edge having the gripping portion. The sidewalls can have any shape (e.g., trapezoidal, rectangular, one or more curved sides). The bottom edge or surface of the sidewalls can be flat or planar. The height of the sidewalls can be the same or less than the greatest depth of the bowl or blister cavity. The sidewalls can add rigidity or strength to a part of or to the entire base member. In addition, or alternatively, the sidewalls may facilitate retaining of the base member in a base member carrier of a heat sealing system or machine. It can be understood that slots may be provided in the base member carrier to receive one or more sidewalls to provide a physical fit between the base member and the base member carrier to ensure that the upper surface of the base member remains stable and parallel to a surface of a heat sealing die that is pressed against the sealing member on top of the upper surface of the base member to seal the sealing member to the base member.

The side walls or side tabs can be two side walls or side tabs. The side walls can have a height from 2.0 mm to 4.0 mm, such as from 2.5 mm to 3.0 mm. The side walls can have a length from 6.0 mm to 10.0 mm, such as from 7.0 mm to 9.0 mm, such as about 8.0 mm, or 8 mm. The height and/or length can be above or below any one of these ranges.

The length of each of the side walls can be from 25% to 100% (e.g., 50% to 90%, 60% to 90%, 70% to 90%) of the diameter (or largest diameter or dimension that defines the cross-sectional area) of the blister cavity or bowl.

The base members of the present invention can include a ridge line that circumscribes a portion (e.g., 25% to 95%, 50% to 90%, 60% to 80% of the entire perimeter length) or the entire perimeter of the base member edge. The ridge line can be present around the entire perimeter but exclude, as an option, the gripping portion edge (or handle end) that includes the clip.

The ridge line has a height and width (or thickness). The width or thickness of the ridge line can be the same thickness of the flange projecting away from the blister cavity. The thickness can be from 0.1 mm to 1 mm or from 0.2 mm to 0.9 mm or from 0.3 mm to 0.8 mm or from 0.4 mm to 0.7 mm or amounts below or above any one of these ranges.

The height of the ridge line can be the same or greater than the thickness of the ridge line such as from 10% to 50% greater than the thickness of the ridge line.

Figure 11A:
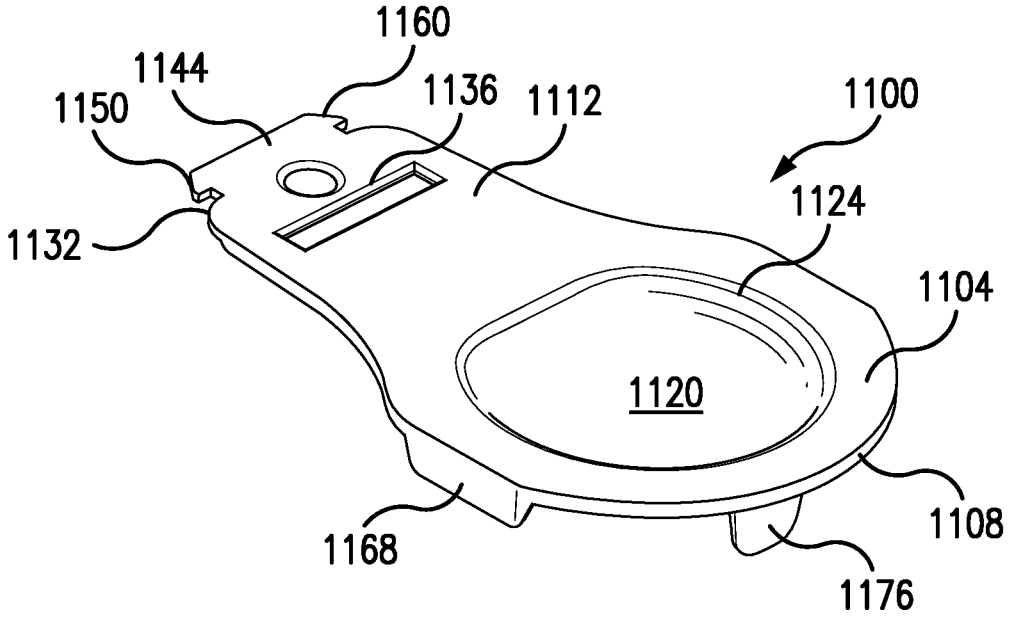
FIG. 11A is a top side perspective view of another embodiment of a thermoplastic base member according to the present invention.
Figure 11B:
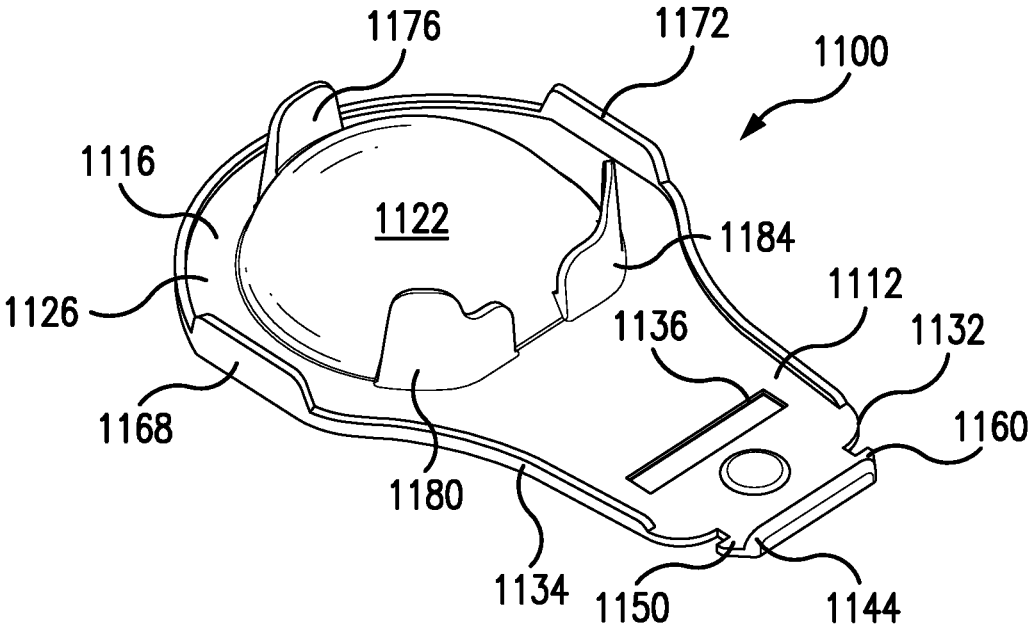
FIG. 11B is a bottom side perspective view of the base member shown in FIG. 11A.

When side walls or side tabs are present along with a ridge line, the side walls or side tabs can be continuous or part of the ridge line. FIG. 11B, for instance, shows this option with side tab 1168 being part of or continuous with ridge line 1134.

The base member can include a plurality of stabilizing legs. The stabilizing legs extend from a lower surface of the flange of the thermoplastic base member and circumscribe the convex exterior surface of the blister cavity. The stabilizing legs are immediately adjacent to the circumference of the blister cavity or bowl at the bottom surface of the base member.

Figure 1B:
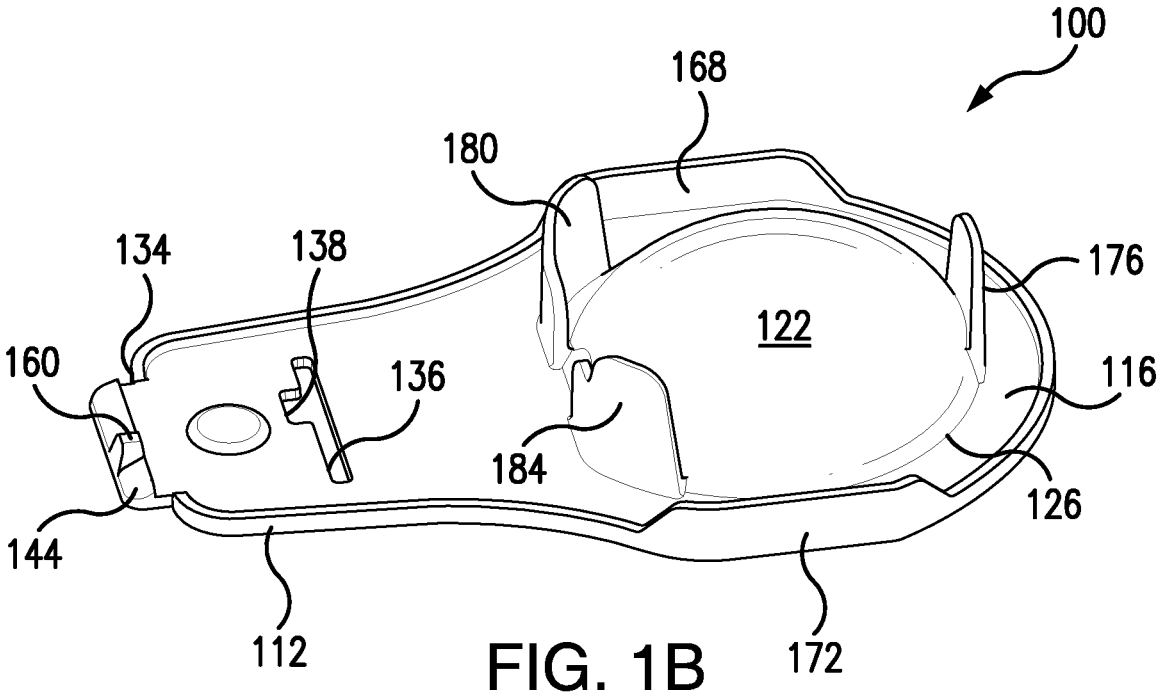
FIG. 1B is a bottom view of the contact lens package base member shown in FIG. 1A.

As an option, the plurality of stabilizing legs can comprise or include three stabilizing legs. The stabilizing legs can be positioned from each other in an equidistance manner. For instance, the stabilizing legs can be positioned approximately 120 degrees (±10 degrees) apart from each other about a vertical axis extending through the center of the blister cavity, for instance, as shown in FIG. 5B. Alternatively, the stabilizing legs can be positioned in a non-equidistance manner where at least two of a plurality of legs are closer to each other than to another leg(s). For instance, as shown in FIG. 1B, three stabilizing legs are shown and two of the three legs are positioned closer to each other and a third stabilizing leg is positioned further away. Put another way, the area circumscribing the blister cavity is a regular or irregular oval or circle, and thus define a 360-degree area. The center of one leg can be located at 0 degrees and the center of a second leg can be located from 150-170 degrees away from the first leg, and a center of the third leg can be located from 190-210 degrees away from the first leg. The first leg can be located at any point of the area circumscribing the convex exterior surface of the bister cavity. In one example, the first leg can be located near or at the convex exterior surface of the blister cavity that is at the side opposite of the gripping portion edge.

The stabilizing legs can include a planar lower edge. The stabilizing legs are designed to either rest on a surface, such as a countertop or a second base member (as shown, for instance in FIG. 9). In addition, or alternatively, the stabilizing legs may facilitate handling of the individual base members during placement in a base member carrier of a heat sealing machine. For example, the stabilizing legs may help orient the blister to ensure the bottom of the base member is down when dispensed from an automated feeder toward the base member carrier. In addition, the base member carrier may be configured with openings to receive the stabilizing legs to help retain the base member during the sealing operation, somewhat similar to the sidewalls discussed herein.

The shape of the stabilizing legs can be of any geometrical shape. As shown in some of the figures, the legs can have or include curved side surfaces and the overall shape can have inclined surfaces. The shape of each leg can be the same or different from each other. Some of the legs can have the same design and other leg(s) can have a different design. As shown, for instance in FIG. 1B, the first leg can have a shape different from the second and third legs.

The length of the legs is generally the same length. The length can be the same or more than the depth (largest depth) of the blister cavity. The length can be same or from 1% to 20% more than the largest depth of the blister cavity.

As indicated, the connecting feature of the base members of the present invention can be one of an interlocking feature or mechanism (e.g., a push through clip, a lever action clip, or a hook-on clip), or a stackable feature or mechanism (e.g., a push-in interference fit, such as with an extruded pin that can include a flat section or pin to control or direct orientation of a connection to another base member have a receiving slot or receptable, or with a recess (such as the recess of the blister cavity) that can include flat/straight surfaces to control or direct orientation of a connection to another base member).

With respect to the push through clip design, the base members interlock together mechanically, by pushing (or inserting) the clip of one base member into the hole or slot of a second base member. The features of the clip and the slot are as described earlier and exemplified in the figures and description accompanying the figures herein. The clip can be located on the end of the thumb-grip or handle or gripping portion and the slot is located away from the end of the thumb-grip or handle or gripping portion and can be located on the gripping portion.

The slot can be slightly thinner in at least one dimension or two or more dimensions or all dimensions (e.g., 1% to 5% thinner) than at least one dimension or two or more dimensions of the clip so that once the clip goes through (with some interference), the base member is mechanically fastened or clipped together with the other base member.

For purposes of the present invention, the mechanical fastening using any one of the connecting member features described herein as part of the base member to another base member with the same connecting member features provides an interference fit or friction fit.

The push through clip design can include a key feature as an option. The key feature as described herein determines a single position for the base member to be able to be inserted in the slot of a second base member. This feature enables a desired or uniform stacking or interconnection of base members. FIGS. 2 and 3 provide an example of such a push through clip base member.

With respect to the lever-action clip design, in this design, the base members interlock by sliding the clip of one base member into the slot of the second base member, with the base members perpendicular to each other, and then rotating one of the base members down (e.g., the top base member down, like a lever. FIGS. 8 and 9 provide an example of such a lever-action clip base member.

The slot can be slightly thinner in at least one dimension or two or more dimensions or all dimensions (e.g., 1% to 5% thinner) than at least one dimension or two or more dimensions of the clip so that once the clip goes through (with some interference), the base member stay clipped together with the other base member.

The lever-action clip design can include a key feature as an option. The key feature as described herein determines a single position for the base member to be able to be inserted in the slop of the other base member. This feature enables a desired or uniform stacking or interconnection of base members.

Figure 12:
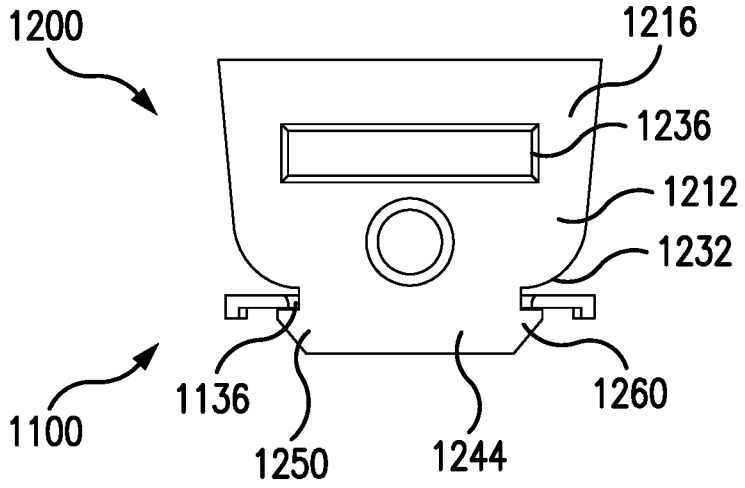
FIG. 12 is a partial cut away view of the handle ends of two base members shown in FIG. 11A connected together.
Figure 13:
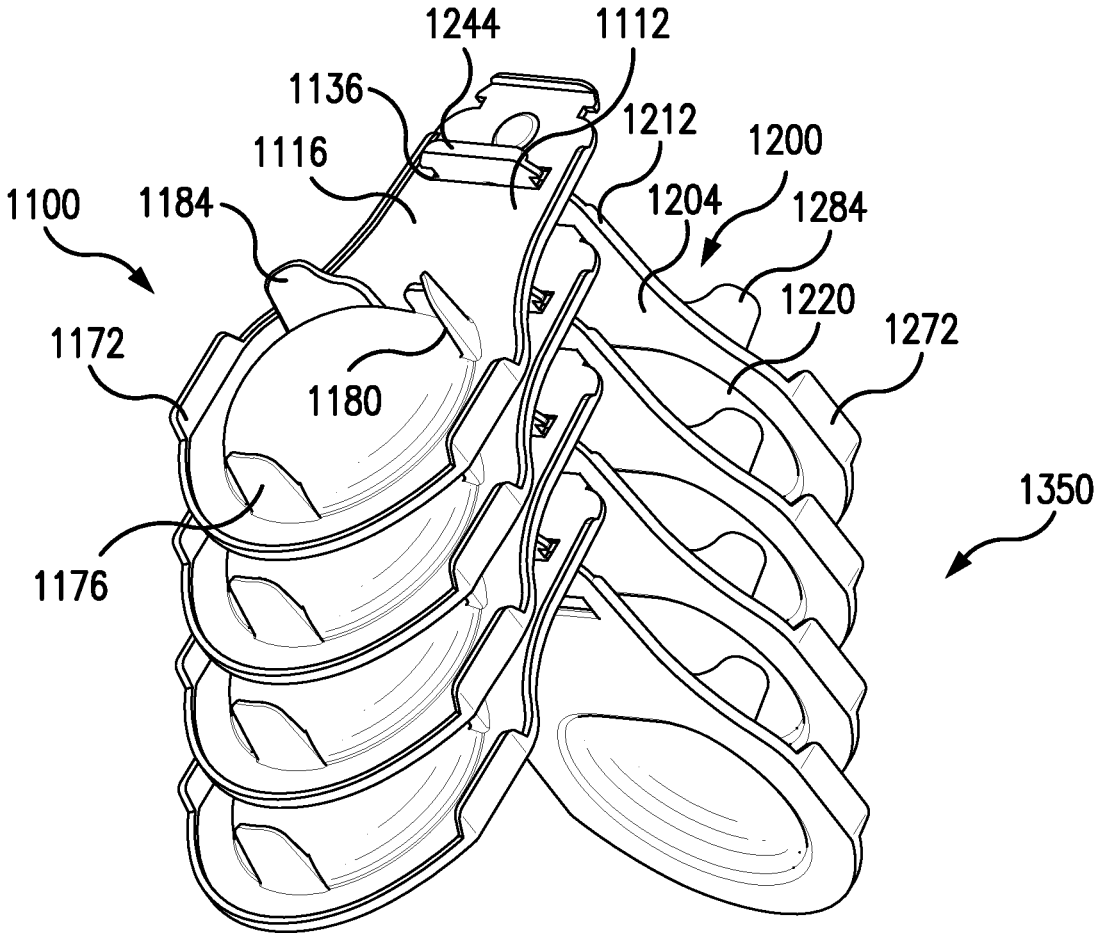
FIG. 13 is a side perspective view of a plurality of base members shown in FIGS. 11A and 11B connected together to form the recyclable assembly.

With respect to the hook-on clip design, the base members interlock by sliding one side of the hook of one base member into the slot of a second base member, and then pushing the opposite side through. FIGS. 11-13 provide an example of such a hook-on clip design.

The slot can be slightly thinner in at least one dimension or two or more dimensions or all dimensions (e.g., 1% to 5% thinner) than at least one dimension or two or more dimensions of the clip so that once the clip goes through (with some interference), the base member stay clipped together with the other base member.

Figure 14A:
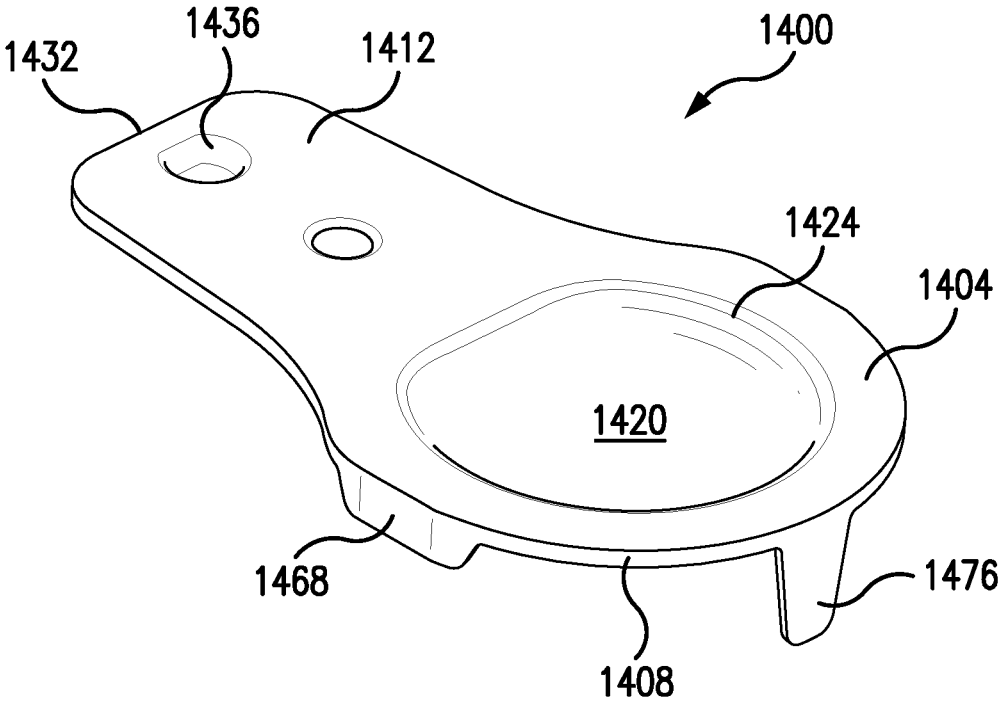
FIG. 14A is a top side perspective view of another embodiment of a thermoplastic base member according to the present invention.
Figure 14B:
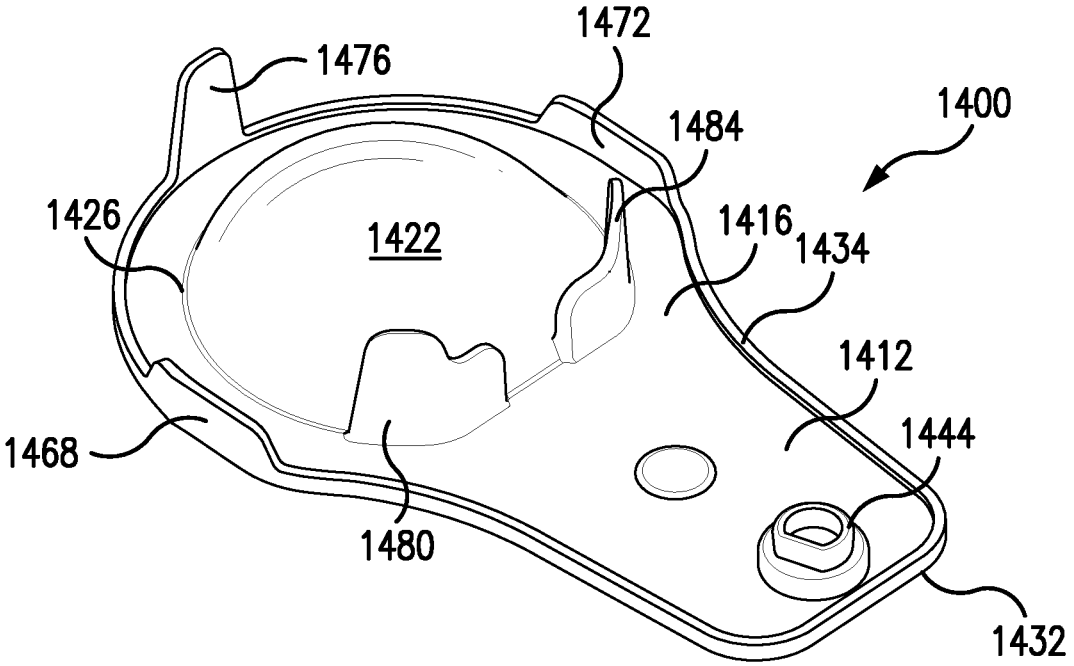
FIG. 14B is a bottom side perspective view of the base member shown in FIG. 14A.
Figure 15:
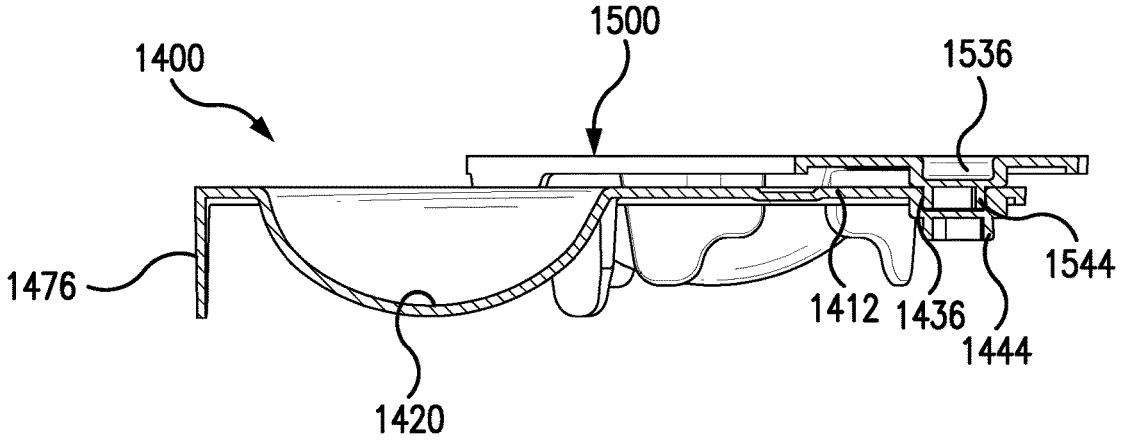
FIG. 15 is a partial cut away side view of two base members shown in FIG. 14A connected together.
Figure 16:
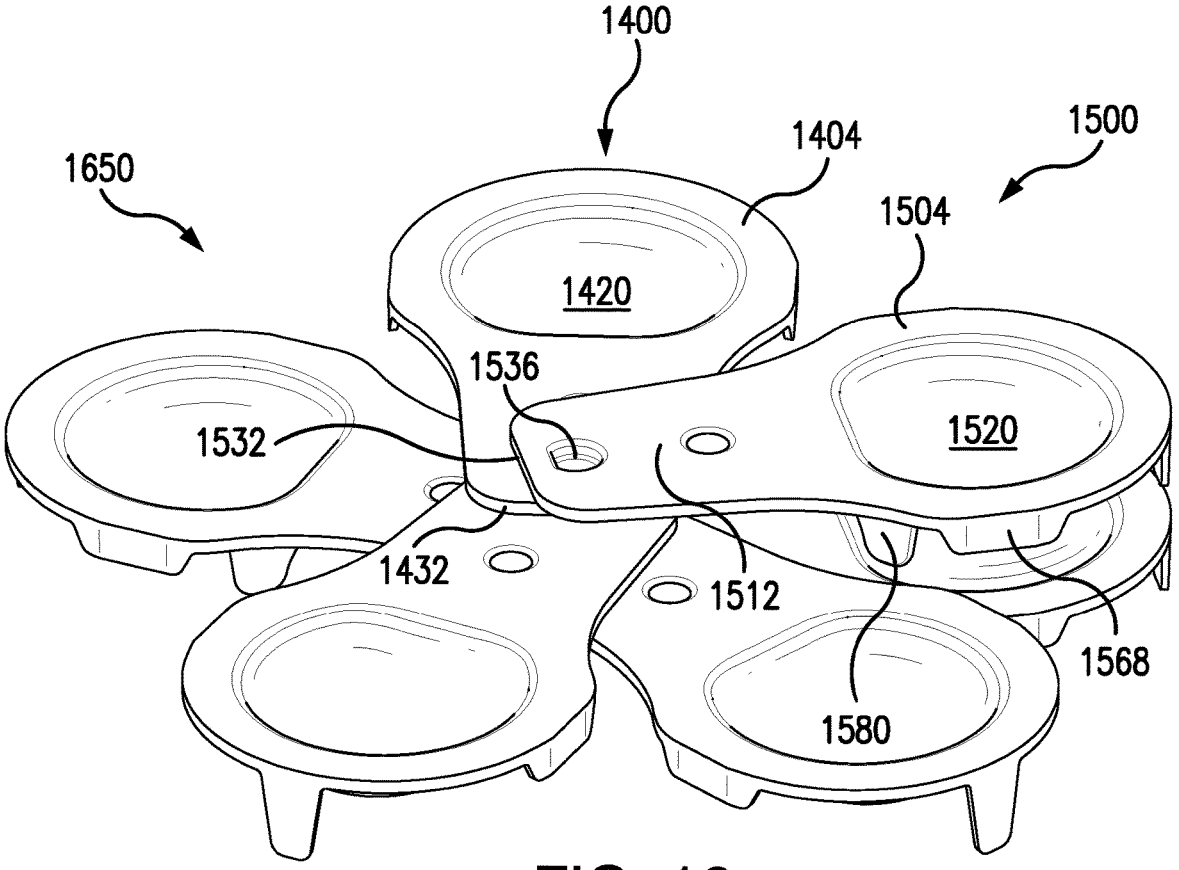
FIG. 16 is a top side perspective view of a plurality of base members shown in FIGS. 14A and 14B connected together to form the recyclable assembly.

With respect to the stackable feature, one example is the push-in interference fit design for the base member using a pin design. In this design, one base member interlocks with another base member by pushing an extruded pin (male part) of the one base member that is on the bottom surface of the one base member into the top of a complimentary hole or receptable or recess (female part) located on the top surface of the second base member. FIGS. 14-16 provide an example of such a pin push-in interference fit design.

The push-in interference design is similar to how self-locking bricks stay together like LEGO pieces. The interference fit between the male and female parts holds the base members together.

The pin and/or the receiving recess can include flat and/or straight sides as part of the shape and this can provide control of the stacking orientation of the base members on top of each other. Thus, as an option, the pin can have a shape so that the orientation of the base member is oriented in a certain manner (e.g., predetermined by a flat section of the pin) in order to create a desired stacking structure.

Figure 17A:
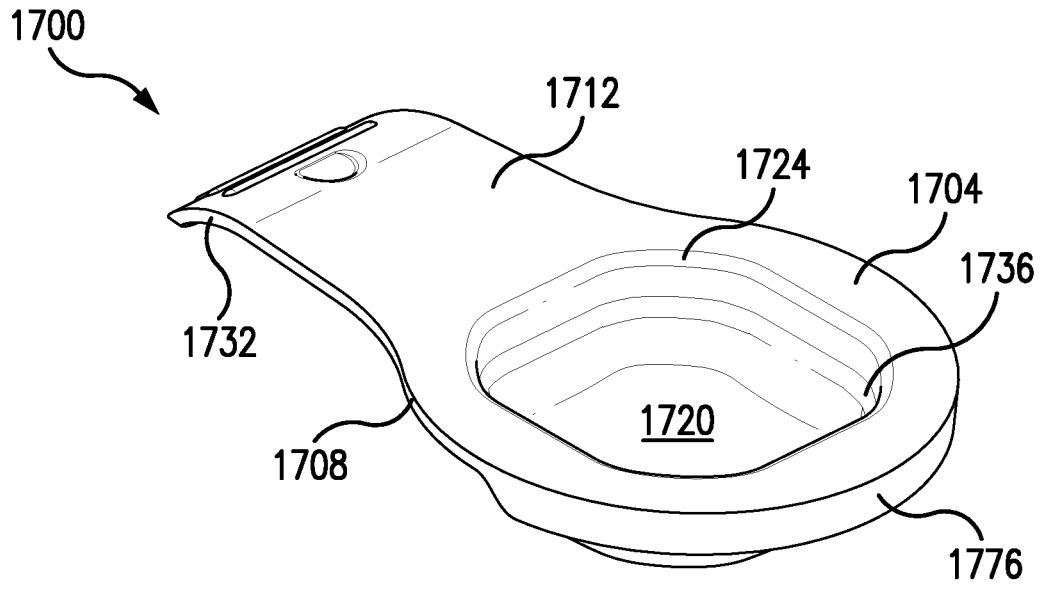
FIG. 17A is a top side perspective view of another embodiment of a thermoplastic base member according to the present invention.
Figure 17B:
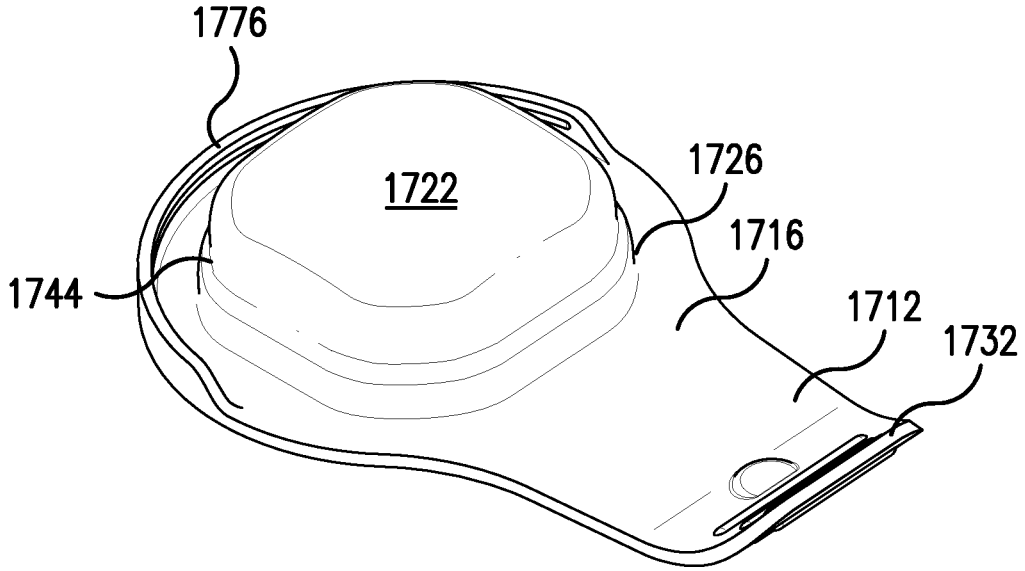
FIG. 17B is a bottom side perspective view of the base member shown in FIG. 17A.
Figure 18:
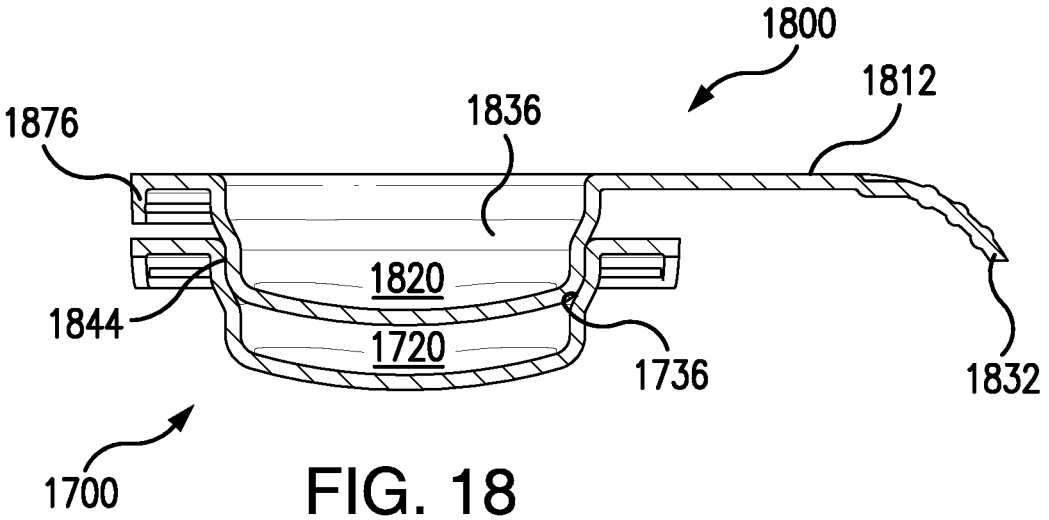
FIG. 18 is a partial cut away view of the handle ends of two base members shown in FIG. 17A connected together by stacking.
Figure 19:
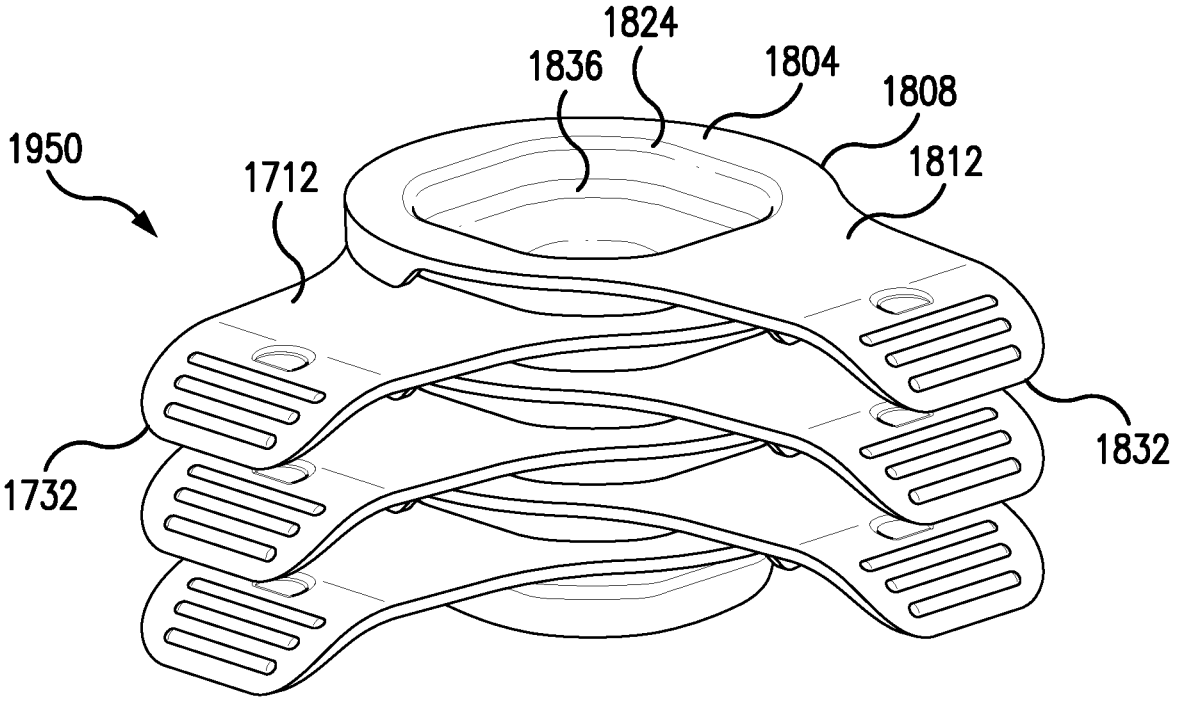
FIG. 19 is a top side perspective view of a plurality of base members shown in FIGS. 17A and 17B connected together to form the recyclable assembly.

With respect to the stackable feature, another example is the push-in interference fit design for the base member using a bowl design. In this design, one base member interlocks with another base member by pushing the exterior bowl (the convex portion—male portion) of one base member that is the bottom surface of the one base member into the interior bowl (the concave portion—female portion) of a complimentary second base member with complementary bowl design to interlock the base members together. FIGS. 17-19 provide an example of such a bowl push-in interference fit design.

The push-in interference design is similar to how self-locking bricks stay together like LEGO pieces. The interference fit between the male and female parts holds the base members together.

As an option, the base members can have a bowl design that includes geometric shapes as part of the bowl convex and concave design (e.g., rectangular, oval, trapezoidal, triangular portions). The bowl can include flat and/or straight sides as part of the bowl concave and convex shape and this can provide control of the stacking orientation.

Due to the geometrical shapes, the base members can be stacked in different orientations. For instance, any of four different orientations can be achieved, when the concave and convex sides of the bowl have square features or rectangular features. The bowl can be designed so that the circumference or rim of the bowl is multi-sided (e.g., 3 or more sides or 4 or more sides or 5 or more sides). This same design would be present on convex or exterior (bottom) surface of the bowl so as to provide the complimentary interference fit.

Figure 20A:
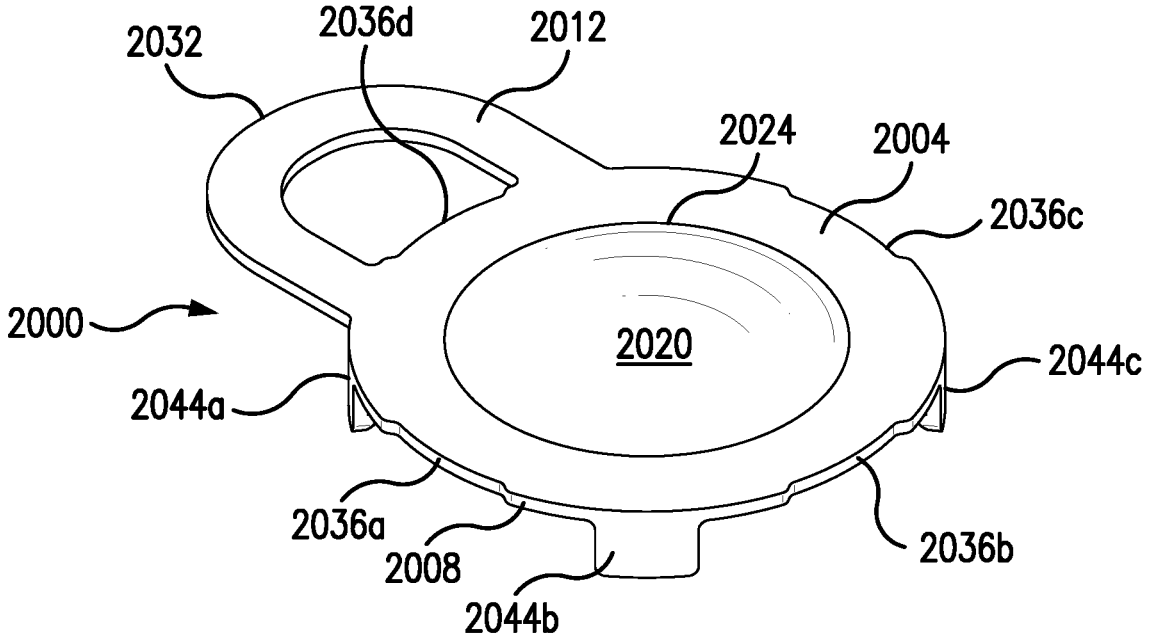
FIG. 20A is a top side perspective view of another embodiment of a thermoplastic base member according to the present invention.
Figure 20B:
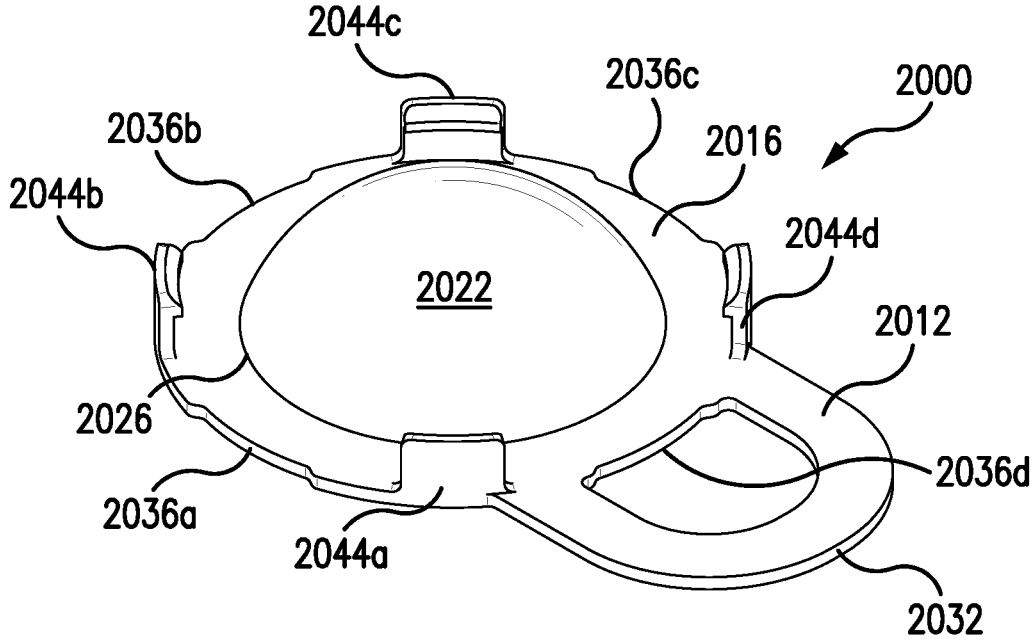
FIG. 20B is a bottom side perspective view of the base member shown in FIG. 20A.
Figure 21:
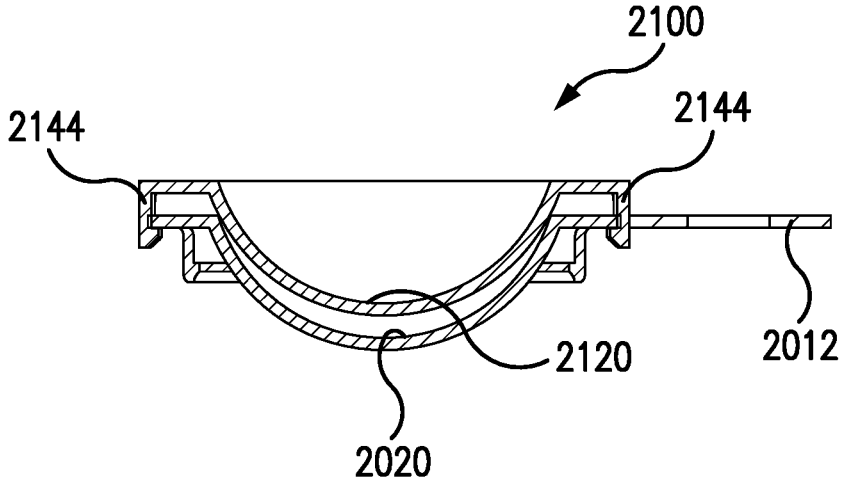
FIG. 21 is a partial cut away view of the handle ends of two base members shown in FIG. 20A connected together by stacking.
Figure 22:
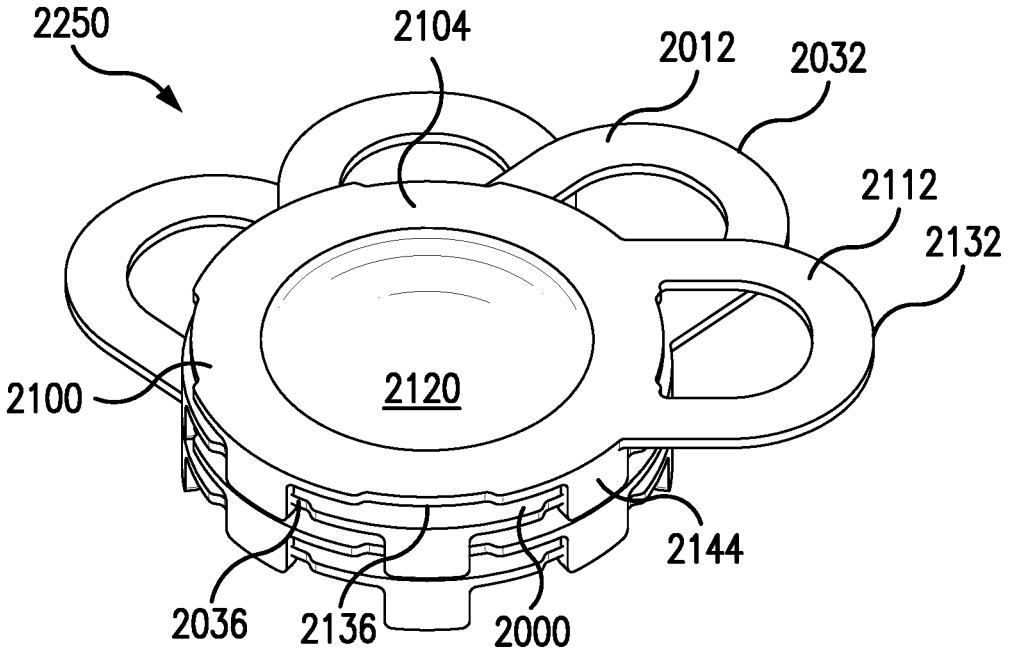
FIG. 22 is a top side perspective view of a plurality of base members shown in FIGS. 20A and 20B connected together to form the recyclable assembly.

As a further option, the base members can have a push-in quad clip design. In this design, the base members are stacked together by pushing the lower part of the bowl of one base member into the top opening of the second base member. Each of the base members have a plurality of leg clips (e.g., quad clips) on the edge or circumference of the bowl and that are capable of clipping or connecting to the edge of a complementary base member. The leg clips can deflect due to some interference while pushing the bowl in and then snap into place, holding the base members together. FIGS. 20-22 provide an example of such a push-in quad clip design.

With this push-in quad clip design, multiple base members can be stacked in staggered order, determined by the geometry of the base member body and positioning of the clips.

The base member on the outer edge that circumscribes the bowl can have a plurality of notches or indentations (e.g., 2 or more, 3 or more, 4 or more, 5 or more, 6 or more). The notches or indentations can be spaced uniformly or non-uniformly apart from each other. The number of notches or indentations can be equal to the number of leg clips on the base member. The notches or indentations can be located between the leg clips. The leg clips can include a catch mechanism or barb at the end of the leg clips so that this end can be snap fitted into a receiving (second) base member and connected together.

As indicated, the interlocking feature or connecting member feature as described herein can be, as an option, in the form of a slot(s) and a corresponding latch(es) (which can be referred to or considered a catch mechanism or a clip or a clip feature), where the latch of one base member connects with a slot of a second base member to form connected base members from this attachment of the latch into the slot. This attachment is preferably such that the connected members are not easily removed from each other.

As one option, the latch of one base member that fits into the slot of another base member can be dimensioned so that the connection forms an interlocking fit or friction fit or pressure fit or snug fit between the latch and slot. The width of the distal end of the latch that first enters the slot when connecting can have a width and thickness such that the latch can be put through the slot with either no force or a slight force and thus the one base member is securely attached to the second or adjacent base member and so on, and the connected base members cannot be removed easily (e.g., the base members will not disconnect from each other due to gravity or due to gripping of the connected base members attached to each other). As an example, the slight force can be characterized as at least an amount of force that a person can connect the base member onto the adjacent base member, but that the base members cannot be disconnected or be removed from each other without a greater amount of force than used to attach the base members together.

As an example, the latch has a thickness that is less than the width of the slot (e.g., from 0.1% to 10% less, or from 0.5% to 5% less, or from 1% to 15% less or from 1% to 10% less or from 1% to 5% less in thickness compared to the width of the slot). For example, the latch can have a thickness that is from 0.05 mm to 0.4 mm less than the width of the slot. As one example, the latch can have a thickness from 0.01 mm to 0.3 mm less than the width of the slot. In a further example, the latch can have a thickness that is 0.2 mm less than the width of the slot.

Still further, as shown in some of the accompanying drawings, the latch may include a barb extending from a surface of the latch. The length of the barb (the distance from which the edge of the barb extends from the latch surface) can be from 0.1 mm to 0.8 mm or other amounts above this range. In a preferred embodiment, the length of the barb and the latch together (as illustrated by 1144, 1150, and 1160 in FIG. 11A or, for example) is greater than the width of the slot into which the latch is inserted (e.g., from 1% to 15% or more greater or from 1% to 10% greater or from 1% to 5% greater in length compared to the width of the slot). For example, the combined length or distance of the barb and latch can be from 0.1 mm to 0.5 mm greater than the width of the slot. As a further example, the length or distance of the barb and latch can be from 0.15 mm to 0.45 mm greater than the width of the slot. In an additional example, the length or the distance of the barb and the latch is about 0.2 mm greater than the width of the slot. It will be understood that the term "length" of the barb is in the context of the present disclosure, and it can also be understood that this length defines the thickness of the barb or the thickness of the latch and the barb. The thickness should be selected so that the barb can engage an under surface of the base member through the slot.

As an option, when two or more base members are connected together, for instance, utilizing one of the stackable feature designs, at least a portion of the exterior bowl surface of one base member nests in the interior bowl surface of the connecting base member. This portion can be at least 5% or from 5% to 99% of the available exterior surface area and/or interior surface area of the bowl, such as from 25% to 99% or from 50% to 99%, or from 60% to 99%, or from 70% to 99%, or from 80% to 99%, or from 50% to 95%, or from 50% to 90%, or from 50% to 80%, or amounts below or above any one of these ranges.

The plurality of contact lens package base members that can be connected together can include two or more, three or more, four or more, five or more, ten or more, twenty or more, thirty or more, sixty or more, or 90 or more. There is no limit to the number of contact lens package base members that can be connected together.

With respect to each of the contact lens packages, each of the packages can independently include or comprise a base member (e.g., plastic base member) comprising at least one interlocking or connecting feature or member. The interlocking or connect feature can comprise at least one latch, at least one slot, a combination of a latch and a slot, or a combination thereof. Each base member can comprise a bowl that defines a cavity that is configured to retain a contact lens and contact lens packaging solution. A planar top surface, for example, a flange region, can extend outwardly from a top rim of the bowl and cavity. A sealing member or sealing lid can be provided and can comprise a removable foil or lid attached to the planar top surface or flange region to provide a sealed contact lens package, for example, a blister package.

Each of the used base members can connect with one or more others to form the recyclable item. If the sealing members are plastic, then the sealing members can optionally be recycled along with the plastic base members.

With respect to the thermoplastic base member, the base member can comprise, consist essentially of, or include or is a recyclable plastic material.

With respect to the thermoplastic base member, the base member can comprise, consist essentially of, or include or is a polypropylene material.

Each base member can comprise, consist essentially of, or consist of a thermoplastic material or other recyclable plastic or recyclable plastic material. Each base member can comprise plastic, polyvinylchloride (PVC), polyethylene, polypropylene, polybutylene, polystyrene, a polyalkylene, polyethylene terephthalate (PET), a combination thereof, or the like. The base member can be made of a material that is recyclable, meaning that the material is of a type that can be taken to a recycle facility or trash facility and put in a recycle bin, such as a plastics recycling bin. The base member can be made of conventional material used for contact lens base members. The base member can be formed from or comprise a polypropylene resin.

The base member can have or include a substantially planar top surface (or flange region) that intersects with an upper rim of the bowl and surrounds the cavity. The planar top surface can intersect with an edge, for example, at a vertical edge. The planar top surface can at least partially define a handle.

The substantially planar surface provides a sealing surface for the sealing member. With the sealing member on the planar surface, a sealed cavity is formed. The term "substantially planar" means a planar surface or a surface surrounding the cavity that is at least 80% in surface area, or at least 90% in surface area, or at least 95% in surface area, or at least 99%, or 100% in surface area planar or flat, or a surface area that is very gently concave or convex. By very gently concave or convex what is meant is that the difference in height, when resting on a horizontal surface, between the highest point and the lowest point on the substantially planar top surface, can be no more than about 0.5 centimeter (cm), no more than 0.25 cm, no more than 0.1 cm, or no more than 0.05 cm, or other amounts within or outside of any one or more of these ranges. The base member may also include a raised rim surrounding the cavity of the base member and extending upwardly from the planar top surface. In such embodiments, the raised rim will also have an upper rim surface that is planar, and parallel to the planar top surface of the base member.

The sealing member can be sealed to the base member to create a seal that can withstand autoclaving conditions used to sterilize the unworn contact lenses. Once the seal is broken by separating the sealing member from the base member, the contact lens package is referred to herein as opened.

With respect to the at least one latch, the at least one slot, or both, of each of the base members, as indicated, the latch of one base member is configured to fit inside and mechanically engage (e.g., interlock or connect), with at least one slot of another base member, thus connecting the two base members together. The latches and slots of the base members can be configured, shaped, or designed to connect with other slots and latches and to connect a plurality of contact lens package base members together after the respective contact lenses are removed from the respective cavities.

As an option, each of the base members can include at least a first slot and at least a first latch. The first slot is formed through the planar top surface, can be spaced away from the upper rim, and can be located on a first side of the bowl. The first latch extends downwardly from the planar top surface and can be adjacent to the first slot. The first latch can be spaced away from the upper rim.

As an option, each of the latches can independently include a distal end, and each distal end can have a tapered side, a tapered edge, a tapered corner, or a combination thereof. For example, each latch can each include a barb or notch or catch shape design to lock or connect with the slot. The slots can be sized to receive the barbs from a first direction, and catch the barbs, preventing the barbs from exiting the slots in a second direction (e.g., opposite the first direction). The barbs can be malleable, deformable, elastically deformable, tapered, beveled, a combination thereof, or the like.

The slots can have any shape including, but not limited to, circular, rectangular, trapezoid and the shape can be further defined by curved or rounded surfaces as opposed to straight lines and right angles. The slots can each form an open area such that this area is less than 1% of the total surface area of the planar surface of the base member (such as 0.5% or less, 0.25% or less, 0.1% or less or 0.05% or less).

The at least one latch and the at least one slot of each of the plurality of contact lens packages can together comprise a poka-yoke design. In such a design, the handle of the first contact lens package can only be capable of extending in a direction that is different than a direction of extension of the handle of an immediately adjacent contact lens package, after the contact lens packages are used or opened and upon stacking together.

Depending on the design of the interlocking feature (as exemplified herein), different stack arrangements can be made by stacking the used base members together. The respective handles can extend in different directions, for example, in two opposite directions, in two different directions, in three different directions, in four different directions, in five different directions, in six different directions, in seven different directions, in eight different directions, in two angled directions, in three angled positions, in four angled positions, or in any number of angles relative to the other handles of the other stacked base members. The different directions or angular positions can be evenly spaced apart, not evenly spaced apart, randomly spaced apart, spaced apart in a spiral, or the like, all with respect to an axis travelling through the centers of the bowls of the used base members. When in angled directions, the difference in angle for respective handles for two base members connected together can be, for instance, from 10 degrees to 180 degrees, such as 10 degrees, 20 degrees, 30 degrees, 40 degrees, 50 degrees, 60 degrees, 70 degrees, 80 degrees, 90 degrees, 100 degrees, 110 degrees, 120 degrees, 130 degrees, 140 degrees, 150 degrees, 160 degrees, or 170 degrees, or 180 degrees or other degrees above or below any one of these ranges.

As an option, the base members are attachable to one another such that the plurality of empty base members are oriented in either a singled stacked configuration or in an alternating, stacked configuration. The cavities of the empty base members can optionally nest within one another other when the empty base members are attached above and/or below one another. The nesting can result in either the base member cavities contacting each other or not contacting each other. The bowls of the empty base members can optionally be spaced apart from the bowls of one or more immediately adjacent base members.

As an option, for instance, when the connecting feature is an interlocking feature, the latch can be located at the end of the gripping portion or handle (i.e., the handle end) and can be considered part of the gripping portion and handle, and the first slot can be located between the bowl and the handle end.

Alternatively, the latches and slots can be located in other locations around a periphery of the bowl, on the handle, or at any other location, such that the latches and slots can connect a plurality of empty base members together. The first slot can be located at any location of the planar surface between the rim of the bowl and the end of the planar surface.

As mentioned, the base members can further include a plurality of sidewalls, such as a first vertical sidewall and a second vertical sidewall. The first vertical sidewall can extend downwardly from the edge of the base member, can have a first depth, and can be located along the edge that adjacent the bowl. The second vertical sidewall can be located on an opposite side of the bowl relative to the first vertical sidewall. While the vertical sidewall or vertical sidewalls extend downwardly from the edge, the vertical sidewalls may have a slope ranging from seventy degrees to ninety degrees or other slope amounts (where the degrees are with respect to the planar surface) from the surface extending from the planar top surface. Thus, it can be understood that the vertical sidewalls may have an approximately vertical orientation relative to the planar top surface extending from the edge. The bowl can have a depth that is of a greater dimension than the first depth of the first vertical sidewall, and the bowl can have a depth that is of a greater dimension than the second vertical sidewall depth.

The first and second vertical sidewalls can be located such that they are not adjacent to any slot. Referring again to the 360 degrees that define the rim of the bowl, the vertical sidewalls can be located such that they are 180 degrees away from each other or within 10 degrees of this distance.

The vertical sidewall can have any shape or geometry, such as a rectangle, trapezoid, half circle, and the like, and any shape can have rounded edges or sides. As an option, the depth of the vertical sidewall can be such that when two base members are connected together, the vertical sidewalls can provide or contribute to the connected base members being connected to form a level surface or about a level surface (within 10 degrees or within 5 degrees of being leveled) based on the planar surface of each base member.

The present invention can include a kit that comprises a carton, box, container, or other packaging, also referred to as a carton. The carton can be made from virgin or recycled cardboard, lid stock, compressed paper, paperboard, or the like. A kit in accordance with the present invention can comprise, consist essentially of, or consist of, a carton, and a plurality of sealed contact lens packages (e.g., blister packs) containing sterilized, unworn contact lenses. Each of the plurality of sealed contact lens packages includes one or more of the connecting features or members described herein. In a further embodiment, such a kit comprises ten or more contact lens packages (e.g., blister packs), thirty or more contact lens packages, sixty or more contact lens packages, or ninety or more contact lens packages. The carton can be a box, a bag, a package, a tray, an enclosure, or any other type of container.

As shown in FIGS. 1A and 1B, the contact lens package base member 100 includes a planar top surface 104. Planar top surface 104 has a sealing ring surface and an edge 108. Base member 100 further includes a handle 112 or gripping portion at least partially defined by planar top surface 104. A bottom surface 116 opposes planar top surface 104. A bowl 120 or recess is provided recessed from planar top surface 104 and has an upper rim 124 that intersects with planar top surface 104 and defines a blister cavity 128. Blister cavity 128 is configured for holding a contact lens, for example, contact lens 408 shown in FIG. 4. Bowl 120 defines a dome 122 protruding from bottom surface 116 that intersects with bottom surface 116 at dome edge 126. Bowl 120 has a concave interior surface and dome 122 has a convex exterior surface. Handle 112 extends away from bowl 120 and terminates at a handle end 132 or gripping portion end.

Planar top surface 104 is a top surface of a flange projecting away from blister cavity 128. Bottom surface 116 is a bottom surface of the flange. The flange provides the sealing ring region that circumscribes blister cavity 128. The flange can also provide handle 112 or gripping portion configured to be held between a thumb and a finger of a contact lens wearer. Handle 112 can be located at a proximal end of the flange, and blister cavity 128 can be located closer to a distal end of the flange.

Base member 100 further includes a slot 136 or hole or opening formed through planar top surface 104 at handle 112. Slot 136 is located in between handle end 132 and upper rim 124. Slot 136 can be located at a greater distance from blister cavity 128 than edge 108 or outer perimeter of top surface 104. Slot 136 has an elongated shape with a length orthogonal to a longitudinal axis of base member 100.

The width of slot 136 can be from 0.2 mm to about 2 mm, 0.3 mm to 1.9 mm, 0.4 mm to 1.8 mm, 0.5 mm to 1.5 mm, 0.7 mm to 1.3 mm, 0.8 mm to 1.2 mm, 0.9 mm to 1.1 mm, or 1 mm. For example, the length of slot 136 is no more than 2 mm, no more than 1.9 mm, no more than 1.8 mm, no more than 1.5 mm, no more than 1.3 mm, no more than 1.2 mm, no more than 1.1 mm, or no more than 1 mm. The width of slot 136 can be no less than 0.2 mm, no less than 0.3 mm, no less than 0.4 mm, no less than 0.5 mm, no less than 0.6 mm, no less than 0.7 mm, no less than 0.8 mm, no less than 0.9 mm, or no less than 1 mm. The length of slot 136 can be from 3.0 mm to 13.0 mm, 3.5 mm to 12 mm, from 4.0 mm to 12 mm, from 5 mm to 12 mm, from 6 mm to 12 mm, from 7 mm to 12 mm, from 8 mm to 12 mm, from 5 mm to 12 mm, from 6 mm to 12 mm, from 7 mm to 12 mm, from 8 mm to 12 mm, from 9 mm to 12 mm, from 8 mm to 11 mm, from 9 mm to 11 mm, from 9 mm to 10 mm.

A notch 138 is defined at an edge of slot 136. Notch 138 extends in a direction towards handle end 132 and is offset from a center of slot 136. In certain embodiments, notch 138 can extend in an opposing direction towards bowl 120. More than one notch 138 can be defined at the edge of slot 136

The sealing ring surface of planar top surface 104 can have a circular configuration or a non-circular configuration when viewed from a top plan view.

The sealing ring region of planar top surface 104 can have a width from 0.5 mm to 6.0 mm, 0.8 mm to 5.0 mm, 1.0 mm to 4.0 mm, 1.5 mm to 3.0 mm, or 2.0 mm. For example, sealing ring region can have a width of no more than 6.0 mm, no more than 5.0 mm, no more than 4.0 mm, no more than 3.0 mm, or no more than 2.0 mm. Sealing ring region can have a width of no less than 0.5 mm, no less than 0.8 mm, no less than 1.0 mm, no less than 1.5 mm, or no less than 2 mm. As discussed herein the width of the sealing ring can be set by varying the temperature of a sealing head, the force applied by the sealing head to the sealing member, or the time of contact between the sealing head and the sealing member on the base member, or combinations thereof. The sealing ring shape, including its perimetric shape and width, are selected to provide a peel separation force less than 15 N. For example, the peel separation force may be from about 6 N to about 13 N.

Figure 4:
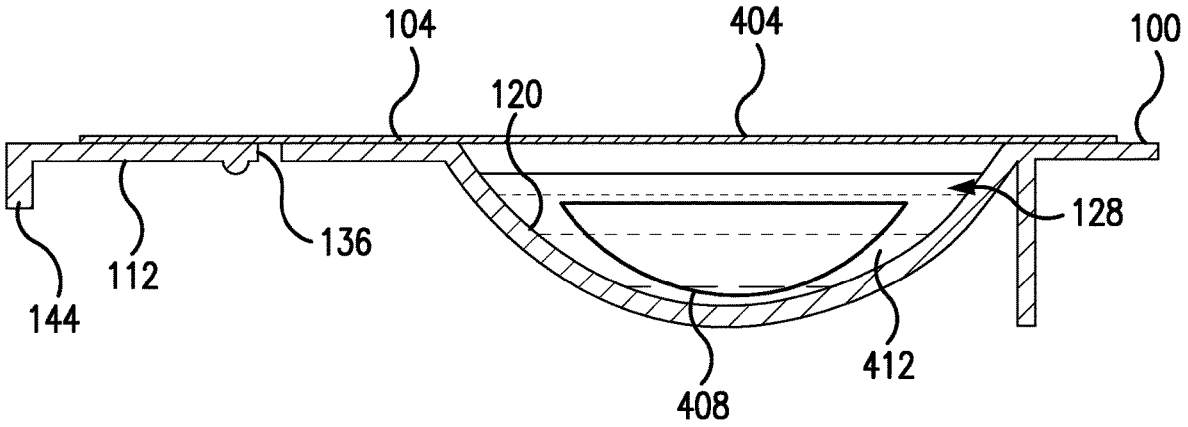
FIG. 4 is a cross-sectional side view of a contact lens package including a sealed base member and a contact lens and contact lens packaging solution contained therein, wherein the base member is the base member shown in FIGS. 1A and 1B.

A sealing member 404, such as a foil seal as shown in FIG. 4, can be sealed, adhered, or coupled to top planar surface 104 at the sealing ring surface to seal blister cavity 128. Sealing member 404 can be hermetically sealed to the sealing ring surface. An unworn contact lens 408 can be provided, sealed in blister cavity 128, along with contact lens solution 412, as shown in FIG. 4. Contact lens 408 can be a hydrogel contact lens, a silicone hydrogel contact lens, or the like. Sealing member 404 and contact lens solution 412 maintains unworn contact lens 408 in a sterile condition.

Blister cavity 128 contains a volume of contact lens solution 412. For example, blister cavity 128 contains from 0.1 mL to 2 mL, 0.2 mL to 1.8 mL, 0.3 mL to 1.7 mL, 0.4 mL to 1.6 mL, 0.5 mL to 1.5 mL, 0.6 mL to 1.4 mL, 0.7 mL to 1.3 mL, 0.8 mL to 1.2 mL, 0.9 mL to 1.1 mL, or 1 mL of contact lens solution 412. For example, cavity 128 contains no more than 2 mL, no more than 1.9 mL, no more than 1.8 mL, no more than 1.7 mL, no more than 1.6 mL, no more than 1.5 mL, no more than 1.4 mL, no more than 1.3 mL, no more than 1.2 mL, no more than 1.1 mL, or no more than 1.0 mL of contact lens solution 412. Cavity 128 can contain no less than 0.1 mL, no less than 0.2 mL, no less than 0.3 mL, no less than 0.4 mL, no less than 0.5 mL, no less than 0.6 mL, no less than 0.7 mL, no less than 0.8 mL, no less than 0.9 mL, or no less than 1.0 mL of contact lens solution 412.

Base member 100 further includes a clip 144 at the proximal end of the flange. Clip 144 extends from handle end 132 and has a length and width to fit within a slot of another base member. Clip 144 can include a key 160 or protrusion and a catch mechanism. The catch mechanism is a tapered surface in the shape of a barb that is provided on and extends downward from bottom surface 116. Key 160 or protrusion extends downward from the tapered surface. Key 160 is also off center relative to clip 144 in an opposing direction as compared to notch 138. The catch mechanism and key 160 are sized and positioned to fit through a slot and a notch of another base member, respectively. Slot 136 is sized to receive catch mechanism from a first direction, and catch the barb, preventing it from exiting slot 136 in a second direction opposite the first direction. Clip 144 can be malleable, deformable, elastically deformable, tapered, beveled, a combination thereof, or the like.

Contact lens package base member 100 can include a first vertical sidewall 168 and a second vertical sidewall 172. First vertical sidewall 168 and second vertical sidewall 172 are side tabs that provide strength to base member 100, prevent base member 100 from tipping over, and/or to prevent over-deformation of bowl 120. First vertical sidewall 168 and second vertical sidewall 172 can add stability to base members that are connected together. First vertical sidewall 168 can extend downwardly from edge 108. Second vertical sidewall 172 can extend downwardly from edge 108 and can be located on an opposite side of bowl 120, relative to first vertical sidewall 168. Bowl 120 can have a depth that is the same or greater in dimension than a height of first vertical sidewall 168 and second vertical sidewall 172.

First vertical sidewall 168 and second vertical sidewall 172 or side tabs can have a height from 1.5 mm to 4.5 mm, 2.0 mm to 4.0 mm, or 2.5 mm to 3.0 mm. For example, side tabs have a height of no more than 4.5 mm, no more than 4.0 mm, or no more than 3.0 mm. Side tabs can have a height of no less than 1.5 mm, no less than 2.0 mm, or no less than 2.5 mm.

First vertical sidewall 168 and second vertical sidewall 172 or side tabs can have a length from 5.0 mm to 11.0 mm, 6.0 mm to 10.0 mm, 7.0 mm to 9.0 mm, or 8.0 mm. For example, side tabs have a length of no more than 11.0 mm, no more than 10.0 mm, no more than 9.0 mm, or no more than 8.0 mm. Side tabs can have a length of no less than 5.0 mm, no less than 6.0 mm, no less than 7.0 mm, or no less than 8.0 mm.

Base member 100 can include a ridge line 134 extending downwardly from a substantial portion of edge 108 or the entire edge 108. Ridge line 134 can provide additional strength to base member 100.

Base member 100 can include stabilizing legs. The stabilizing legs can extend from bottom surface 116 of base member 100 and circumscribe the convex exterior surface. Base member 100 includes a first stabilizing leg 176, a second stabilizing leg 180, and a third stabilizing leg 184. First stabilizing leg 176, second stabilizing leg 180, and third stabilizing leg 184 extend downward from bottom surface 116 where dome 122 intersects with bottom surface 116 at dome edge 126. First stabilizing leg 176 is at the front side of dome 122. Second stabilizing leg 180 and third stabilizing leg 184 are at the rear side of dome 122 closer to handle 112. For example, first stabilizing leg 176, second stabilizing leg 180, and third stabilizing leg 184 can be 120 degrees apart from one another relative to a vertical axis extending through the center of dome 122. First stabilizing leg 176, second stabilizing leg 180, and third stabilizing leg 184 each have a leg height that is same or greater than the depth of dome 122 and can have a planar lower edge. When base members are stacked together, planar lower edges of first stabilizing leg 176, second stabilizing leg 180, and third stabilizing leg 184 contact a surface (e.g., top planar surface) of another base member. The stabilizing legs provide additional stability to stacked base members.

FIG. 23 shows the same features as FIG. 1A and includes a vertex region as part of the sealing rim. In FIG. 23, the raised sealing rim 3100 includes a vertex shape/portion 3200. The remaining features shown in FIG. 23 are same as in FIG. 1A.

Figure 2A:
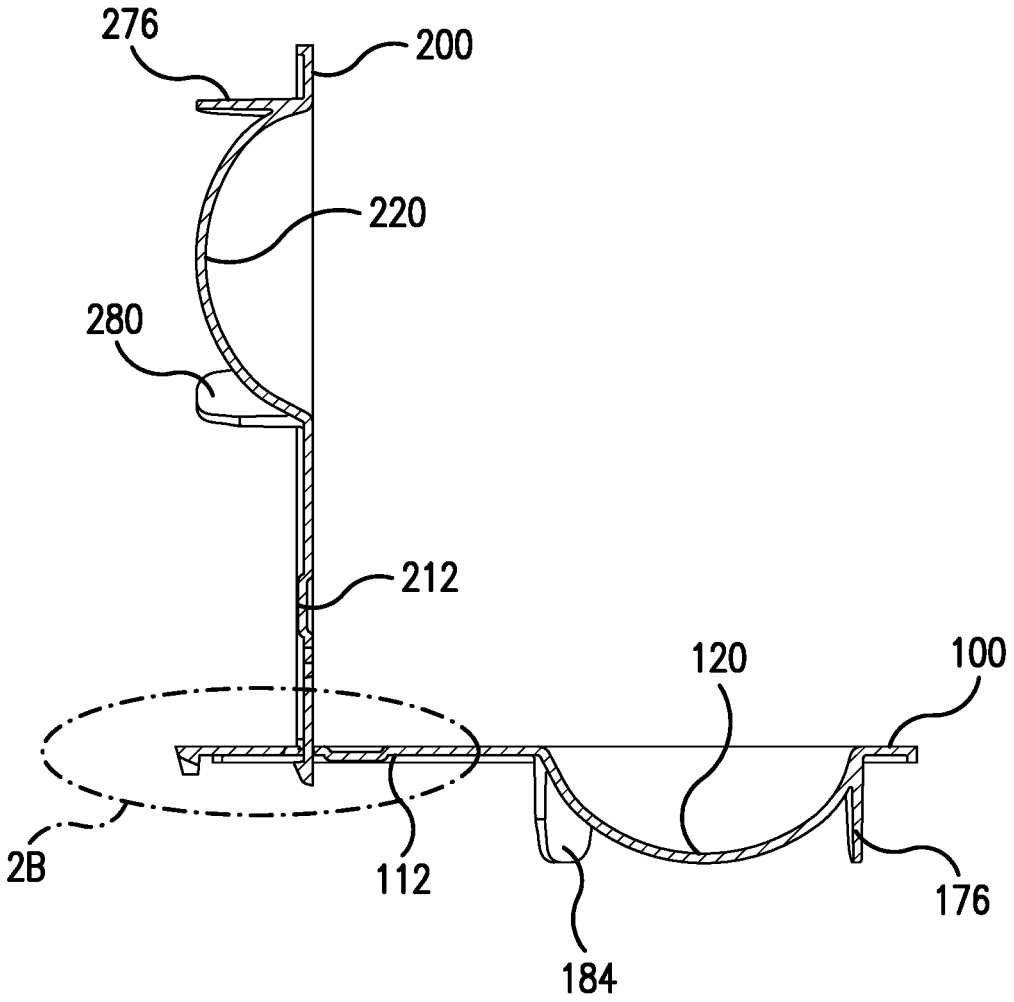
FIG. 2A is a side cut-away view of a recyclable assembly of two contact lens package base members each of which is individually shown in FIGS. 1A and 1B.
Figure 2B:
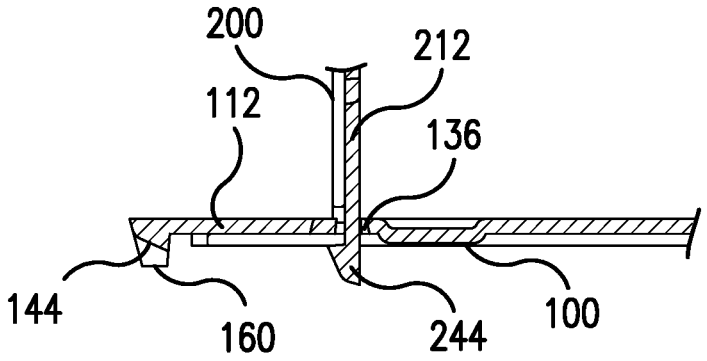
FIG. 2B is an enlarged view of the connecting members (hole/clip) shown in FIG. 2A.
Figure 3:
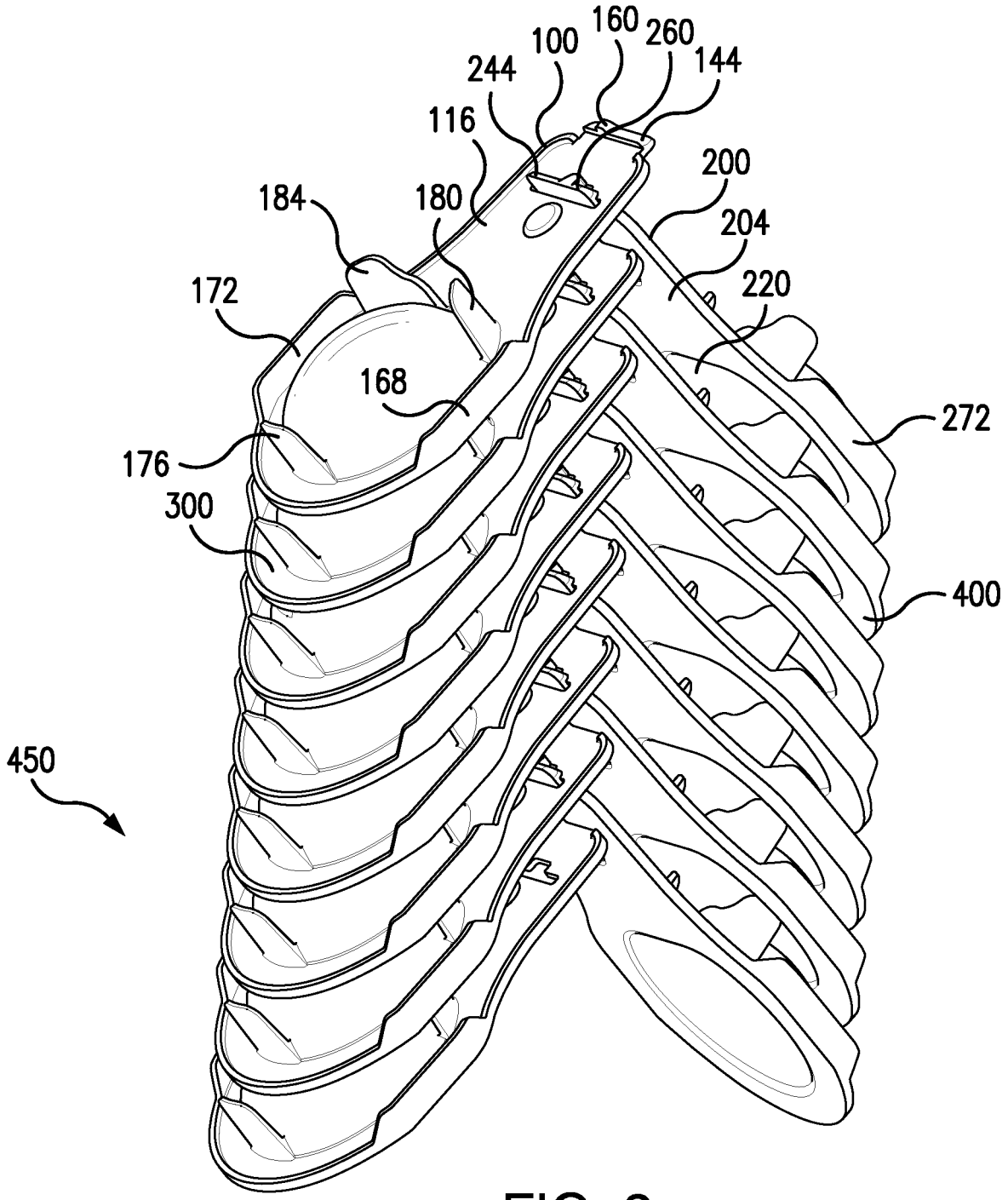
FIG. 3 is a bottom, side perspective view of a recyclable assembly of a plurality of base members shown in FIGS. 1A and 1B.

Also provided is a combination of two or more contact lens package base members, as shown in FIGS. 2A, 2B, and 3. The combination can be understood to be a stack or an assembly of contact lens package base members and can be a recyclable assembly 450. Contact lens package base members 100, 200, 300, and 400 can be the same as described above. For example, a second base member 200 can also have: a planar top surface 204 having an edge and at least partially defining a handle 212 or gripping portion; a bottom surface; a bowl 220 or recess that is recessed from planar top surface 204, has an upper rim that intersects with planar top surface 204, and defines a cavity configured for holding a contact lens, handle 212 extending away from bowl 220 and terminating at a handle end; a slot or hole or opening formed through the planar top surface, located in between the handle end and the upper rim, and having an elongated shape with a length orthogonal to a longitudinal axis of base member 200; a notch extending in a direction towards the handle end and offset from a center of the slot; a clip 244 extending from the handle end, clip 244 having a key 260; a first vertical sidewall and a second vertical sidewall 272; and a first stabilizing leg 276, a second stabilizing leg 280, and a third stabilizing leg.

Clip 244 of second contact lens package base member 200 can be configured to fit into the slot 136 of base member 100 (also referred to as first base member 100). As shown in FIGS. 2A and 2B, slot 136 received the catch mechanism of clip 244 from a first direction. The barb of the catch mechanism prevents clip 244 from exiting slot 136 in a second direction opposite the first direction, thus retaining second base member 200 to first base member 100.

As mentioned above, slot 136 of base member 100 has notch 138 that extends in a direction towards the handle end and is offset from the center of slot 136. Additionally, clip 144 includes key 160 that is offset from a center of clip 144 in an opposite direction as compared to notch 138. This creates a poka-yoke design for clip 144 and slot 135 connections. Key 160 guides clip 144 into the slot of another base member via the notch. Due to the offset key 160 and notch 138, base members can only connect together in a uniform configuration. As shown in FIG. 3, second base member 200 is connected to first base member 100, a third base member 300 is connected to second base member 200, a fourth base member 400 is connected to third base member 300 and so on, in a stacked and uniform configuration. Accordingly, the plurality of base members connected together are compact to define recyclable assembly 450.

FIGS. 5A-23 show different embodiments of the present invention. Each of these embodiments can have the same or similar dimensions, and/or characteristics, and/or materials as described in detail above or herein, with regard to FIGS. 1A-4.

Figure 5A:
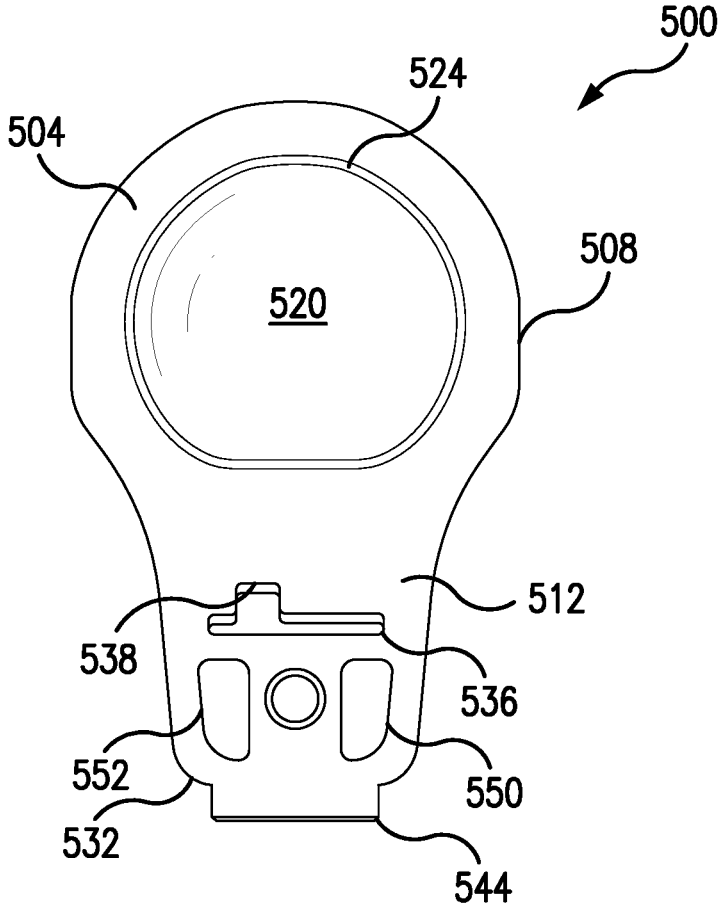
FIG. 5A is a top view of another embodiment of a thermoplastic base member according to the present invention.
Figure 5B:
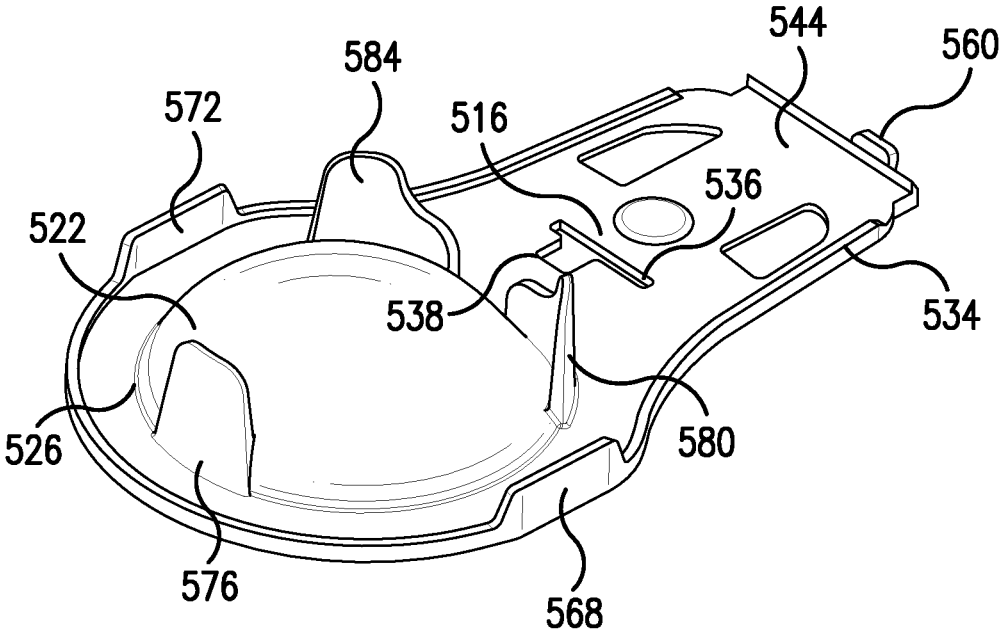
FIG. 5B is a bottom view of the base member shown in FIG. 5A.

As shown in FIGS. 5A and 5B, a contact lens package base member 500 includes a planar top surface 504. Planar top surface 504 has a sealing ring surface and an edge 508.

Base member 500 further includes a handle 512 or gripping portion at least partially defined by planar top surface 504. A bottom surface 516 opposes planar top surface 504. A bowl 520 or recess is provided recessed from planar top surface 504 and has an upper rim 524 that intersects with planar top surface 504 and defines a blister cavity. Blister cavity is configured for holding a contact lens. Bowl 520 defines a dome 522 protruding from bottom surface 516 that intersects with bottom surface 516 at a dome edge 526. Bowl 520 has a concave interior surface and dome 522 has a convex exterior surface. Handle 512 extends away from bowl 520 and terminates at a handle end 532 or gripping portion end.

Planar top surface 504 is a top surface of a flange projecting away from the blister cavity. Bottom surface 516 is a bottom surface of the flange. The flange provides the sealing ring region that circumscribes blister cavity. The flange can also provide handle 512 or gripping portion configured to be held between a thumb and a finger of a contact lens wearer. Handle 512 can be located at a proximal end of the flange, and blister cavity can be located closer to a distal end of the flange.

Base member 500 further includes a slot 536 or hole or opening formed through planar top surface 504 at handle 512. Slot 536 is located in between handle end 532 and upper rim 524. Slot 536 can be located at a greater distance from the blister cavity than edge 508 or outer perimeter of top surface 504. Slot 536 has an elongated shape with a length orthogonal to a longitudinal axis of base member 500.

The sealing ring surface of planar top surface 504 can have a circular configuration or a non-circular configuration when viewed from a top plan view.

A notch 538 is defined at an edge of slot 536. Notch 538 extends in a direction towards bowl 520 and is offset from a center of slot 536. In certain embodiments, notch 538 can extend in an opposing direction towards handle end 532. More than one notch 538 can be defined at the edge of slot 536

Base member 500 further includes a clip 544 at the proximal end of the flange. Clip 544 extends from handle end 532 and has a length and width to fit within a slot of another base member. Clip 544 can include a key 560 or protrusion and a catch mechanism. The catch mechanism is a tapered surface in the shape of a barb that is provided on and extends downward from bottom surface 516. Key 560 or protrusion extends downward from the tapered surface. Key 560 is also off center relative to clip 544 in an opposing direction as compared to notch 538. The catch mechanism and key 160 are sized and positioned to fit through a slot and a notch of another base member, respectively. Slot 536 is sized to receive the catch mechanism from a first direction, and catch the barb, preventing it from exiting slot 536 in a second direction opposite the first direction. Clip 544 can be malleable, deformable, elastically deformable, tapered, beveled, a combination thereof, or the like.

A first opening 550 and a second opening 552 are formed through handle 512 in between slot 536 and handle end 532. First and second openings 550, 552 can be used to further grip handle 512 and can reduce the weight of base member 500.

Contact lens package base member 500 can include a first vertical sidewall 568 and a second vertical sidewall 572. First vertical sidewall 568 and second vertical sidewall 572 are side tabs that provide strength to base member 500, prevent base member 500 from tipping over, and/or prevent over-deformation of bowl 520. First vertical sidewall 568 and second vertical sidewall 572 can add stability to base members that are connected together. First vertical sidewall 568 can extend downwardly from edge 508. Second vertical sidewall 572 can extend downwardly from edge 508 and can be located on an opposite side of bowl 520, relative to first vertical sidewall 568. Bowl 520 can have a depth that is the same or of greater dimension than a height of first vertical sidewall 568 and second vertical sidewall 572.

Base member 500 can include a ridge line 534 extending downwardly from a substantial portion of edge 508 or the entire edge 508. Ridge line 534 can provide additional strength to base member 500.

Base member 500 can include stabilizing legs. The stabilizing legs can extend from bottom surface 516 of base member 500 and circumscribe the convex exterior surface. Base member 500 includes a first stabilizing leg 576, a second stabilizing leg 580, and a third stabilizing leg 584. First stabilizing leg 576, second stabilizing leg 580, and third stabilizing leg 584 extend downward from bottom surface 516 where dome 522 intersects with bottom surface 516 at dome edge 526. First stabilizing leg 576 is at the front side of dome 522. Second stabilizing leg 580 and third stabilizing leg 584 are at the rear side of dome 522 closer to handle 512. For example, first stabilizing leg 576, second stabilizing leg 580, and third stabilizing leg 584 can be 120 degrees apart from one another relative to a vertical axis extending through the center of dome 522. First stabilizing leg 576, second stabilizing leg 580, and third stabilizing leg 584 each have a leg height that is the same or greater than the depth of dome 522 and can have a planar lower edge. When base members are stacked together, planar lower edges of first stabilizing leg 576, second stabilizing leg 580, and third stabilizing leg 584 contact a surface (e.g., top planar surface) of another base member. The stabilizing legs provide additional stability to stacked base members.

Multiple base members 500 can attach to one another via clip 544 and slot 536 in a similar manner as shown in FIG. 3, except in a flipped orientation due to the direction in which notch 538 is extending.

Figure 6A:
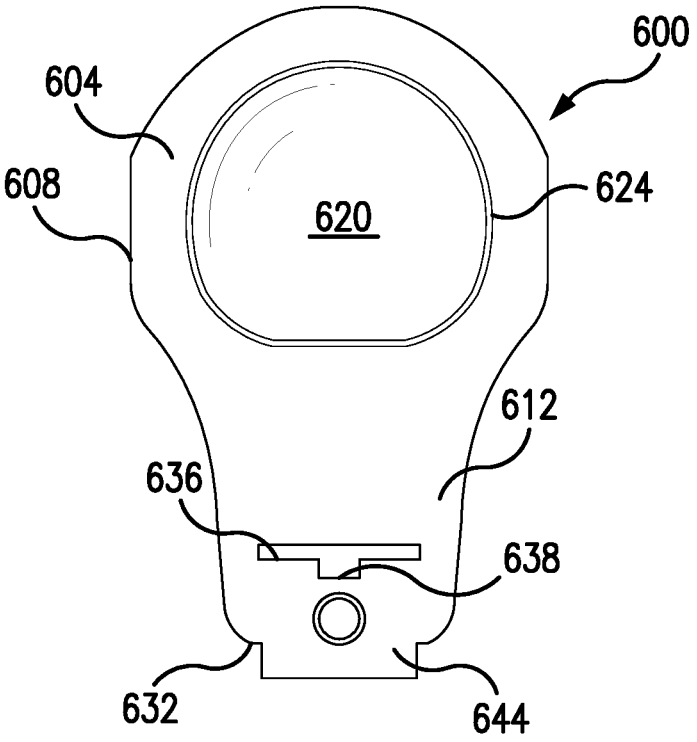
FIG. 6A is a top view of another embodiment of a thermoplastic base member according to the present invention.
Figure 6B:
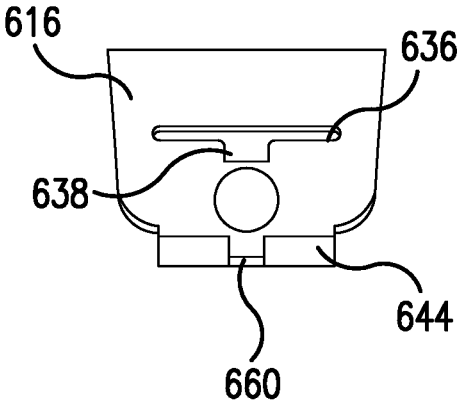
FIG. 6B is a partial cut-away view of the bottom surface of the handle end of the base member shown in FIG. 6A.

As shown in FIGS. 6A and 6B, a contact lens package base member 600 includes a planar top surface 604. Planar top surface 604 has a sealing ring surface and an edge 608. Base member 600 further includes a handle 612 or gripping portion at least partially defined by planar top surface 604. A bottom surface 616 opposes planar top surface 604. A bowl 620 or recess is provided recessed from planar top surface 604 and has an upper rim 624 that intersects with planar top surface 604 and defines a blister cavity. Blister cavity is configured for holding a contact lens. Handle 612 extends away from bowl 620 and terminates at a handle end 632 or gripping portion end.

Planar top surface 604 is a top surface of a flange projecting away from the blister cavity. Bottom surface 616 is a bottom surface of the flange. The flange provides the sealing ring region that circumscribes blister cavity. The flange can also provide handle 612 or gripping portion configured to be held between a thumb and a finger of a contact lens wearer. Handle 612 can be located at a proximal end of the flange, and blister cavity can be located closer to a distal end of the flange.

Base member 600 further includes a slot 636 or hole or opening formed through planar top surface 604 at handle 612. Slot 636 is located in between handle end 632 and upper rim 624. Slot 636 can be located at a greater distance from the blister cavity than edge 608 or outer perimeter of top surface 604. Slot 636 has an elongated shape with a length orthogonal to a longitudinal axis of base member 600.

A notch 638 is defined at an edge of slot 636. Notch 638 extends in a direction towards handle end 632 and is formed at a center of slot 636. In certain embodiments, notch 638 can extend in an opposing direction towards bowl 620. More than one notch 638 can be defined at the edge of slot 636.

The sealing ring surface of planar top surface 604 can have a circular configuration or a non-circular configuration when viewed from a top plan view.

Base member 600 further includes a clip 644 at the proximal end of the flange. Clip 644 extends from handle end 632 and has a length and width to fit within a slot of another base member. Clip 644 can include a key 660 or protrusion and a catch mechanism. The catch mechanism is a tapered surface in the shape of a barb that is provided on and extends downward from bottom surface 616. Key 660 or protrusion extends downward from the tapered surface. Key 660 is also centered relative to clip 644. The catch mechanism and key 660 are sized and positioned to fit through a slot and a notch of another base member, respectively. Slot 636 is sized to receive catch mechanism from a first direction, and catch the barb, preventing it from exiting slot 636 in a second direction opposite the first direction. Clip 644 can be malleable, deformable, elastically deformable, tapered, beveled, a combination thereof, or the like.

Multiple base members 600 can attach to one another via clip 644 and slot 636 in a similar manner as shown in FIG. 3 or can attach to one another in a non-uniform configuration.

Figure 7A:
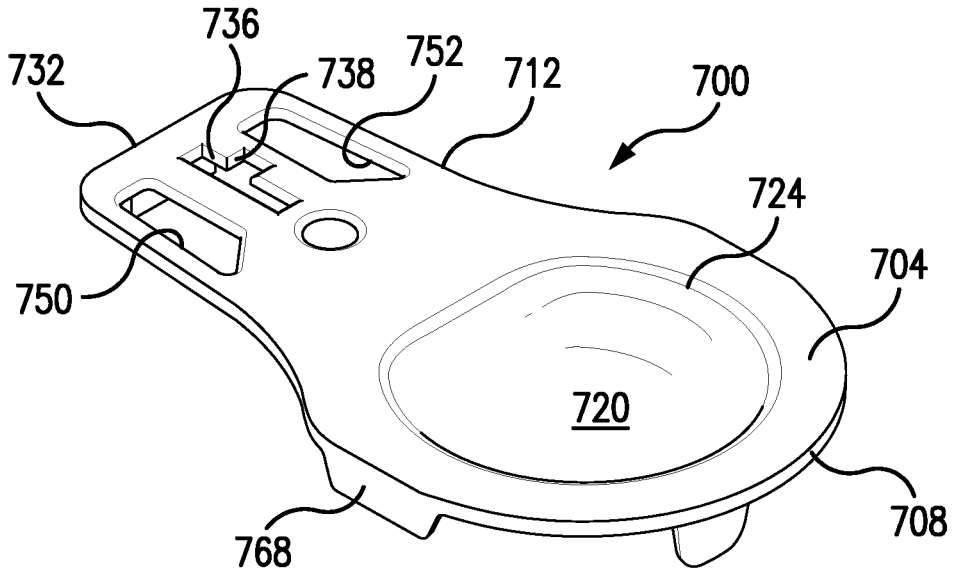
FIG. 7A is a top side perspective view of another embodiment of a thermoplastic base member according to the present invention.
Figure 7B:
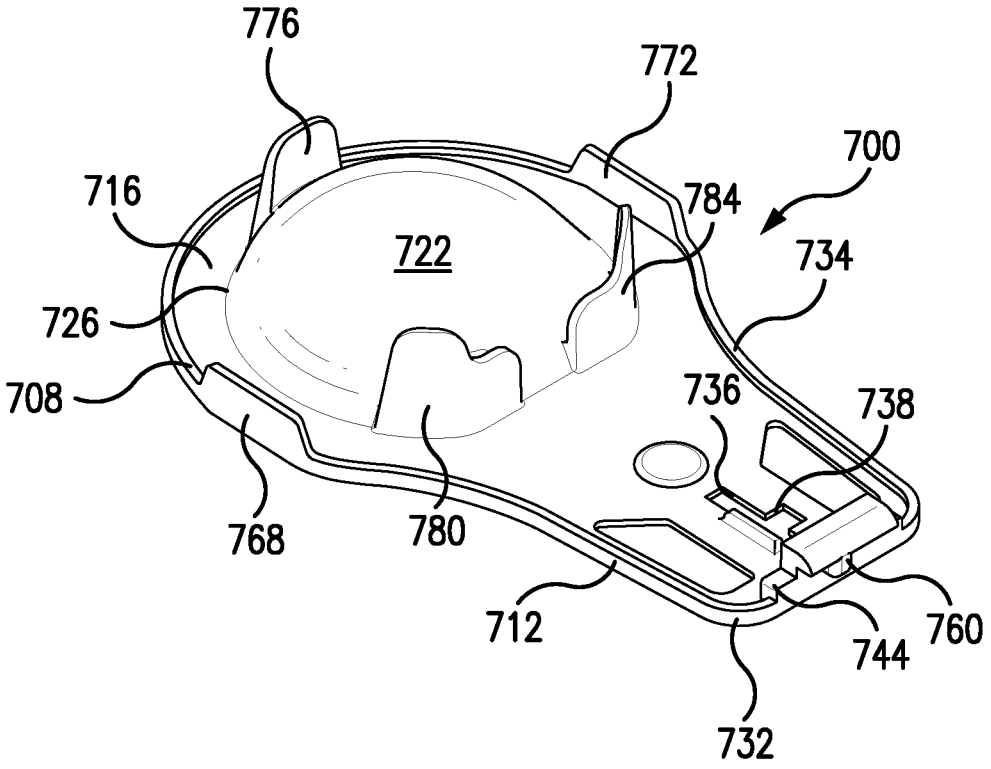
FIG. 7B is a bottom side perspective view of the contact lens package base member shown in FIG. 7A.

As shown in FIGS. 7A and 7B, the contact lens package base member 700 includes a planar top surface 704. Planar top surface 704 has a sealing ring surface and an edge 708. Base member 700 further includes a handle 712 or gripping portion at least partially defined by planar top surface 704. A bottom surface 716 opposes planar top surface 704. A bowl 720 or recess is provided recessed from planar top surface 704 and has an upper rim 724 that intersects with planar top surface 704 and defines a blister cavity. Blister cavity is configured for holding a contact lens. Bowl 720 defines a dome 722 protruding from bottom surface 716 that intersects with bottom surface 716 at dome edge 726. Bowl 720 has a concave interior surface and dome 722 has a convex exterior surface. Handle 712 extends away from bowl 720 and terminates at a handle end 732 or gripping portion end.

Planar top surface 704 is a top surface of a flange projecting away from blister cavity. Bottom surface 716 is a bottom surface of the flange. The flange provides the sealing ring region that circumscribes the blister cavity. The flange can also provide handle 712 or gripping portion configured to be held between a thumb and a finger of a contact lens wearer. Handle 712 can be located at a proximal end of the flange, and the blister cavity can be located closer to a distal end of the flange.

A first opening 750 and a second opening 752 are formed through handle 712 in between handle end 732 and blister cavity. First and second openings 750, 752 can be used to further grip handle 712 and can reduce the weight of base member 700.

The sealing ring surface of planar top surface 704 can have a circular configuration or a non-circular configuration when viewed from a top plan view.

Base member 700 further includes a slot 736 or hole or opening formed through planar top surface 704 at handle 712. Slot 736 is located in between first and second openings 750, 752. Slot 736 can be located at a greater distance from the blister cavity than edge 708 or outer perimeter of top surface 704. Slot 736 has an elongated shape with a length parallel to a longitudinal axis of base member 700. As shown in FIGS. 7A and 7B, length of slot 736 runs along the longitudinal axis of base member 700.

A notch 738 is defined at an edge of slot 736. Notch 738 extends in a direction towards second opening 752 and the side of base member 700. Notch 738 is offset from a center of slot 736. In certain embodiments, notch 738 can extend in an opposing direction towards first opening 750. More than one notch 738 can be defined at the edge of slot 736

Base member 700 further includes a clip 744 at the proximal end of the flange. Clip 744 includes a first portion 744*a* that extends downward from handle end 732 and a second portion 744*b* that is adjoined to a distal end of first portion 744*a* and extends rearward from handle end 732. Clip 744 has a length and width to fit within a slot of another base member. Clip 744 can include a key 760 or protrusion. Key 760 or protrusion extends rearward from first portion 744*a*, upward from second portion 744*b*, or both. Key 760 is also off center relative to clip 744. The key 760 is sized and positioned to fit through the notch of another base member. Clip 744 can be malleable, deformable, elastically deformable, tapered, beveled, a combination thereof, or the like.

Contact lens package base member 700 can include a first vertical sidewall 768 and a second vertical sidewall 772. First vertical sidewall 768 and second vertical sidewall 772 are side tabs that provide strength to base member 700, prevent base member 700 from tipping over, and/or to prevent over-deformation of bowl 720. First vertical sidewall 768 and second vertical sidewall 772 can add stability to base members that are connected together. First vertical sidewall 768 can extend downwardly from edge 708. Second vertical sidewall 772 can extend downwardly from edge 708 and can be located on an opposite side of bowl 720, relative to first vertical sidewall 768. Bowl 720 can have a depth that is the same or of greater dimension than a height of first vertical sidewall 768 and second vertical sidewall 772.

Base member 700 can include a ridge line 734 extending downwardly from a substantial portion of edge 708 or the entire edge 708. Ridge line 734 can provide additional strength to base member 700.

Base member 700 can include stabilizing legs. The stabilizing legs can extend from bottom surface 716 of base member 700 and circumscribe the convex exterior surface. Base member 700 includes a first stabilizing leg 776, a second stabilizing leg 780, and a third stabilizing leg 784. First stabilizing leg 776, second stabilizing leg 780, and third stabilizing leg 784 extend downward from bottom surface 716 where dome 722 intersects with bottom surface 716. First stabilizing leg 776 is at the front side of dome 722. Second stabilizing leg 780 and third stabilizing leg 784 are at the rear side of dome 722 closer to handle 712. For example, first stabilizing leg 776, second stabilizing leg 780, and third stabilizing leg 784 can be 120 degrees apart from one another relative to a vertical axis extending through the center of dome 722. First stabilizing leg 776, second stabilizing leg 780, and third stabilizing leg 784 each have a leg height that is the same or greater than the depth of dome 722 and can have a planar lower edge. When base members are stacked together, planar lower edges of first stabilizing leg 776, second stabilizing leg 780, and third stabilizing leg 784 contact a surface (e.g., top planar surface) of another base member. The stabilizing legs provide additional stability to stacked base members.

Figure 8A:
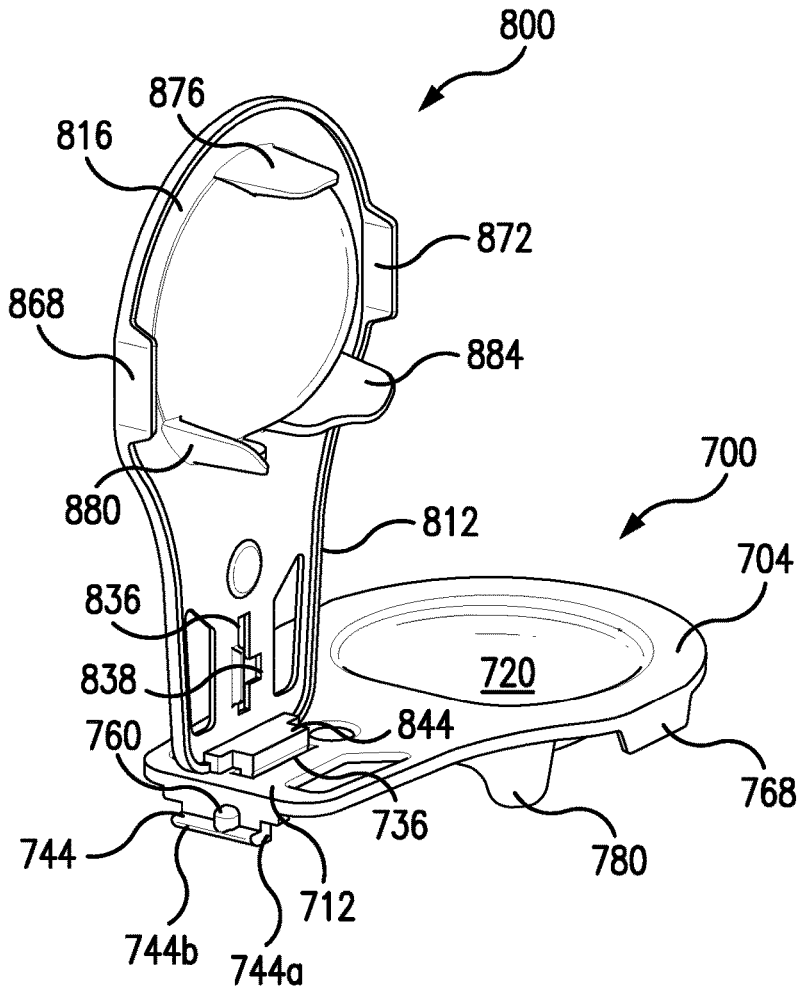
FIG. 8A is a side perspective view of two base members shown in FIGS. 7A and 7B being initially connected together before the interlocking of the two base members.
Figure 8B:
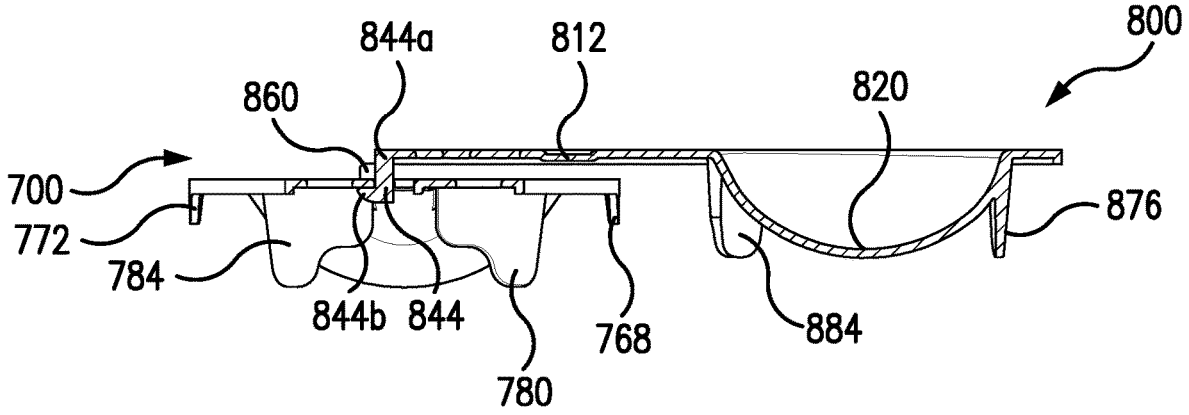
FIG. 8B is a cross-sectional side view of the recyclable assembly of a plurality of base members shown in FIG. 8A once connected together.
Figure 9:
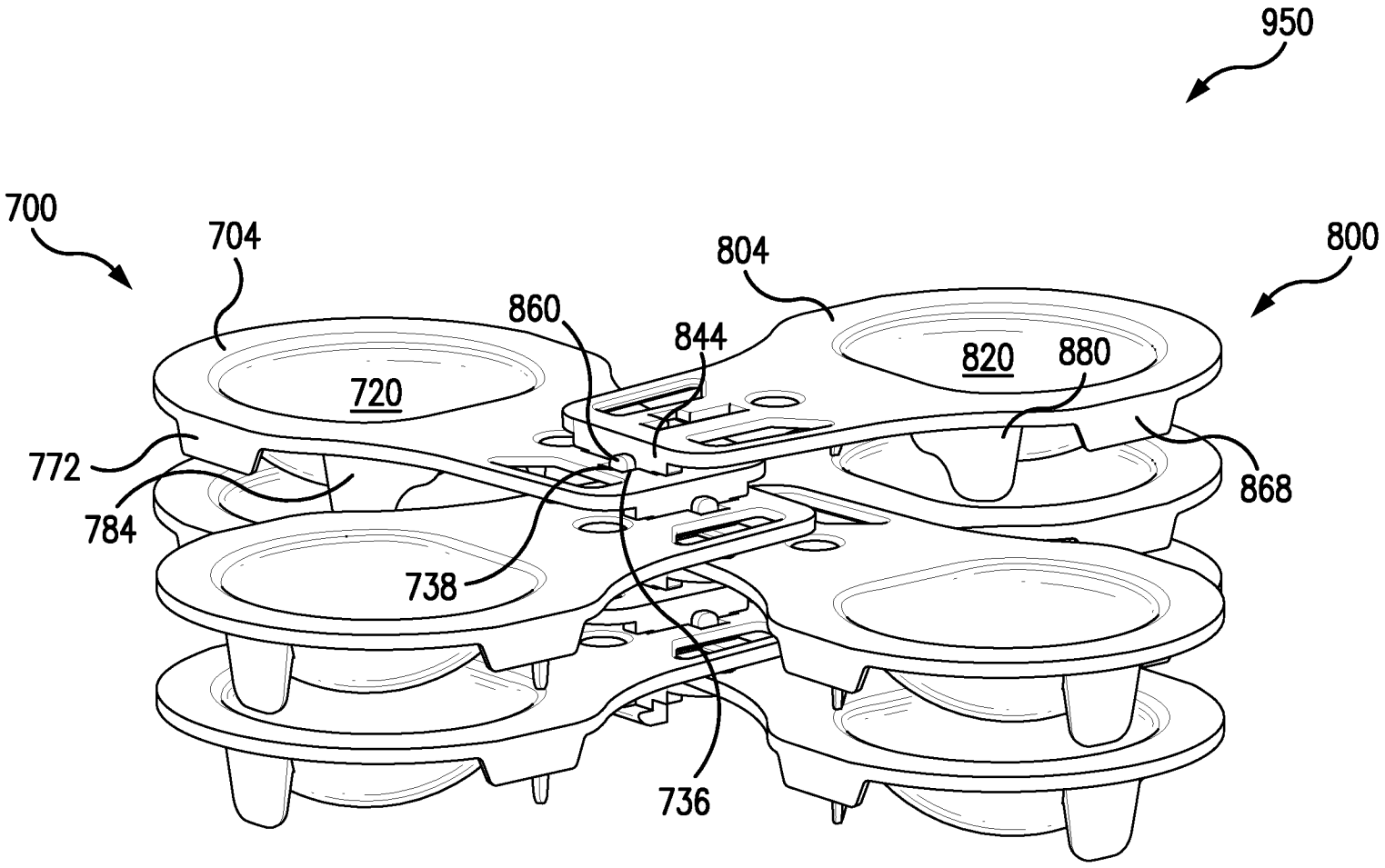
FIG. 9 is a perspective view of a plurality of base members shown in FIGS. 7A and 7B connected together to form the recyclable assembly.

Also provided is a combination of two or more contact lens package base members, as shown in FIGS. 8A, 8B, and 9. The combination can be understood to be a stack or an assembly of contact lens package base members and can be a recyclable assembly 950. Contact lens package base members 700 and 800 can be the same as described above. For example, a second base member 800 can also have: a planar top surface 804 having an edge and at least partially defining a handle 812 or gripping portion; a bottom surface 816; a bowl 820 or recess that is recessed from planar top surface 804, has an upper rim that intersects with planar top surface 804, and defines a cavity configured for holding a contact lens, handle 812 extending away from bowl 220 and terminating at a handle end; a slot 836 or hole or opening formed through the planar top surface, having an elongated shape with a length parallel to a longitudinal axis of base member 800; a notch extending in a direction towards a side of base member 800 and offset from a center of slot 836; a clip 844 extending from the handle end, clip 844 having a first portion 844*a*, a second portion 844*b*, and a key 860; a first vertical sidewall and a second vertical sidewall 872; and a first stabilizing leg 876, a second stabilizing leg 880, and a third stabilizing leg 884.

Clip 844 of second contact lens package base member 800 can be configured to fit into the slot 736 of base member 700 (also referred to as first base member 700). As shown in FIG. 8A, second base member 800 is orthogonal relative to first base member 700. Second portion 844*b* and key 860 are first inserted into slot 736 and notch 738, respectively. As shown in FIG. 8B, second base member 800 pivots such that first portion 844*a* is inserted into slot 836, and first base member 700 and second base member 800 are parallel. In this configuration, first base member 700 and second base member 800 are locked together.

As mentioned above, slot 736 of base member 700 has notch 738 that is offset from the center of slot 736. Additionally, clip 744 includes key 760 that is offset from a center of clip 744. This creates a poka-yoke design for clip 744 and slot 735 connections. Key 760 guides clip 744 into the slot of another base member via the notch. Due to the offset key 760 and notch 738, base members can only connect together in a uniform configuration. As shown in FIG. 9, second base member 800 is connected to first base member 700, a third base member is connected to second base member 800, a fourth base member is connected to third base member and so on, in a stacked and uniform configuration. Accordingly, the plurality of base members connected together provide a recyclable assembly 950.

Figure 10A:
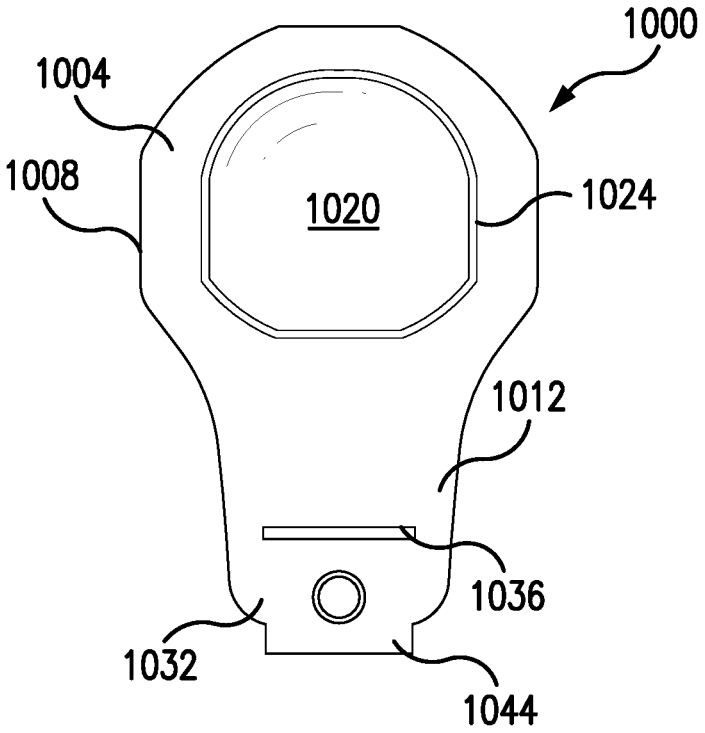
FIG. 10A is a top view of another embodiment of a thermoplastic base member according to the present invention.
Figure 10B:
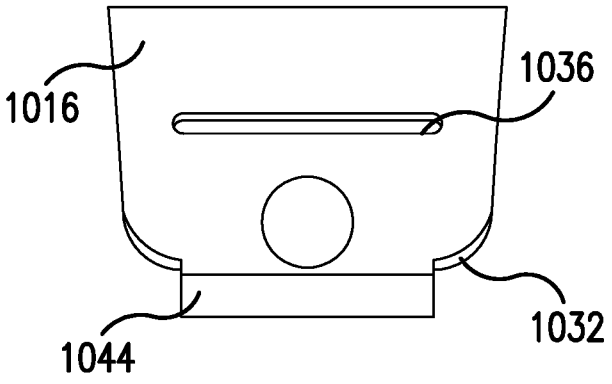
FIG. 10B is a partial cut-away view of the bottom surface of the handle end of the base member shown in FIG. 10A.

As shown in FIGS. 10A and 10B, a contact lens package base member 1000 includes a planar top surface 1004. Planar top surface 1004 has a sealing ring surface and an edge 1008. Base member 1000 further includes a handle 1012 or gripping portion at least partially defined by planar top surface 1004. A bottom surface 1016 opposes planar top surface 1004. A bowl 1020 or recess is provided recessed from planar top surface 1004 and has an upper rim 1024 that intersects with planar top surface 1004 and defines a blister cavity. Blister cavity is configured for holding a contact lens. Handle 1012 extends away from bowl 1020 and terminates at a handle end 1032 or gripping portion end.

Planar top surface 1004 is a top surface of a flange projecting away from the blister cavity. Bottom surface 1016 is a bottom surface of the flange. The flange provides the sealing ring region that circumscribes blister cavity. The flange can also provide handle 1012 or gripping portion configured to be held between a thumb and a finger of a contact lens wearer. Handle 1012 can be located at a proximal end of the flange, and blister cavity can be located closer to a distal end of the flange.

Base member 1000 further includes a slot 1036 or hole or opening formed through planar top surface 1004 at handle 1012. Slot 1036 is located in between handle end 1032 and upper rim 1024. Slot 1036 can be located at a greater distance from the blister cavity than edge 1008 or outer perimeter of top surface 1004. Slot 1036 has an elongated shape with a length orthogonal to a longitudinal axis of base member 1000. Slot 1036 is absent of a notch.

The sealing ring surface of planar top surface 1004 can have a circular configuration or a non-circular configuration when viewed from a top plan view.

Base member 1000 further includes a clip 1044 at the proximal end of the flange. Clip 1044 extends from handle end 1032 and has a length and width to fit within a slot of another base member. Clip 1044 is absent of a key. Clip 1044 includes a catch mechanism that is a tapered surface in the shape of a barb. The catch mechanism is provided on and extends downward from bottom surface 1016. The catch mechanism is sized and positioned to fit through a slot of another base member. Slot 1036 is sized to receive the catch mechanism from a first direction, and catch the barb, preventing it from exiting slot 1036 in a second direction opposite the first direction. Clip 1044 can be malleable, deformable, elastically deformable, tapered, beveled, a combination thereof, or the like.

Multiple base members 1000 can attach to one another via clip 1044 and slot 1036 in a similar manner as shown in FIG. 3 or can attach to one another in a non-uniform configuration.

As shown in FIGS. 11A-13, a contact lens package base member 1100 includes a planar top surface 1104. Planar top surface 1104 has a sealing ring surface and an edge 1108. Base member 1100 further includes a handle 1112 or gripping portion at least partially defined by planar top surface 1104. A bottom surface 1116 opposes planar top surface 1104. A bowl 1120 or recess is provided recessed from planar top surface 1104 and has an upper rim 1124 that intersects with planar top surface 1104 and defines a blister cavity. Blister cavity is configured for holding a contact lens. Bowl 1120 defines a dome 1122 protruding from bottom surface 1116 that intersects with bottom surface 1116 at a dome edge 1126. Bowl 1120 has a concave interior surface and dome 1122 has a convex exterior surface. Handle 1112 extends away from bowl 1120 and terminates at a handle end 1132 or gripping portion end.

Planar top surface 1104 is a top surface of a flange projecting away from the blister cavity. Bottom surface 1116 is a bottom surface of the flange. The flange provides the sealing ring region that circumscribes blister cavity. The flange can also provide handle 1112 or gripping portion configured to be held between a thumb and a finger of a contact lens wearer. Handle 1112 can be located at a proximal end of the flange, and blister cavity can be located closer to a distal end of the flange.

The sealing ring surface of planar top surface 1104 can have a circular configuration or a non-circular configuration when viewed from a top plan view.

Base member 1100 further includes a slot 1136 or hole or opening formed through planar top surface 1104 at handle 1112. Slot 1136 is located in between handle end 1132 and upper rim 1124. Slot 1136 can be located at a greater distance from the blister cavity than edge 1108 or outer perimeter of top surface 1104. Slot 1136 has an elongated shape with a length orthogonal to a longitudinal axis of base member 1100. Slot 1136 is absent a notch.

Base member 1100 further includes a clip 1144 at the proximal end of the flange. Clip 1144 extends from handle end 1132 and has a length and width to fit within a slot of another base member. Clip 1144 can include ends that have tapered edges. The ends having tapered edges define a first barb 1150 extending laterally from a first side and a second barb 1160 extending laterally from a second side opposite the first side. Slot 1136 is sized to receive clip 1144 from a first direction, and catch first barb 1150 and second barb 1160, preventing clip 1144 from exiting slot 1136 in a second direction opposite the first direction. Clip 1144 can be malleable, deformable, elastically deformable, tapered, beveled, a combination thereof, or the like.

Contact lens package base member 1100 can include a first vertical sidewall 1168 and a second vertical sidewall 1172. First vertical sidewall 1168 and second vertical sidewall 1172 are side tabs that provide strength to base member 1100, prevent base member 1100 from tipping over, and/or to prevent over-deformation of bowl 1120. First vertical sidewall 1168 and second vertical sidewall 1172 can add stability to base members that are connected together. First vertical sidewall 1168 can extend downwardly from edge 1108. Second vertical sidewall 1172 can extend downwardly from edge 1108 and can be located on an opposite side of bowl 1120, relative to first vertical sidewall 1168. Bowl 1120 can have a depth that is the same or of greater dimension than a height of first vertical sidewall 1168 and second vertical sidewall 1172.

Base member 1100 can include a ridge line 1134 extending downwardly from a substantial portion of edge 1108 or the entire edge 1108. Ridge line 1134 can provide additional strength to base member 1100.

Base member 1100 can include stabilizing legs. The stabilizing legs can extend from bottom surface 1116 of base member 1100 and circumscribe the convex exterior surface. Base member 1100 includes a first stabilizing leg 1176, a second stabilizing leg 1180, and a third stabilizing leg 1184. First stabilizing leg 1176, second stabilizing leg 1180, and third stabilizing leg 1184 extend downward from bottom surface 1116 where dome 1122 intersects with bottom surface 1116 at dome edge 1126. First stabilizing leg 1176 is at the front side of dome 1122. Second stabilizing leg 1180 and third stabilizing leg 1184 are at the rear side of dome 1122 closer to handle 1112. For example, first stabilizing leg 1176, second stabilizing leg 1180, and third stabilizing leg 1184 can be 120 degrees apart from one another relative to a vertical axis extending through the center of dome 1122. First stabilizing leg 1176, second stabilizing leg 1180, and third stabilizing leg 1184 each have a height that is the same or greater than the depth of dome 1122 and can have a planar lower edge. When base members are stacked together, planar lower edges of first stabilizing leg 1176, second stabilizing leg 1180, and third stabilizing leg 1184 contact a surface (e.g., top planar surface) of another base member. The stabilizing legs provide additional stability to stacked base members.

Also provided is a combination of two or more contact lens package base members, as shown in FIGS. 12 and 13. FIG. 12 is a partial and cut-away view of two base members, one of which has a clip inserted to the slot of the other base member. A cut-away view shows the interaction and position of the slot and clip when one base member is orthogonal to the other base member during insertion of the clip into the slot. The combination can be understood to be a stack or an assembly of contact lens package base members and can be a recyclable assembly 1350. Contact lens package base members 1100, 1200 can be the same as described above. For example, a second base member 1200 can also have: a planar top surface 1204 having an edge and at least partially defining a handle 1212 or gripping portion; a bottom surface 1216; a bowl 1220 or recess that is recessed from planar top surface 1204, has an upper rim that intersects with planar top surface 1204, and defines a cavity configured for holding a contact lens, handle 1212 extending away from bowl 1220 and terminating at a handle end; a slot 1236 or hole or opening formed through the planar top surface, located in between the handle end and the upper rim, and having an elongated shape with a length orthogonal to a longitudinal axis of base member 1200; a clip 1244 extending from the handle end, clip 1244 having a first barb 1250 extending laterally from a first side and a second barb 1260 extending laterally from a second side opposite the first side; a first vertical sidewall and a second vertical sidewall 1272; and a first stabilizing leg, a second stabilizing leg, and a third stabilizing leg 1284.

Clip 1244 of second contact lens package base member 1200 can be configured to fit into the slot 1136 of base member 1100 (also referred to as first base member 1100). As shown in FIG. 12, slot 1136 received clip 1244 from a first direction. First barb 1250 and second barb 1260 prevents clip 1244 from exiting slot 1136 in a second direction opposite the first direction, thus retaining second base member 1200 to first base member 1100. As shown in FIG. 13, second base member 1200 is connected to first base member 1100, a third base member is connected to second base member 1200, a fourth base member is connected to third base member and so on, in a stacked and uniform configuration. Accordingly, the plurality of base members connected together to obtain a recyclable assembly 1350. Alternatively, base members 1110, 1200 can be stacked in a non-uniform configuration.

As shown in FIGS. 14A-16, a contact lens package base member 1400 includes a planar top surface 1404. Planar top surface 1404 has a sealing ring surface and an edge 1408. Base member 1400 further includes a handle 1412 or gripping portion at least partially defined by planar top surface 1404. A bottom surface 1416 opposes planar top surface 1404. A bowl 1420 or recess is provided recessed from planar top surface 1404 and has an upper rim 1424 that intersects with planar top surface 1404 and defines a blister cavity. Blister cavity is configured for holding a contact lens. Bowl 1420 defines a dome 1422 protruding from bottom surface 1416 that intersects with bottom surface 1416 at a dome edge 1426. Bowl 1420 has a concave interior surface and dome 1422 has a convex exterior surface. Handle 1412 extends away from bowl 1420 and terminates at a handle end 1432 or gripping portion end.

Planar top surface 1404 is a top surface of a flange projecting away from the blister cavity. Bottom surface 1416 is a bottom surface of the flange. The flange provides the sealing ring region that circumscribes blister cavity. The flange can also provide handle 1412 or gripping portion configured to be held between a thumb and a finger of a contact lens wearer. Handle 1412 can be located at a proximal end of the flange, and blister cavity can be located closer to a distal end of the flange.

The sealing ring surface of planar top surface 1404 can have a circular configuration or a non-circular configuration when viewed from a top plan view.

Base member 1400 further includes a receptacle 1436 or hole or opening formed at planar top surface 1404 at handle 1412. Receptacle 1436 is located in between handle end 1432 and upper rim 1424. Receptacle 1436 can be located at a greater distance from the blister cavity than edge 1408 or outer perimeter of top surface 1404. Receptacle 1436 can include an inner sidewall having a flat portion and a curved portion.

Base member 1400 further includes a post 1444 or pin extending downward from bottom surface 1416. Post 1444 is located in between handle end 1432 and dome edge 1426. Post 1444 can include an outer sidewall having a flat portion and a curved portion. Receptacle 1436 is sized to receive post 1444 by aligning the flat portion of the outer sidewall of post 1444 with the flat portion of the inner sidewall of receptacle 1436 and aligning the curved portion of the outer sidewall of post 1444 with the curved portion of the inner sidewall of receptacle 1436. Post 1444 and receptacle 1436 have snap fit or pressure fit or a friction fit (or interference fit) and thus retain two base members together. The connection of two base members using the receptacle and post design is similar to how LEGO pieces are snapped together. The connection can be releasable. In the case of connecting base members together, the snap fit can have more interference or friction than LEGO pieces which intentionally makes the release of two base members difficult, as one optional design.

Contact lens package base member 1400 can include a first vertical sidewall 1468 and a second vertical sidewall 1472. First vertical sidewall 1468 and second vertical sidewall 1472 are side tabs that provide strength to base member 1400, prevent base member 1400 from tipping over, and/or to prevent over-deformation of bowl 1420. First vertical sidewall 1468 and second vertical sidewall 1472 can add stability to base members that are connected together. First vertical sidewall 1468 can extend downwardly from edge 1408. Second vertical sidewall 1472 can extend downwardly from edge 1408 and can be located on an opposite side of bowl 1420, relative to first vertical sidewall 1468. Bowl 1420 can have a depth that is the same or of greater dimension than a height of first vertical sidewall 1468 and second vertical sidewall 1472.

Base member 1400 can include a ridge line 1434 extending downwardly from a substantial portion of edge 1408 or the entire edge 1408. Ridge line 1434 can provide additional strength to base member 1400.

Base member 1400 can include stabilizing legs. The stabilizing legs can extend from bottom surface 1416 of base member 1400 and circumscribe the convex exterior surface. Base member 1400 includes a first stabilizing leg 1476, a second stabilizing leg 1480, and a third stabilizing leg 1484. First stabilizing leg 1476 extends downward from edge 1408, and second stabilizing leg 1480 and third stabilizing leg 1484 extend downward from bottom surface 1416 where dome 1422 intersects with bottom surface 1416 at dome edge 1426. First stabilizing leg 1476 is at the front side of base member 1400. Second stabilizing leg 1480 and third stabilizing leg 1484 are at the rear side of dome 1422 closer to handle 1412. For example, first stabilizing leg 1476, second stabilizing leg 1480, and third stabilizing leg 1484 can be 120 degrees apart from one another relative to a vertical axis extending through the center of dome 1422. First stabilizing leg 1476, second stabilizing leg 1480, and third stabilizing leg 1484 each have a leg height that is the same as or greater than the depth of dome 1422 and can have a planar lower edge. When base members are stacked together, planar lower edges of first stabilizing leg 1476, second stabilizing leg 1480, and third stabilizing leg 1484 contact a surface (e.g., top planar surface) of another base member. The stabilizing legs provide additional stability to stacked base members.

Also provided is a combination of two or more contact lens package base members, as shown in FIGS. 15 and 16. FIG. 15 is a cut-away and partial view of two base members connected together. The combination can be understood to be a stack or an assembly of contact lens package base members and can be a recyclable assembly 1650. Contact lens package base members 1400, 1500 can be the same as described above. For example, a second base member 1500 can also have: a planar top surface 1504 having an edge and at least partially defining a handle 1512 or gripping portion; a bottom surface; a bowl 1520 or recess that is recessed from planar top surface 1504, has an upper rim that intersects with planar top surface 1504, and defines a cavity configured for holding a contact lens, handle 1512 extending away from bowl 1520 and terminating at a handle end; a receptacle 1536 formed at the planar top surface 1504, located in between the handle end and the upper rim; a post 1544 extending downward from the bottom surface; a first vertical sidewall 1568 and a second vertical sidewall; and a first stabilizing leg, a second stabilizing leg 1580, and a third stabilizing.

Post 1544 of second contact lens package base member 1500 can be configured to friction fit into the receptacle 1436 of base member 1400 (also referred to as first base member 1400). As shown in FIG. 15, receptacle 1436 received post 1544 and snuggly fits within receptacle 1436. As shown in FIG. 16, second base member 1500 is connected to first base member 1400, a third base member is connected to first base member 1500, a fourth base member is connected to third base member and so on, in a stacked and uniform configuration. The connection of the base members can be done such that each successively connected base member is adjacent to the one connected beforehand and thus as shown in FIG. 16, the connected base members rotate around a central axis like the hands of a clock. In FIG. 16, five different orientations are shown around the central connected axis, and then further base members can be connected and placed on top of previously connect members to form a stacking network. The number of orientations about the connected axis can be more or less than five, and five orientations are just an example. The uniform configuration is due to the orientation of the flat portion and the curved portion of the inner sidewall of receptacles 1436, 1536, and the flat portion and the curved portion of the outer sidewall of posts 1444, 1544. Accordingly, the plurality of base members connected together to define a recyclable assembly 1650.

As shown in FIGS. 17A-19, a contact lens package base member 1700 includes a planar top surface 1704. Planar top surface 1704 has a sealing ring surface and an edge 1708. Base member 1700 further includes a handle 1712 or gripping portion at least partially defined by planar top surface 1704. A bottom surface 1716 opposes planar top surface 1704. A bowl 1720 or recess is provided recessed from planar top surface 1704 and has an upper rim 1724 that intersects with planar top surface 1704 and defines a blister cavity. Blister cavity is configured for holding a contact lens. Bowl 1720 defines a dome 1722 protruding from bottom surface 1716 that intersects with bottom surface 1716 at a dome edge 1726. Bowl 1720 has a concave interior surface and dome 1722 has a convex exterior surface. Handle 1712 extends away from bowl 1720 and terminates at a handle end 1732 or gripping portion end.

Planar top surface 1704 is a top surface of a flange projecting away from the blister cavity. Bottom surface 1716 is a bottom surface of the flange. The flange provides the sealing ring region that circumscribes blister cavity. The flange can also provide handle 1712 or gripping portion configured to be held between a thumb and a finger of a contact lens wearer. Handle 1712 can be located at a proximal end of the flange, and blister cavity can be located closer to a distal end of the flange.

The sealing ring surface of planar top surface 1704 can have a circular configuration or a non-circular configuration when viewed from a top plan view.

A female ridge 1736 is defined on the inner sidewall of bowl 1720. The inner sidewall of bowl 1720 can have multiple female ridges 1736 that define a step shaped surface. Consequently, a male ridge 1744 is defined on the outer sidewall of dome 1722. Outer sidewall of dome 1722 can have multiple male ridges 1744 that define a step shaped surface. Bowl 1720 and dome 1722 can be malleable, deformable, elastically deformable, a combination thereof, or the like. When pressed into one another, male ridge 1744 interlocks with a female ridge of another base member, creating a friction fit (or pressure fit or interference fit) and thus retaining (e.g., releasably retaining) the two base members together.

Contact lens package base member 1700 can include a vertical sidewall 1776. Vertical sidewall 1776 provides strength to base member 1700, prevents base member 1700 from tipping over, and/or prevents over-deformation of bowl 1720. Vertical sidewall 1776 can add stability to base members that are connected together. Vertical sidewall 1776 extends downwardly from edge 1708 at the distal end of base member 1700 and at least partially surrounds dome 1722 (e.g., vertical sidewall 1776 can surround from 25% to 75% of the circumference of dome 1722, such as 40% to 60%). Dome 1722 can have a depth that is the same or of greater dimension than a wall height of vertical sidewall 1776.

Also provided is a combination of two or more contact lens package base members, as shown in FIGS. 18 and 19. FIG. 18 is a cut-away and partial view of two base members friction fitted or pressure fitted together. The combination can be understood to be a stack or an assembly of contact lens package base members and can be a recyclable assembly 1950. Contact lens package base members 1700, 1800 can be the same as described above. For example, a second base member 1800 can also have: a planar top surface 1804 having an edge 1808 and at least partially defining a handle 1812 or gripping portion; a bottom surface; a bowl 1820 or recess that is recessed from planar top surface 1804, has an upper rim 1824 that intersects with planar top surface 1804, and defines a cavity configured for holding a contact lens, handle 1812 extending away from bowl 1820 and terminating at a handle end 1832; a female ridge 1836 defined in bowl 1720; a male ridge 1844 defined on the dome; and a vertical sidewall 1876.

The dome of a second contact lens package base member 1800 can be configured to friction fit into the bowl 1720 of base member 1700 (also referred to as first base member 1700). As shown in FIG. 18, the dome of second base member 1800 has been pressed into bowl 1720 of first base member 1700 such that male ridge 1844 of second base member 1800 interlocks or pressure fits with female ridge 1736 of first base member 1700, friction fitting the first base member 1700 and second base member 1800 together. As shown in FIG. 19, second base member 1800 is connected to first base member 1700, a third base member is connected to first base member 1700, a fourth base member is connected to third base member and so on, in a stacked and uniform configuration. Accordingly, the plurality of base members connected together to define recyclable assembly 1950.

As shown in FIGS. 20A-22, a contact lens package base member 2000 includes a planar top surface 2004. Planar top surface 2004 has a sealing ring surface and an edge 2008. Base member 2000 further includes a handle 2012 or gripping portion at least partially defined by planar top surface 2004. A bottom surface 2016 opposes planar top surface 2004. A bowl 2020 or recess is provided recessed from planar top surface 2004 and has an upper rim 2024 that intersects with planar top surface 2004 and defines a blister cavity. The blister cavity is configured for holding a contact lens. Bowl 2020 defines a dome 2022 protruding from bottom surface 2016 that intersects with bottom surface 2016 at a dome edge 2026. Bowl 2020 has a concave interior surface and dome 2022 has a convex exterior surface. Handle 2012 extends away from bowl 2020 and terminates at a handle end 2032 or gripping portion end.

Planar top surface 2004 is a top surface of a flange projecting away from the blister cavity. Bottom surface 2016 is a bottom surface of the flange. The flange provides the sealing ring region that circumscribes blister cavity. Handle 2012 can extend from or be formed of the flange. Handle 2012 can include a U-shape, in which a portion of edge 2008 is exposed in between the U-shape of handle 2012.

The sealing ring surface of planar top surface 2004 can have a circular configuration or a non-circular configuration when viewed from a top plan view.

Base member 2000 can further include a plurality of notches defined on edge 2008. As shown in FIGS. 20A and 20B, the present invention can include a first notch 2036*a*, a second notch 2036*b*, a third notch 2036*c* and a fourth notch 2036*d*. Notches 2036*a*, 2036*b*, 2036*c*, and 2036*d* can be 90 degrees apart from one another relative to a vertical axis extending through the center of bowl 2020. Fourth notch 2036*d* is defined at edge 2008 within the U-shape of handle 2012.

Base member 2000 can further include a plurality of clips extending downward from edge 2008. As shown in FIGS. 20A and 20B, the present invention can include a first clip 2044*a*, a second clip 2044*b*, a third clip 2044*c*, and a fourth clip 2044*d*. Clips 2044*a*, 2044*b*, 2044*c*, and 2044*d* can be 90 degrees apart from one another relative to a vertical axis extending through the center of dome 2022. Each of clips 2044*a*, 2044*b*, 2044*c*, and 2044*d* can have a barbed shaped end having a tapered surface facing inward and a receiving recess above the barbed shaped end at an inner surface of the respective clip.

Also provided is a combination of two or more contact lens package base members, as shown in FIGS. 21 and 22. FIG. 21 is a cut-away and partial view of two base members connected together. The combination can be understood to be a stack or an assembly of contact lens package base members and can be a recyclable assembly 2250. Contact lens package base members 2000, 2100 can be the same as described above. For example, a second base member 2100 can also have: a planar top surface 2104 having an edge and at least partially defining a handle 2112 or gripping portion; a bottom surface; a bowl 2120 or recess that is recessed from planar top surface 2104, has an upper rim that intersects with planar top surface 2104, and defines a cavity configured for holding a contact lens, handle 2112 extending away from bowl 2120 and terminating at a handle end 2132; four notches 2136; and four clips 2144.

Clips 2144 of second contact lens package base member 2100 are first aligned with respective notches 2036*a*, 2036*b*,

2036*c*, and 2036*d* of base member 2000 (also referred to as first base member 2000). Clips 2144 are urged over notches 2036*a*, 2036*b*, 2036*c*, and 2036*d* such that the tapered surfaces of clips 2144 slide over notches 2036*a*, 2036*b*, 2036*c*, and 2036*d*, with clips 2144 temporarily being deformed. Once the tapered surfaces are urged past notches 2036*a*, 2036*b*, 2036*c*, and 2036*d*, the clips snap back to an original nondeformed state, and the receiving recesses of the clips 2144 receive notches 2036*a*, 2036*b*, 2036*c*, and 2036*d*, securing second base member 2100 to first base member 2000. As shown in FIG. 22, second base member 2100 is connected to first base member 2000, a third base member is connected to first base member 2100, a fourth base member is connected to third base member and so on, in a stacked and uniform configuration. The configuration can be such that each successively connected base member is connected such that the handle is adjacent the handle of the previously connected base member immediately below. Thus, the connection of the base members can be done such that each successively connected base member is adjacent to the one connected beforehand and thus as shown in FIG. 22, the connected base members rotate around a central axis like the hands of a clock. In FIG. 22, four different orientations are shown around the central connected axis, with three to four more different orientations possible and then further base members can be connected and placed on top of previously connect members to form a stacking network. The number of orientations about the connected axis can be more or less than five, and the orientations and number of orientations are just an example. Accordingly, the plurality of base members connected together to define a recyclable assembly 2250. Alternatively, base members 2100, 2200 can be stacked in a non-uniform configuration.

For any value provided for any dimension or size or angle or range, or other parameter herein, it is to be understood that these measurements or amounts or numbers can instead be a value that is plus or minus 1%, 5%, 10%, 15%, 20% or 25% from any one or more of the values provided.

As another aspect of the present invention, a method of manufacturing a packaged contact lens is provided.

The method of manufacturing can comprise, consists of, consist essentially of, or include the steps of providing a contact lens blister package as described herein; placing a contact lens into the blister cavity of the thermoplastic base member; placing a volume of liquid contact lens packaging solution into the blister cavity of the thermoplastic base member; and sealing a sealing member to the sealing rim region of the thermoplastic base member.

As with any thermoplastic base member, with the shape and design being understood and provided, the base members of the present invention, as described and shown herein, can be made by injection molding using conventional molding techniques and molding equipment. Essentially, the same equipment and procedures used to make convention base members can be applied and utilized here in view of the detailed description provided herein on the novel and inventive base members of the present invention.

The method of manufacturing can further include autoclaving the sealed contact lens blister package to sterilize the contact lens and the packaging solution.

A method of recycling a plurality of used contact lens package base members (as described herein) is also provided (e.g., an empty base member or a base member that has the seal member removed along with the lens and packaging solution removed). The method can comprise starting with or providing a plurality of used contact lens package base members. Each of the plurality of used contact lens package base members can independently define a cavity that is sized to retain a contact lens therein.

The method of recycling the contact lens blister package can comprise, consists of, or include: removing the sealing member from the thermoplastic base member; removing the contact lens from the blister cavity; removing the liquid contact lens packaging solution from the blister cavity; coupling two of the thermoplastic base members of two contact lens blister packages by inserting the proximal end of one thermoplastic base member into the hole (e.g., slot) of the second thermoplastic base member to form a thermoplastic base member assembly.

The method of recycling can further include coupling additional thermoplastic base members to the thermoplastic base member assembly to form an assembly comprising at least 5, at least 10, at least 20, or at least 30 thermoplastic base members coupled together to form a thermoplastic base member recycling unit.

The method of recycling can further include placing the thermoplastic base member recycling unit in a recycling receptacle.

The method of recycling can involve utilizing the connecting feature that is part of the base member so as to connect a plurality of base members together. The connecting can comprise, consists of, or include interlocking two or more base members together utilizing the clip of one base member with a hole or slot of a second base member, or stacking two or more base members together utilizing stackable feature as described here. By utilizing the connecting feature, the base members are mechanically connected or fastened together by way of the clip and hole/slot and/or by way of the pin and the slot/recess or the nesting of bowls together. As a result, a stack is formed.

Once enough base members are stacked together, the stack can be large enough to be a recyclable assembly. The recyclable assembly can then be recycled.

The present invention further includes a recyclable thermoplastic contact lens assembly. The assembly can be considered a recyclable plastic contact lens assembly, a recyclable thermoplastic assembly, or a recyclable assembly. In lieu of a thermoplastic material, any recyclable material can be used. The recyclable assembly includes a plurality of empty contact lens packages as described herein. In other words, the recyclable assembly includes a plurality of contact lens package base members without contact lenses or packaging solution. Each empty contact lens package comprises a base member having a cavity. The base member is as described herein. The base members that are attached together are empty (i.e., the sealing member has been opened or removed and the contact lens removed by the wearer or user.) If the sealing member is of the same recycle category as the base member, as an option, the sealing member can be attached as well to the base members.

As an option, the recyclable thermoplastic assembly can have at least an overall height of at least 2 inches (e.g., from 2 inches to 6 inches or more) and either or both of a width and depth of at least 2 inches (e.g., from 2 inches to 6 inches or more). These dimensions permit the assembly to be deposited into a recycling bin and be acceptable for recycling in a recycling facility.

As indicated, the unworn contact lens is sealed within the cavity of the sealed contact lens package and is packaged in a contact lens packaging solution. Any contact lens can be packaged therein. For example, the contact lens can be a hydrogel contact lens or it can be a silicone hydrogel contact lens. Examples of contact lenses that can be provided in the packages include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, fanfilcon A, etafilcon A, senofilcon A, senofilcon B, senofilcon C, narafilcon A, narafilcon B, balafilcon A, samfilcon A, lotrafilcon A, lotrafilcon B, somofilcon A, riofilcon A, delefilcon A, kalifilcon A, lehfilcon A, and the like. The contact lens packaging solution is typically a buffered saline solution, such as a phosphate buffered saline solution or a borate buffered saline solution, that may contain one or more additives, such as surfactants, wetting agents, viscosity agents, and the like.

The contact lens in the base member can be a soft contact lens, such as a soft silicone hydrogel contact lens.

The contact lens may be of any lens wear modality. Lens wear modality refers to the how many days and nights in a row the lens can be worn without removal. In one example, the contact lens is a daily disposable lens. Daily disposable lenses are indicated for single use, up to about 12 or 16 hours of continuous wear and should be discarded after the single use. In another example, the contact lens is a daily wear lens. Daily wear lenses are worn during the waking hours, typically up to about 12 to 16 hours, and are removed before sleep. Daily wear lenses are typically stored in a contact lens case containing a contact lens care solution for cleaning and disinfecting the lens during the hours of non-use. Daily wear lenses are typically discarded after a maximum of 30 days wear. In yet another example, the contact lens is an extended wear lens. Extended wear lenses are typically worn continuously for up to 6, 14 or 30 consecutive days and nights.

The packaging solution sealed within the contact lens package may be any conventional contact-lens compatible solution. In one example, the packaging solution comprises, consists, or consists essentially, of an aqueous solution of a buffer, and/or a tonicity agent. In another example, the packaging solution contains additional agents such as one or more additional antimicrobial agents, and/or a comfort agent, and/or a hydrophilic polymer, and/or a surfactant and/or other beneficial agent. In some examples, the packaging solution may comprise polysaccharides (e.g., hyaluronic acid, hydroxypropyl methylcellulose, hydroxypropyl cellulose, hydroxyethyl cellulose, etc.) or other high molecular weight polymers, such as polyvinyl pyrrolidone, which are commonly used as comfort polymers or thickening agents in ophthalmic solutions and contact lens packaging solutions. In other examples, the packaging solution may comprise an ophthalmic drug. The packaging solution can have a pH in the range of about 6.8 or 7.0 up to about 7.8 or 8.0. In one example, the packaging solution comprises phosphate buffer or borate buffer. In another example, the packaging solution comprises a tonicity agent selected from sodium chloride or sorbitol in an amount to maintain osmolality in the range of about 200 to 400 mOsm/kg, and typically from about 270 mOsm/kg up to about 310 mOsm/kg.

It will be appreciated that conventional manufacturing methods can be used to manufacture the sealed contact lens package. In a method of manufacturing a contact lens package, the method can include the step of placing an unworn contact lens and a contact lens packaging solution in a receptacle, placing a cover on the receptacle, and sealing the cover on the receptacle. Generally, the receptacle is configured to receive a single contact lens and an amount of packaging solution sufficient to completely cover the contact lens, typically about 0.5-1.5 ml. In one example, the receptacle comprises a plastic base member comprising a connecting member (e.g., a latch, a slot), a cavity configured to retain the contact lens and packaging solution and a flange region extending outwardly around the cavity, and the cover comprises a removable foil (or other sealing cover or lid) attached to the flange region to provide the sealed contact lens package. The removable foil (or other sealing cover or lid) may be sealed by any conventional means such as heat sealing or gluing. The method of manufacturing the sealed contact lens package may further comprise sterilizing the unworn contact lens by autoclaving the sealed contact lens package. The sealed package may be sterilized by sterilizing amounts of radiation, including heat or steam, such as by autoclaving, or by gamma radiation, e-beam radiation, ultraviolet radiation, etc. Autoclaving generally involves subjecting the sealed contact lens package to temperatures of at least 121° C. for at least 20 minutes.

With the present invention, it becomes possible to recycle used or opened contact lens packages as a collective unit such that the packages that form the collective unit preferably do not break or separate while being processed at a recycling facility. The collective unit is sufficiently dimensioned so as to be processed as recyclable material.

With the present invention, a person has an easy way to recycle used or opened contact lens packages.

With the present invention, a person has a simple yet efficient way to recycle used or opened contact lens packages, and by providing a simple way, this can encourage a person to actually recycle this material. For example, after removing the sealing member and contact lens from the base member, the base member can simply be pressed against another open base member such that the two are coupled together to form an assembly or stack that has a size, such as a volume or surface area that is greater than a single base member alone. Once enough base members are stacked, minimum size requirements can be met and a recyclable assembly is formed.

References herein to "an example" or "a specific example" or "an aspect" or "an embodiment" or similar phrase, are intended to introduce a feature or features of the invention, or components thereof, or methods thereof (depending on context) that can be combined with any combination of previously-described or subsequently-described examples, aspects, embodiments (i.e., features), unless a particular combination of features is mutually exclusive, or if context indicates otherwise. Further, as used in this specification, the singular forms "a," "an," and "the" include plural referents (e.g., at least one or more) unless the context clearly dictates otherwise. Thus, for example, reference to a "contact lens" includes a single lens as well as two or more of the same or different lenses.

The present invention includes the following aspects/embodiments/features in any order and/or in any combination:

1. The present invention relates to a contact lens blister package, comprising:

a thermoplastic base member having a weight from 0.40 g to 0.72 g and comprising a bowl that defines a blister cavity dimensioned to accommodate a contact lens, and a flange projecting away from the blister cavity, the flange having a top surface and a bottom surface, the flange providing a sealing ring region circumscribing the blister cavity at the top surface, and the flange providing a gripping portion configured to be held between a thumb and a finger of a contact lens wearer;

a liquid contact lens packaging solution provided in the blister cavity;

an unworn contact lens located in the contact lens packaging solution in the cavity; and a sealing member hermetically sealed to the sealing ring region of the thermoplastic base member to maintain the contact lens in a sterile condition.

2. The contact lens blister package or method or other embodiment of any preceding or following embodiment/feature/aspect, wherein the thermoplastic base member has a weight from 0.50 g to 0.70 g.

3. The contact lens blister package or method or other embodiment of any preceding or following embodiment/feature/aspect, wherein the contact lens is a hydrogel contact lens or a silicone hydrogel contact lens.

4. The contact lens blister package or method or other embodiment of any preceding or following embodiment/feature/aspect, wherein the thermoplastic base member comprises a recyclable plastic material.

5. The contact lens blister package or method or other embodiment of any preceding or following embodiment/feature/aspect, wherein the thermoplastic base member comprises a polypropylene material.

6. The contact lens blister package or method or other embodiment of any preceding or following embodiment/feature/aspect, wherein the sealing ring region has a circular configuration or a non-circular configuration when viewed from a top plan view.

7. The contact lens blister package or method or other embodiment of any preceding or following embodiment/feature/aspect, wherein the sealing ring region has a non-circular configuration that includes a vertex.

8. The contact lens blister package or method or other embodiment of any preceding or following embodiment/feature/aspect, wherein the sealing ring region has a width from 1.0 mm to 4.0 mm.

9. The contact lens blister package or method or other embodiment of any preceding or following embodiment/feature/aspect, wherein the gripping portion is planar.

10. The contact lens blister package or method or other embodiment of any preceding or following embodiment/feature/aspect, further comprising a connecting member configured to mechanically fasten the thermoplastic base member to a second thermoplastic base member of another contact lens blister package.

11. The contact lens blister package or method or other embodiment of any preceding or following embodiment/feature/aspect, wherein the connecting member is at least one of an interlocking feature and a stackable feature.

12. The contact lens blister package or method or other embodiment of any preceding or following embodiment/feature/aspect, wherein the connecting member is the interlocking feature, and the interlocking feature comprises a hole, a clip, a latch, or a combination thereof.

13. The contact lens blister package or method or other embodiment of any preceding or following embodiment/feature/aspect, wherein the interlocking feature comprises the hole on the flange comprises one hole.

14. The contact lens blister package or method or other embodiment of any preceding or following embodiment/feature/aspect, wherein the interlocking feature comprises the hole and the hole is a slot defined through the flange, the slot having a length greater than a width.

15. The contact lens blister package or method or other embodiment of any preceding or following embodiment/feature/aspect, wherein the slot is located at a greater distance from the blister cavity than an outer perimeter of the flange.

16. The contact lens blister package or method or other embodiment of any preceding or following embodiment/feature/aspect, wherein the width of the slot is from 0.5 mm to 1.5 mm and the length of the slot is from 3.0 mm to 13.0 mm.

17. The contact lens blister package or method or other embodiment of any preceding or following embodiment/feature/aspect, wherein the length of the slot is perpendicular to a longitudinal axis of the thermoplastic base member.

18. The contact lens blister package or method or other embodiment of any preceding or following embodiment/feature/aspect, wherein the length of the slot is parallel to a longitudinal axis of the thermoplastic base member.

19. The contact lens blister package or method or other embodiment of any preceding or following embodiment/feature/aspect, wherein the slot is from 5 degrees to 45 degrees from being perpendicular to a longitudinal axis of the thermoplastic base member.

20. The contact lens blister package or method or other embodiment of any preceding or following embodiment/feature/aspect, wherein the slot comprises a notch defined at an edge of the slot.

21. The contact lens blister package or method or other embodiment of any preceding or following embodiment/feature/aspect, wherein the notch is defined along a side of the length of the slot.

22. The contact lens blister package or method or other embodiment of any preceding or following embodiment/feature/aspect, wherein the notch is off-centered from a center of the length of the slot.

23. The contact lens blister package or method or other embodiment of any preceding or following embodiment/feature/aspect, wherein the notch is at a center of the length of the slot.

24. The contact lens blister package or method or other embodiment of any preceding or following embodiment/feature/aspect, wherein the notch has a square shape, a rectangular shape, an oval shape, or a circular shape.

25. The contact lens blister package or method or other embodiment of any preceding or following embodiment/feature/aspect, wherein the interlocking feature further comprises the clip having dimensions configured to fit through the slot.

26. The contact lens blister package or method or other embodiment of any preceding or following embodiment/feature/aspect, wherein the clip is configured to be inserted into a slot of a second thermoplastic base member such that the thermoplastic base member is interlocked with the second thermoplastic base member.

27. The contact lens blister package or method or other embodiment of any preceding or following embodiment/feature/aspect, wherein the clip further comprises a bottom surface that is angled and defines a barb configured to be inserted into a slot of a second thermoplastic base member from a first direction and the slot of the second thermoplastic base member is configured to prevent the barb from exiting in a second direction, opposite the first direction.

28. The contact lens blister package or method or other embodiment of any preceding or following embodiment/feature/aspect, wherein the clip further comprises a first end having a tapered surface defining a first barb and a second end having a tapered surface defining a second barb, wherein the first barb and the second barb are configured to be inserted into a slot of a second thermoplastic base member from a first direction and the slot of the second thermoplastic base member is configured to prevent the first barb and the second barb from exiting in a second direction, opposite the first direction.

29. The contact lens blister package or method or other embodiment of any preceding or following embodiment/feature/aspect, wherein the clip further comprises a key protruding therefrom, wherein the key is positioned to fit within a notch of a second thermoplastic base member.

30. The contact lens blister package or method or other embodiment of any preceding or following embodiment/feature/aspect, wherein the key is off-centered from a center of a length of the clip in a position that mirrors the notch.

31. The contact lens blister package or method or other embodiment of any preceding or following embodiment/feature/aspect, wherein a position of the key and the notch is configured such that when the key is inserted into a notch of a second thermoplastic base member, the second thermoplastic base member is oriented in a specific manner relative to the thermoplastic base member.

32. The contact lens blister package or method or other embodiment of any preceding or following embodiment/feature/aspect, wherein the key is at a center of a length of the clip.

33. The contact lens blister package or method or other embodiment of any preceding or following embodiment/feature/aspect, wherein the clip is defined at a gripping portion end of the thermoplastic base member.

34. The contact lens blister package or method or other embodiment of any preceding or following embodiment/feature/aspect, wherein the connecting member is the stackable feature.

35. The contact lens blister package or method or other embodiment of any preceding or following embodiment/feature/aspect, wherein the stackable feature comprises a receptacle formed at the top surface of the flange.

36. The contact lens blister package or method or other embodiment of any preceding or following embodiment/feature/aspect, wherein the receptacle is located on the gripping portion, in between a gripping portion end and the blister cavity.

37. The contact lens blister package or method or other embodiment of any preceding or following embodiment/feature/aspect, wherein the stackable feature further comprises a post extending downward from the bottom surface, wherein the post is configured to friction fit or interference fit within a receptacle of a second thermoplastic base member.

38. The contact lens blister package or method or other embodiment of any preceding or following embodiment/feature/aspect, wherein the post and the receptacle have a common central axis.

39. The contact lens blister package or method or other embodiment of any preceding or following embodiment/feature/aspect, wherein the stackable feature comprises at least one female ridge defined on an inner sidewall of the bowl, and at least one male ridge defined on an outer sidewall of the bowl.

40. The contact lens blister package or method or other embodiment of any preceding or following embodiment/feature/aspect, wherein the at least one male ridge is configured to friction fit or interference fit within at least one female ridge of a second thermoplastic base member.

41. The contact lens blister package or method or other embodiment of any preceding or following embodiment/feature/aspect, wherein the stackable feature comprises a plurality of clips extending downward from an outer perimeter of the flange, and a plurality of notches defined at the outer perimeter in between the plurality of clips.

42. The contact lens blister package or method or other embodiment of any preceding or following embodiment/feature/aspect, wherein each of the plurality of clips is configured to mechanically fasten to a respective notch of a plurality of notches of a second thermoplastic base member.

43. The contact lens blister package or method or other embodiment of any preceding or following embodiment/feature/aspect, wherein the plurality of clips each comprise a tapered end defining a barb configured to interlock with a respective notch of a second thermoplastic base member.

44. The contact lens blister package or method or other embodiment of any preceding or following embodiment/feature/aspect, wherein the liquid contact lens packaging solution is present in an amount from 0.4 mL to 1.6 mL.

45. The contact lens blister package or method or other embodiment of any preceding or following embodiment/feature/aspect, wherein the thermoplastic base member has a length from 40.0 mm to 50.0 mm, and a width from 25.0 mm to 35.0 mm.

46. The contact lens blister package or method or other embodiment of any preceding or following embodiment/feature/aspect, wherein the blister cavity has a depth from 5.0 mm to 8.0 mm.

47. The contact lens blister package or method or other embodiment of any preceding or following embodiment/feature/aspect, wherein the thermoplastic base member has a thickness, and the blister cavity is defined by a curved surface of the bowl having a thickness of X mm, and the flange of the thermoplastic base member has a thickness that is no greater than X.

48. The contact lens blister package or method or other embodiment of any preceding or following embodiment/feature/aspect, wherein the thermoplastic base member consists of a thermoplastic material having a flexural modulus from 1600 MPa (232,000 psi) to 1900 MPa (275,500 psi), as measured using the ISO 178 testing method.

49. The contact lens blister package or method or other embodiment of any preceding or following embodiment/feature/aspect, wherein the flange of the thermoplastic base member has a stiffness from 50,000 psi·mm$^2$ to 150,000 psi·mm$^2$.

50. The contact lens blister package or method or other embodiment of any preceding or following embodiment/feature/aspect, wherein the flange of the thermoplastic base member has a stiffness from 60,000 psi·mm$^2$ to 90,000 psi·mm$^2$.

51. The contact lens blister package or method or other embodiment of any preceding or following embodiment/feature/aspect, wherein the thermoplastic base member comprises a plurality of tabs depending from the top surface of the flange of the thermoplastic base member.

52. The contact lens blister package or method or other embodiment of any preceding or following embodiment/feature/aspect, wherein the plurality of tabs is two side tabs having a height from 2.0 mm to 4.0 mm, and a length from 6.0 mm to 10.0 mm.

53. The contact lens blister package or method or other embodiment of any preceding or following embodiment/feature/aspect, wherein the gripping portion of the flange is located at a proximal end of the flange and the blister cavity is located closer to a distal end of the flange.

54. The contact lens blister package or method or other embodiment of any preceding or following embodiment/feature/aspect, wherein the bowl of the thermoplastic base member has a concave interior surface and a convex exterior surface, and a plurality of stabilizing legs extend from the bottom surface of the flange of the thermoplastic base member and circumscribe the convex exterior surface of the bowl.

55. The contact lens blister package or method or other embodiment of any preceding or following embodiment/feature/aspect, wherein the plurality of stabilizing legs is three stabilizing legs positioned approximately 120 degrees apart from each other about a vertical axis extending through the center of the blister cavity.

56. The contact lens blister package or method or other embodiment of any preceding or following embodiment/feature/aspect, wherein the plurality of stabilizing legs each include a respective planar lower edge.

57. The present invention also relates to a method of manufacturing a packaged contact lens, comprising:

providing the contact lens blister package of any preceding claim;

placing the contact lens into the blister cavity of the thermoplastic base member;

placing a volume of the liquid contact lens packaging solution into the blister cavity of the thermoplastic base member; and sealing the sealing member to the sealing rim region of the thermoplastic base member.

58. The contact lens blister package or method or other embodiment of any preceding or following embodiment/feature/aspect, further comprising autoclaving the sealed contact lens blister package to sterilize the contact lens and the packaging solution.

59. The present invention further relates to a method of recycling the contact lens blister package or method or other embodiment of any preceding or following embodiment/feature/aspect, comprising:

removing the sealing member from the thermoplastic base member;

removing the contact lens from the blister cavity;

removing the liquid contact lens packaging solution from the blister cavity;

coupling two of the thermoplastic base members of two contact lens blister packages by inserting a gripping portion end of one thermoplastic base member into the hole of the second thermoplastic base member to form a thermoplastic base member assembly.

60. The contact lens blister package or method or other embodiment of any preceding or following embodiment/feature/aspect, further comprising coupling additional thermoplastic base members to the thermoplastic base member assembly to form an assembly comprising at least 30 thermoplastic base members coupled together to form a thermoplastic base member recycling unit.

61. The contact lens blister package or method or other embodiment of any preceding or following embodiment/feature/aspect, further comprising placing the thermoplastic base member recycling unit in a recycling receptacle.

The present invention can include any combination of these various features or embodiments above and/or below as set forth in sentences and/or paragraphs. Any combination of disclosed features herein is considered part of the present invention and no limitation is intended with respect to combinable features.

The disclosure herein refers to certain illustrated examples, it is to be understood that these examples are presented by way of example and not by way of limitation. The intent of the foregoing detailed description, although discussing exemplary examples, is to be construed to cover all modifications, alternatives, and equivalents of the examples as may fall within the spirit and scope of the invention as defined by the additional disclosure.

The entire contents of all cited references in this disclosure, to the extent that they are not inconsistent with the present disclosure, are incorporated herein by reference.

The present invention can include any combination of the various features or embodiments described above and/or in the claims below as set forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A contact lens blister package, comprising:

a thermoplastic base member having a weight from 0.40 g to 0.72 g and comprising a bowl that defines a blister cavity dimensioned to accommodate a contact lens, and a flange projecting away from the blister cavity, the flange having a top surface and a bottom surface, the flange providing a sealing ring region circumscribing the blister cavity at the top surface, and the flange providing a gripping portion configured to be held between a thumb and a finger of a contact lens wearer;

a liquid contact lens packaging solution provided in the blister cavity;

an unworn contact lens located in the contact lens packaging solution in the cavity; and a sealing member hermetically sealed to the sealing ring region of the thermoplastic base member to maintain the contact lens in a sterile condition.

2. The contact lens blister package of claim 1, wherein the thermoplastic base member has a weight from 0.50 g to 0.70 g.

3. The contact lens blister package of claim 1, wherein the thermoplastic base member comprises a recyclable plastic material.

4. The contact lens blister package of claim 1, wherein the thermoplastic base member comprises a polypropylene material.

5. The contact lens blister package of claim 1, wherein the sealing ring region has a non-circular configuration that includes a vertex.

6. The contact lens blister package of claim 1, further comprising a connecting member configured to mechanically fasten the thermoplastic base member to a second thermoplastic base member of another contact lens blister package.

7. The contact lens blister package of claim 6, wherein the connecting member is at least one of an interlocking feature and a stackable feature.

8. The contact lens blister package of claim 7, wherein the connecting member is the interlocking feature, and the interlocking feature comprises a hole, a clip, a latch, or a combination thereof.

9. The contact lens of claim 8, wherein the interlocking feature comprises the hole on the flange comprises one hole.

10. The contact lens blister package of claim 8, wherein the interlocking feature comprises the hole and the hole is a slot defined through the flange, the slot having a length greater than a width.

11. The contact lens blister package of claim 10, wherein the slot is located at a greater distance from the blister cavity than an outer perimeter of the flange.

12. The contact lens blister package of claim 10, wherein the width of the slot is from 0.5 mm to 1.5 mm and the length of the slot is from 3.0 mm to 13.0 mm.

13. The contact lens blister package of claim 10, wherein the slot comprises a notch defined at an edge of the slot.

14. The contact lens blister package of claim 13, wherein the notch is off-centered from a center of the length of the slot.

15. The contact lens blister package of claim 10, wherein the interlocking feature further comprises the clip having dimensions configured to fit through the slot.

16. The contact lens blister package of claim 15, wherein the clip is configured to be inserted into a slot of a second thermoplastic base member such that the thermoplastic base member is interlocked with the second thermoplastic base member.

17. The contact lens blister package of claim 16, wherein the clip further comprises a first end having a tapered surface defining a first barb and a second end having a tapered surface defining a second barb, wherein the first barb and the second barb are configured to be inserted into a slot of a second thermoplastic base member from a first direction and the slot of the second thermoplastic base member is configured to prevent the first barb and the second barb from exiting in a second direction, opposite the first direction.

18. The contact lens blister package of claim 16, wherein the clip further comprises a key protruding therefrom, wherein the key is positioned to fit within a notch of a second thermoplastic base member.

19. The contact lens blister package of claim 18, wherein the key is off-centered from a center of a length of the clip in a position that mirrors the notch.

20. The contact lens blister package of claim 18, wherein a position of the key and the notch is configured such that when the key is inserted into a notch of a second thermoplastic base member, the second thermoplastic base member is oriented in a specific manner relative to the thermoplastic base member.

21. The contact lens blister package of claim 15, wherein the clip further comprises a bottom surface that is angled and defines a barb configured to be inserted into a slot of a second thermoplastic base member from a first direction and the slot of the second thermoplastic base member is configured to prevent the barb from exiting in a second direction, opposite the first direction.

22. The contact lens blister package of claim 15, wherein the clip is defined at a gripping portion end of the thermoplastic base member.

23. The contact lens blister package of claim 1, wherein the liquid contact lens packaging solution is present in an amount from 0.4 mL to 1.6 mL.

24. The contact lens blister package of claim 1, wherein the thermoplastic base member has a length from 40.0 mm to 50.0 mm, and a width from 25.0 mm to 35.0 mm.

25. The contact lens blister package of claim 1, wherein the blister cavity has a depth from 5.0 mm to 8.0 mm.

26. The contact lens blister package of claim 1, wherein the thermoplastic base member has a thickness, and the blister cavity is defined by a curved surface of the bowl having a thickness of X mm, and the flange of the thermoplastic base member has a thickness that is no greater than X.

27. The contact lens blister package of claim 1, wherein the thermoplastic base member consists of a thermoplastic material having a flexural modulus from 1600 MPa (232,000 psi) to 1900 MPa (275,500 psi), as measured using the ISO 178 testing method.

28. The contact lens blister package of claim 1, wherein the flange of the thermoplastic base member has a stiffness from 50,000 psi·mm$^2$ to 150,000 psi·mm$^2$.

29. The contact lens blister package of claim 1, wherein the thermoplastic base member comprises a plurality of tabs depending from the top surface of the flange of the thermoplastic base member.

30. The contact lens blister package of claim 1, wherein the bowl of the thermoplastic base member has a concave interior surface and a convex exterior surface, and a plurality of stabilizing legs extend from the bottom surface of the flange of the thermoplastic base member and circumscribe the convex exterior surface of the bowl.

* * * * *